United States Patent [19]

Basic, Sr.

[11] Patent Number: 4,516,510

[45] Date of Patent: May 14, 1985

[54] INCINERATOR WITH TWO REBURN STAGES AND, OPTIONALLY, HEAT RECOVERY

[76] Inventor: John N. Basic, Sr., 41 W. 202 Whitney Rd., St. Charles, Ill. 60174

[21] Appl. No.: 573,429

[22] Filed: Mar. 26, 1984

Related U.S. Application Data

[62] Division of Ser. No. 248,054, Mar. 27, 1981, Pat. No. 4,438,705.

[51] Int. Cl.[3] ..... F23G 7/06

[52] U.S. Cl. ..... 110/346; 110/210; 110/211; 110/212; 110/213; 110/214; 110/345

[58] Field of Search ..... 110/346, 345, 210, 211, 110/212, 213, 214

[56] References Cited

U.S. PATENT DOCUMENTS

| | | | |
|---|---|---|---|
| 1,957,921 | 5/1934 | White | 110/251 |
| 3,680,501 | 8/1972 | Szilagyi et al. | 110/212 |
| 3,792,671 | 2/1974 | Woods | 110/190 X |
| 3,844,233 | 10/1974 | Fishback | 110/212 |
| 3,875,874 | 3/1974 | Altmann . | |
| 3,995,568 | 12/1976 | Dvirka et al. | 110/190 |
| 4,246,850 | 1/1981 | Gravel | 110/235 |
| 4,270,467 | 6/1981 | Drake | 110/212 X |
| 4,317,417 | 3/1982 | Foresto | 110/211 |

FOREIGN PATENT DOCUMENTS

| | | |
|---|---|---|
| 2096770 | 10/1970 | Australia . |
| 317401 | 8/1974 | Austria . |
| 2227614 | 6/1972 | Fed. Rep. of Germany . |
| 1261411 | 1/1972 | United Kingdom . |
| 1282982 | 7/1972 | United Kingdom . |

*Primary Examiner*—Edward G. Favors
*Attorney, Agent, or Firm*—Eugene F. Friedman

[57] ABSTRACT

A method of incinerating in a main combustion chamber leading directly to two consecutive reburn stages. The main combustion chamber accepts bulk refuse onto a hearth floor. In the first reburn tunnel, a burner maintains the temperature of the gases above a predetermined set point. Above that set point, the burner assumes a low setting. Below it, a high setting increases the heat produced. Alternatively, the gas may go to its high setting below a first set point; to its low setting above a second set point; and proportionate at temperatures between them. This chamber also receives outside air to assist in the actual combustion process. From the first reburn chamber, the gases go to a second reburn chamber to complete the combustion. There, they receive additional oxygen for this purpose. At temperatures above a set point determined near the third chamber, additional air enters to prevent excessive temperatures. Fume burning of hydrocarbon containing gases may also take place in the double reburn tunnel. The entering gases should have a velocity of about 40 ft./sec. and the entrained particles should have a size less than about 100 microns.

38 Claims, 30 Drawing Figures

S1
A
F1
F2
F3
T1
MS1
120 v 60~
MS3
MS2
M1
M2
M3
S2
F4
UPPER BLOWER MOTOR
LOWER BLOWER MOTOR
TOP BLOWER MOTOR
B
MS1
CR1
MS2
MS3
STAGE 1
TMR1
S3
TMR2
ASH DOOR INTERLOCK
STAGE 2
TMR1
TMR1
CR2
C
TMR2
TMR3
TMR2
RELAY
CR1
S4
TMR3
ILI
PURGE COMPLETE
BLOWER SWITCH
D
E

TC2
STAGE 2 TEMPERATURE CONTROLLER
5 13 14 15 3 10 11 12 2 1 4
T/C 2
THERMOCOUPLE SENSOR
J
K
X
2
3
ACT4
MOTOR OPERATOR FOR STAGE 2 FUEL
L1
L2
1
5
6
MOTOR OPERATOR FOR STAGE 3 AIR
ACT5
F
G
MOTOR OPERATOR FOR STAGE 2 AIR
ACT 6
MOTOR OPERATOR FOR STAGE 1 AIR
ACT 7
H
T
T/C 3
STAGE 3 THERMOCOUPLE
5 13 14 15 3 7 8 2 1 4
STAGE 3 TEMPERATURE CONTROLLER

FIG. 21a

| START UP & OPERATION | SYSTEM SAFETY INTERLOCK CONDITIONS | | | | | | | | | COMBUSTION SYSTEM OPERATING SYSTEMS | | | | | | | | | | | MAT'L HANDLING OPER CONDITION | |
|---|---|---|---|---|---|---|---|---|---|---|---|---|---|---|---|---|---|---|---|---|---|---|
| | CUPOLA CAP POSITION (189) | I.D. FAN (196) | EXCESSIVE STEAM PRESSURE | BOILER CONNECTION UNIT (191) | HIGH PRESSURE REBURN | LOW MAIN CHAMBER DRAFT | INLET TEMP TO SCRUBBER | LOW $H_2O$ UPPER LEVEL | LOW $H_2O$ LOWEST LEVEL | MAIN CHAMBER IGNITION BURNER (252) FUEL | MAIN CHAMBER IGNITION BURNER (252) AIR | MAIN CHAMBER OIL BURNER (257) FUEL | MAIN CHAMBER OIL BURNER (257) AIR | BLOWERS 1 & 2 (299) | BLOWER (381) | REBURN STAGE 2 BURNER (401) FUEL | REBURN STAGE 2 BURNER (401) AIR | REBURN STAGE 3 BLOWER (397) | LOADER (216) | MOVING FLOOR ASH REMOVER (185) | CUPOLA CAP POSITION (189) | |
| I SYSTEM ON | OPEN | X | N | | N | N | X | X | N | | ON | | ON | HIGH | HIGH | | ON | HIGH | | ON | OPEN | |
| II PURGE COMPLETE | OPEN | X | N | | N | N | X | X | N | | ON | | | LOW | LOW | | ON | LOW | | ON | OPEN | |
| III WARM-UP CYCLE | CLOSED | ON | N | A.F. | N | N | N | N | N | | ON | ON | ON | LOW | LOW | HIGH | ON | LOW | | ON | CLOSED | |
| IV STAGE 2 AT 1ST SET PT (WARM-UP CYCLE COMP) | CLOSED | ON | N | A.F. | N | N | N | N | N | ON | ON | | | HIGH | LOW | HIGH | ON | LOW | ON | ON | CLOSED | |
| V STAGE 1 ABOVE 1ST SET PT | CLOSED | ON | N | A.F. | N | N | N | N | N | | ON | | | X | X | X | ON | X | X | ON | CLOSED | |
| VI STAGE 2 BETWEEN 1ST AND 2ND SET POINTS | CLOSED | ON | N | A.F. | N | N | N | N | N | | ON | | | HIGH | LOW | X | ON | X | ON | ON | CLOSED | |
| VII STAGE 2 ABOVE 2ND SET PT | CLOSED | ON | N | A.F. | N | N | N | N | N | | ON | | | HIGH | HIGH | X | ON | X | ON | ON | CLOSED | |
| VIII STAGE 2½ BELOW 1ST SET PT | CLOSED | ON | N | A.F. | N | N | N | N | N | | ON | | | X | X | HIGH | ON | X | X | ON | CLOSED | |
| IX STAGE 2½ BETWEEN 1ST AND 2ND SET POINTS | CLOSED | ON | N | A.F. | N | N | N | N | N | | ON | | | X | X | H&L | ON | X | X | ON | CLOSED | |
| X STAGE 2½ ABOVE 2ND SET PT | CLOSED | ON | N | A.F. | N | N | N | N | N | | ON | | | X | X | LOW | ON | X | X | ON | CLOSED | |
| XI STAGE 3 BELOW 2ND SET PT | CLOSED | ON | N | A.F. | N | N | N | N | N | | ON | | | HIGH | X | X | ON | LOW | ON | ON | CLOSED | |
| XII STAGE 3 ABOVE 2ND SET PT | CLOSED | ON | N | A.F. | N | N | N | N | N | | ON | | | LOW | X | X | ON | HIGH | | ON | CLOSED | |
| COLUMN A | B | C | D | E | F | G | H | I | J | K | L | M | N | O | P | Q | R | S | T | U | V | |

SHUT DOWN

| COLUMN A | | | B | C | D | E | F | G | H | I | J | K | L | M | N | O | P | Q | R | S | T | U | V |
|---|---|---|---|---|---|---|---|---|---|---|---|---|---|---|---|---|---|---|---|---|---|---|---|
| XIII | MANUAL EMERGENCY BUTTON | | X | X | X | | X | X | X | X | X | | | | | | | | | | | | OPEN |
| XIV | | MODE 1 LOW $H_2O$ | X | X | N | | N | N | N | N | LOW | | | | | | | | | | | | OPEN |
| XV | | MODE 2 HIGH PRESSURE REBURN | CLOSED | N | N | | HIGH | N | N | N | N | | | | | | | | | | | | OPEN |
| XVI | AUTOMATIC SHUTDOWN | MODE 3 LOW MAIN CHAMBER DRAFT | CLOSED | N | N | | N | LOW | N | N | N | | | | | | | | | | | | OPEN |
| XVII | | MODE 4 STAGE 2 (ANYTIME) BURNER FAILURE | X | X | N | | N | N | N | X | N | | ON | | | LOW | LOW | | ON | LOW | | ON | OPEN |
| XVIII | | MODE 5 PURGE CYCLE INCOMPLETE | OPEN | X | N | | X | X | X | X | N | | ON | | ON | HIGH | HIGH | | ON | HIGH | | ON | OPEN |
| XIX | | MODE 1 I.D. FAN OFF | X | OFF | N | | N | N | N | N | N | | ON | | | X | X | X | ON | X | X | ON | OPEN |
| XX | PARTIAL SHUTDOWN | MODE 2 EXCESSIVE STEAM PRESSURE | X | N | HIGH | | N | N | N | N | N | | ON | | | X | X | X | ON | X | X | ON | OPEN |
| XXI | | MODE 3 HIGH INLET TEMP TO SCRUBBER | X | N | N | | N | N | HIGH | N | N | | ON | | | X | X | X | ON | X | X | ON | OPEN |
| XXII | | MODE 4 LOW $H_2O$ UPPER LEVEL | X | N | N | | N | N | N | LOW | N | | ON | | | X | X | X | ON | X | X | ON | OPEN |
| XXIII | | STEP 1 MANUAL | X | X | N | A.F. | N | N | N | N | N | | ON | ON | ON | LOW | X | X | ON | X | | ON | CLOSED |
| XXIV | NORMAL SHUTDOWN | STEP 2 AFTER TIMER #1 | OPEN | X | N | | N | N | N | N | N | | | | | LOW | LOW | | | LOW | | ON | OPEN |
| XXV | | STEP 3 AFTER TIMER #2 | OPEN | X | X | | X | X | X | X | X | | | | | | | | | | | | OPEN |

FIG. 21b

INCINERATOR WITH TWO REBURN STAGES AND, OPTIONALLY, HEAT RECOVERY

This is a division of application Ser. No. 248,054, filed Mar. 27, 1981 now U.S. Pat. No. 4,438,705.

BACKGROUND

As municipal land waste areas continue to become completely filled, alternate methods of refuse disposal assume an increasingly large importance. The aggrandizement of this problem, moreover, results in efforts to totally destroy the refuse, especially through burning. This undertaking, however, must comply with current environmental restrictions. Yet, burning the material and thus attempting to recover the heat produced represents an especially tantalizing goal in this age of excessively high energy costs.

The environmentally acceptable burning of refuse and other wastes constitutes the objective of many drastically different types of incinerators. Almost all aspects of the combustion process and equipment have engendered widely divergent techniques and components in attempting to control the burning and, more importantly, the resulting air pollutants.

To begin with, various incinerators impose specific requirements upon the refuse which they will burn. Some incinerators require the removal of various noncombustible components prior to the entry of the remaining portions into the combustion chamber. The sorting process, of course, requires the expenditure of substantial economic resources for the labor or machines that accomplish the task. It also slows down the overall disposal system.

Other incinerator systems actually require the shredding of the waste before it can burn. The grinding, of course, entails the use of expensive machinery to reduce the collected waste into an acceptable form. Furthermore, prior to the commencement of the grinding, a selection process must remove at least some egregious components; gasoline cans, for example, can explode and destroy the grinder and, perhaps, people in the near vicinity. Accordingly, the additional grinding and, usually, sorting steps impose additional machinery, costs, and time onto the disposal process.

Reducing the waste into a shredded form apparently has the objective of creating a uniform type of material which will burn predictably. This permits the incinerator designer to construct the apparatus with the knowledge that it will have a specific known task to accomplish. However, once in the incinerator, the shredded waste creates an additional problem; it permits the very rapid burning of the material at possibly excessive temperatures. The resultant high gas velocities within the chamber can entrain particulate matter into the exhaust stream. These large amounts of particulates will then escape the incinerator to create prohibited, or at least undesired, smoke.

The main combustion chambers that the entering refuse initially encounter have also witnessed a wide degree in variation of designs. Some incinerators place the refuse upon a grate bed. This allows the air or other oxygen-containing gas to readily and uniformly intermingle with the refuse to assure complete combustion. However, unburned ash, plastics, wet refuse, and liquids may simply drop down through the grates to the bottom of the incinerator. There they undergo combustion and can provide excessive heat to the incinerator's lower surface and grating structure, possibly damaging them. Then can also stay and otherwise alter the actual floor of the chamber.

A hearth, or refractory, floor represents an alternative to the grate support for refuse. However, a hearth floor interposes other problems in attempting the effective and efficient combustion of refuse.

Initially, the refuse upon the floor must receive an even distribution of oxygen in order for the bulk of the material to burn. This throughput of oxygen does not occur if the air simply passes into the combustion chamber over the burning refuse; it must enter undeneath the waste material and disperse throughout. The uniform dispersion of the air into the waste requires the placement of air nozzles within the hearth floor itself. However, the heavy refuse sitting upon the floor has shown an unmistakeable propensity to clog and destroy the effectiveness of the air-introducing nozzles. As a result, the refuse does not undergo efficient and thorough combustion.

To prevent the clogging of nozzles in a hearth floor, some incinerators force the air through at a high velocity. This hopefully avoids the clogging problem. However, the fast-moving gases again display a propensity to entrain particles and produce smoke. Furthermore, the high velocities have a tendency to create a "blow torch" effect and produce slag. The slag may then stick to the hearth floor and interfere with the chamber's subsequent operation.

Further, incinerators current in use also employ drastically different geometric designs for the initial combustion chamber. For example, some use a tall compartment occupying a relatively small horizontal area. Others utilize cylindrical chambers with the main axis of cylindrical symmetry lying horizontally. Most also use chambers with a minimal volume to permit the burning of the intended refuse. All of these factors, again, however, increase the velocity of gases passing through and thus the entrainment of particulate, smoke-producing material.

Many incinerators also attempt to control the amount of air entering the first combustion chamber. They select the quantity of oxygen and thus, presumably, the combustion rate within the main chamber. Thus, some incinerators use an amount of air far in excess of the quantity required to stoichiometrically burn the refuse inside. Others employ a "starved air" process and permit the entry of substantially less air than dictated by stoichiometry.

The large amounts of air in the former system again help to entrain particulate matter. These excess air systems attempt to control this problem by choking the output of the main combustion chamber. However, a small throat itself increases the gas velocity in the vicinity which can thus defeat the main goal of avoiding the entrainment of particles.

The starved air systems, in comparison, do not provide sufficient oxygen to achieve the combustion of the material placed inside. However, the heat developed in the main chamber effects the volatilization of much of the introduced hydrocarbon material. As these hydrocarbons assume the vapor form, they can create very substantial positive pressure within the main combustion chamber. These pressures, as the gases inside attempt to escape, actually create high velocities. These velocities again entrain particulate matter which results in smoke.

Furthermore, the positive pressures inside the starved-air combustion chamber may also force its internal gases into the area immediately surrounding the chamber. In an enclosed room, the combustion gases pass into areas occupied by the operating personnel. Moreover, the lack of oxygen in the starved-air process does not permit the burning hydrocarbons to convert to water and carbon dioxide; carbon monoxide frequency represents a very substantial component in this type of chamber. The internal positive pressures can then force the carbon monoxide into the area where the operating personnel may breathe it. Accordingly, the starved-air system should should typically have a location outside of a building or in an extremely well ventilated area.

The incinerators of the days before environmental concern simmply released their exhaust gases from the combustioin chamber into the atmosphere. The obviously detrimental effect of these gases upon the environment has resulted in prohibitions on their continued use. Moreover, it has led to the development of additional techniques for controlling the pollutants produced in the combustion chamber.

Efforts to control pollution have often centered upon the use of a reburn tunnel to effectuate further combustion of the main combustion chamber's exhaust. The gases, upon departing the main combustion chamber, immediately enter the reburn unit. The tunnel may include a burner to produce heat and a source of oxygen, usually air, to complete the combustion process. The additional oxygen, of course, represents an essential ingredient for the starved-air incinerators. Depending upon the material introduced in the main chamber, the reburn unit provides a set amount of fuel to the burner and a specified amount of oxygen.

Typically, the incinerator's manufacturer sets the burner level and the amount of oxygen for the amount and kind of waste he expects the incinerator to receive. When the main chamber does, in fact, receive the expected refuse, the reburn unit can effectively provide a "clean" exhaust.

However, deviations in the amount or quality of the refuse place unexpected strains and requirements on the reburn unit. This can cause the unit to lose its ability to prevent atmospheric pollution. When this occurs, the incinerator system, with the reburn unit, will release unacceptable amounts of pollutants into the atmosphere.

Furthermore, many incinerators, while attempting to avoid degrading the environment, have also sought to recover the heat produced by the combustion. Some try to capture heat directly within the main combustion chamber. Others choose to locate a boiler past the reburn unit, where employed. Maximizing the recovery of the produced energy while avoiding substantial pollution, however, has not yet yielded to a satisfactory solution.

SUMMARY

An incinerator system should have the capability of effectuating the combustion of refuse without the production of unacceptable pollution. In particular, it should display the ability to effectively respond to the varying kinds and amounts of refuse fed into most incinerators generally encountered at most installations. Thus, changing the actual content and quantities of the refuse within wide ranges should not cause the incinerator system to become a polluter. Moreover, for further economy, the incinerator should operate in this fashion upon bulk refuse without any pretreatment.

An incinerator system accomplishing this objective, of course, must have an enlosed main combustion chamber. In this component occurs the initial and primary burning of refuse.

The main combustion chamber, of course, has a first inlet opening which permits the introduction of the solid bulk refuse. This opening typically has a location in a wall at the beginning of the main chamber. The chamber must also have an outlet opening. This permits the egress of the gaseous products of combustion. Usually, the outlet constitutes an opening in the roof at the opposite end of the chamber from the inlet door.

Even under the best of conditions, which, however, almost never occur, the main chamber process produces serious amounts of pollutants. Accordingly, the gaseous combustion products, after leaving the main combustion chamber, immediately enter a first reburn chamber where they undergo further processing. The first reburn tunnel, of course, has a second inlet opening which couples to and has fluid communication with the outlet of the main combustion chamber. It also has a second outlet opening which permits the gaseous products of combustion within the first reburn tunnel to pass out of it.

The gas stream entering the first reburn tunnel typically include particulate hydrocarbons, combustible materials in a liquid form, and vaporized materials. This material, thus, requires additional heat to liquify the solids, vapporize the liquids, and to bring the vapors to a temperature where they will then undergo complete combustion. Accordingly, the materials entering the first reburn tunnel usually require substantial additional heat. For this purpose, the first tunnel includes a burner located near its inlet. The burner consumes a fuel and produces the desired heat.

The amount of heat required by the entering gas stream, however, radically varies depending upon the amounts and kinds of refuse recently introduced into the main chamber. Excessive heat represents an undesireable situation. First, it wastes expensive fuel. Second, it can cause the combustible matter in the tunnel to prematurely burn with insufficient oxygen and thus produce carbon monoxide. Third, it can raise the temperature within the second chamber to excessive and perhaps destructive levels. Accordingly, the burner should have a high and a low setting to permit the burning of different amounts of fuel and the creation of varying amounts of heat.

Naturally, within the first reburn tunnel, the combustible matter continues to burn. Accordingly, it has a need for further oxygen. The main chamber may provide the burning refuse with a stoichiometric amount of this ingredient. However, due to imperfect mixture, the oxygen from the main chamber may not always combine with sufficient intimacy to assure total combustion. Accordingly, the first reburn tunnel may also include a first plurality of jets which can provide it with air or some other oxygen-containing gas into the tunnel. These jets extend at least about half the distance between the inlet and the outlet in order to gradually provide the required oxygen. Furthermore, the air from these jets may also create the mixing turbulence required to achieve proper combustion.

A first oxygenating device must then couple to the first plurality of jets. It has the purpose of introducing the oxygen-containing gas through these jets and into the first reburn tunnel.

As with the burner, the varying conditions encountered in the first reburn tunnel may indicate the need for differing amounts of air. Clearly, adding excessive amounts of air in this region will unacceptably cool the gas stream. The cold gas stream then does not reach a combustion temperature, and the hydrocarbon material may not undergo complete burning to carbon dioxide and water. On the other hand, the entrance of large amounts of material into the first reburn tunnel will require greater amounts of oxygen to sustain the burning process. Accordingly, the oxygenating means for the first tunnel must have high and low settings at which it introduces the different amounts of the oxygen-containing gas.

As indicated thus far, the burner and the oxygenating means in the first reburn tunnel can both operate at different levels. The conditions within the first reburn tunnel itself should dictate the actual settings of these two components. They may then respond to the changing requriements as developed within the first tunnel itself.

Temperatures determined at various points within the first tunnel can provide an indication as to the combustion conditions occurring there. Accordingly, the incinerator system must include a first sensor which determines a first temperature within the first tunnel. A controlling device then couples to the first sensor and to the burner. A temperature above a first predetermined set point would generally indicate the need for less heat from the burner. Accordingly, at a temperature above the set point, the controller will place the burner in its low setting.

At a temperature below a second predetermined set point, the first tunnel requires the most heat it can obtain from the burner. Accordingly, below this set point, the controller will place the burner in its high setting. Obviously, the second set point cannot exceed the first set point, although they may equal each other. When the second set point sits below the first set point, the burner may respond, although it need not necessarily do so, by assuming proportionate settings.

The same or a different sensor can also determine a second temperature within the first tunnel. A second controller then responds to the second temperature. It determines the appropriate setting for the first oxygenating device. High temperatures indicate greater amounts of combustible material and perhaps the necessity for a slight cooling in the first tunnel. In response, the controller places the first oxygenating means in its high setting. At a low temperature, neither requirement exists, and the controller places the oxygenating device in its low setting to conserve heat.

After the passage through the first reburn tunnel, the gases have about reached the condition in which they can undergo complete combustion. However, they require an additional unit in which this process can safely occur without damaging the environment. Accordingly, the gas stream from the first reburn tunnel passes thorugh a third inlet opening into a second reburn tunnel.

At this juncture, the gasses may have preferably received stoichiometric air within the main combustion chamber and additional air in the first reburn tunnel. However, the gases require yet additional oxygen in the second reburn tunnel to complete their burning. Accordingly, the second tunnel incorporates a second plurality of jets spaced at least half the distance between its third inlet opening and its third outlet opening. A second oxygenating device provides an oxygen-containing gas through these jets into the second tunnel.

Again, the varying conditions regularly encountered in waste incineration require that the second tunnel respond to differing conditions of the entering gases. Accordingly, the second oxygenating device will also have high and low settings. These provide the second reburn tunnel with the different amounts of air or other oxygen-containing gas.

Again, temperature represents a suitable indicator of the condition of the gases in the second reburn tunnel. Accordingly, a third sensing means determines a temperature in or near the third reburn tunnel and relays that information to a third controller. Temperatures above a fourth set point indicate both a large amount of combustible material within the second tunnel and the need for a cooling effect. Accordingly, at these temperatures, the controller places the second oxygenating device in its high setting.

At temperatures below the set point, the large amount of air can unacceptably cool the gas stream within the second tunnel. In response, the second controller places the second oxygenating means in its low setting to avoid this undesired effect.

The gases passing out of the second tunnel should have undergone complete combustion to the nonpolluting carbon dioxide and water. Specifically, it should have minimal amounts of carbon monoxide, oxides of nitrogen, hydrocarbons, or particulates.

Other pollutants, of course, do not disappear even though the materials have undergone properly controlled combustion. In particular, chlorine and the oxides of sulfur will remain as undesired pollutants. The presence of these components will indicate the need for further treating components to remove them.

With such exceptions, two reburn tunnels take a gas stream containing pollutants and place it into an environmentally acceptable condition. Accordingly, they may find use not only for treating the flue gases from a main combustion chamber, but from other sources as wall. These include chemical processes or other combustion chambers. Naturally, to operate effectively, the two reburn tunnels, when acting as a fume burner, may impose limitations on the gas stream entering them. For example, the size of particulates containing combustible matter and the velocity of the entering gas stream may have to remain below prescribed upper limits.

The reburn tunnels, regardless of the source with which used, may advantageously include a double walled plenum and their exterior. The oxygenating device, usually in the form of blowers, forces air into these plenums. The jets, which introduce the air into the first and second tunnels, then connect into and receive their air from the plenum. The air passing through the plenums will then likely capture the heat passing through the walls of the tunnels. Thus, the plenums act as a sort of dynamic insulating device to prevent the loss of substantial heat from the tunnels. Furthermore, the entering air has a cooling effect upon the tunnel walls and helps prevent their destruction.

The jets may introduce the air at an actue angle relative to the direction of travel of the main gas stream. This assists in the introduction of the air and creates the necessary turbulence for effective mixing and combustion. Furthermore, by forcing the air through these jets at that angle, the blowers also help create an induced draft that keeps the gases moving through these tunnels.

The incinerator system may include additional control devices to prevent the development of excessive and possibly damaging heat in the third chamber. Thus, temperatures above an acceptable set point may cause the burner in the first reburn tunnel to turn off. In the presence of chlorines, however, this should not occur; the heat in the second chamber is also required to strip the chlorine from the hydrocarbons to which it has attached.

Furthermore, excessive second reburn tunnel temperatures may cause the oxygenating device within the main chamber to go to a lower setting. This slows the rate of combustion and reduces the temperature throughout the entire system.

Lastly, in the case of an incinerator with an automatic loader, excessive third-stage temperatures may simply turn that item off. Thus, no additional refuse can enter the system to provide additional undesired heat at this point. When the temperature in the third stage again falls below the upper set point, all of these processes reverse and the system operates as before.

The structure of the main combustion chamber can help provide a gas stream imposing less sever requirements upon the reburn tunnels. It can also result in the most desired, id est, smallest volume ash.

As discussed above, a hearth floor offers many advantages over a grate when used to support the entering refuse. However, for proper combustion, the air or other oxygen-containing gas must directly enter the mass of burning refuse. It must do so generally from underneath to assure a reasonably thorough mixing of the oxygen with the burning mass.

Providing a stepped configuration to the hearth floor permits the facile and efficient accomplishment of this task. Locating the nozzles for the incoming air within the vertical faces of the steps helps to preclude the refuse from entering and jamming the nozzles. Thus, although the refuses sits directly on the floor, the nozzles located in the step's vertical faces permit the passage of the air. Yet, they do not face upward and into the refuse which wold allow the refuse to enter and choke them off.

More specifically, the combustion chamber frequently includes four fire-resistant walls connected together. The first pair of walls face each other as do the second pair. The walls of each pair connect to the walls of the other pair.

A fire-resistant roof connects the walls while the fire-resistant hearth floor couples to them. The inlet opening appears in one of the walls while the outlet generally constitutes an opening in the roof.

The vertical steps in the hearth floor generally have an alignment that runs perpendicular to the wall with the inlet opening and thus parallel to the two walls that connect to it. Substantially horizontal flat planes then interconnect adjacent steps. The air nozzles, extending substantially all of the distance between the pair of walls including the inlet door, sit in the vertical faces. The air then passes through the nozzles immediately prior to entering the combustion chamber.

Air entering through the nozzles of the main chamber can, of course, entrain particulate matter from the burning refuse. This especially applies to the air entering through the nozzles in a hearth floor located directly underneath the burning refuse.

As discussed above, the starved-air chamber possesses significant drawbacks that limit its desireability. Accordingly, the main chamber should generally receive at least within 10 percent of a stoichiometric amount of air for its designed amount of Btu's that it will handle. Forcing a large portion of this amount of air through the nozzles in the floor creates the danger of entraining and lifting particulates from the refuse. These particulates can then pass through the outlet of the incinerator system as smoke pollution.

However, limiting the velocity of the air passing through the nozzles will reduce and perhaps prevent the entrainment of particulate matter by the entering air. As an upper limit, the air should leave these nozzles with a velocity of no greater than about 300 ft./min. Preferably, it should move slower than about 150 ft./min. These velocities, barely perceptible to the human sense of touch, help avoid the entrainment of particulate matter from the burning refuse.

A large amount of air must pass into the chamber. However, the slow velocity of that air implies the requirement of a large cross-sectional area through which this air passes immediately prior to entering the main chamber. Providing a large number of nozzles with more than minimal openings accomplishes this result.

The shape of the main combustion chamber can also affect its ability to cleanly handle the gaseous material placed and developed inside. Accordingly, on vertical cross-sectional planes taken parallel to its walls, it should display a substantially rectangular configuration. This overall configuration, however, encompasses the use of the hearth floor with the rows of steps running perpendicular to the wall with the inlet opening.

The rectangular shape avoids the development of high gas velocities in the narrower regions of other configurations. Particularly in the case of circular cross-sections, the top and the bottom of the chamber constitute small and confined regions. The gases passing through these areas achieve great velocities which can lift undesireable amounts and kinds of particulates.

Furthermore, relative to the predetermined average amount of Btu's for which the main chamber is designed, it should present a relatively low profile. Furthermore, it should have an elongated configuration extending from the wall with the inlet toward the outlet; this allows the refuse placed inside to burn gently.

In particular, the length of the wall with the inlet opening and also its counterpart on the other side of the incinerator should about equal its height. More specifically, the ratio of these two figures should fall in the range of about 1:0.9 to 1:1.1. The distance between the wall with the inlet, and its counterpart should greatly exceed either of these figures. Specifically, the ratio of this distance to the length or the height of the wall with the inlet should fall within the range of about 2:1 to 3.5:1.

Furthermore, the chamber should have an adequate area and volume for the combustion to take place. This avoids the high gas velocities that accompany the burning in a more confined space. For stoichiometric air, the main chamber should have a sufficient horizontal area that the ratio of its designed burning capacity to this area is within the range of about 75,000 to 135,000 Btu./sq.ft. hr. The ratio of the designed capacity to its volume should fall generally within the range of about 7,000 to 15,000 Btu./cu.ft. hr. In the case of refuse without a substantial amount of pigment material, the latter ratio should then come within the range of about 10,000 to 15,000 Btu./cu.ft. hr.

The combustion within the main chamber, of course, produces heat. Removing the maximum possible amount of heat from the main chamber, however, will deleteriously affect the burning process; it will require excessive amounts of added fuel to achieve the proper treatment of the combustion products with any subsequent reburn unit. Moreover, it may lower the temperature to a point where chemically combined atoms, such as chlorine, cannot strip from the hydrocarbons.

However, the main chamber does have some excess heat which can be recovered in the usual fashion. Typically, this involves passing a fluid heat exchange medium through a conduit in or in contact with the main combustion chamber to capture radiant heat.

The combustion gases passing through the reburn unit, however, require all the heat that they have as well as additional heat from a burner. Accordingly, no heat recovery should occur within the reburn unit. In fact, the reburn unit should typically have insulation to prevent the escape of substantial heat and the defeat of the processes occurring there.

After passing through the reburn unit, however, the gases, now completely burned, have substantial heat which they may provide for other usable purposes. Passing these completely burned gases through a recovery unit effectuates the capture of this energy.

Thus, the main chamber produces sufficient heat to allow the recovery of some energy. The gases in the reburn unit, however, should retain substantially all of their heat and usually require additional heat from the burner in order to destroy various pollutants. After passage from the reburn unit, however, substantial further heat recovery may occur.

BRIEF DESCRIPTION OF THE DRAWINGS

FIGS. 21*a* and 21*b* give a block diagram showing the operation of the incinerator-boiler of FIGS. 14 to 20.

DETAILED DESCRIPTION

Figure 1:
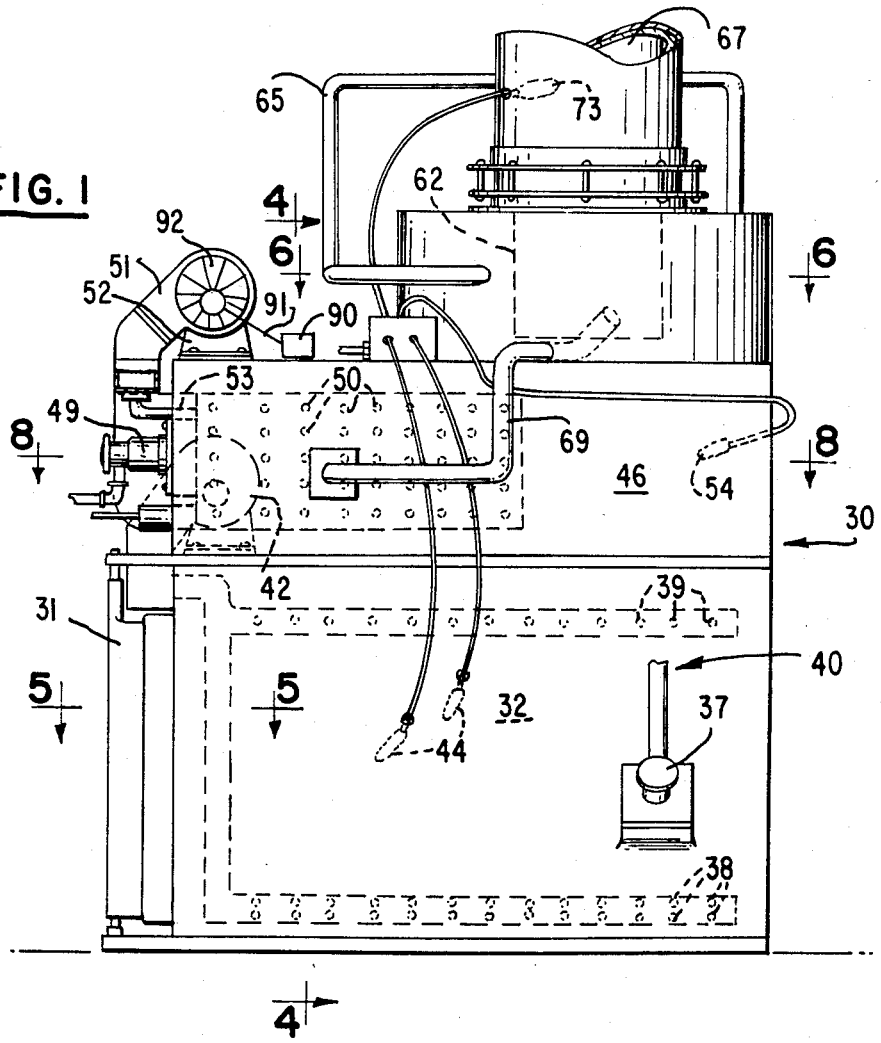
FIG. 1 presents a side elevational view of a refuse incinerator utilizing three combustion stages.

The incinerator, shown generally at 30 in FIG. 1, includes first the access door 31 for batch feeding refuse into the main combustion chamber 32. The main chamber 32 constitutes the first stage of the incinerator.

The auxiliary burners 37 employ an auxiliary fuel, such as gas or oil, to ignite refuse placed in the combustion chamber 32. It also helps to maintain the temperature level in the chamber 32 should it begin to decrease because of the moisture content in the refuse. The burners 37 receive their air from the second stage air plenum, discussed below, through the airduct 40.

The main combustion chamber 32 has both the underfire air jets 38 and the overfire air jets 39. These provide the oxygen required to maintain the refuse burning. To move the air into the main combustion chamber, the motor 42 powers the blower 43 which forces air into the plenum 40 and to the jets 38 and 39. Lastly, the sensors 44 measure the temperature within the main combustion chamber 32.

Figure 3:
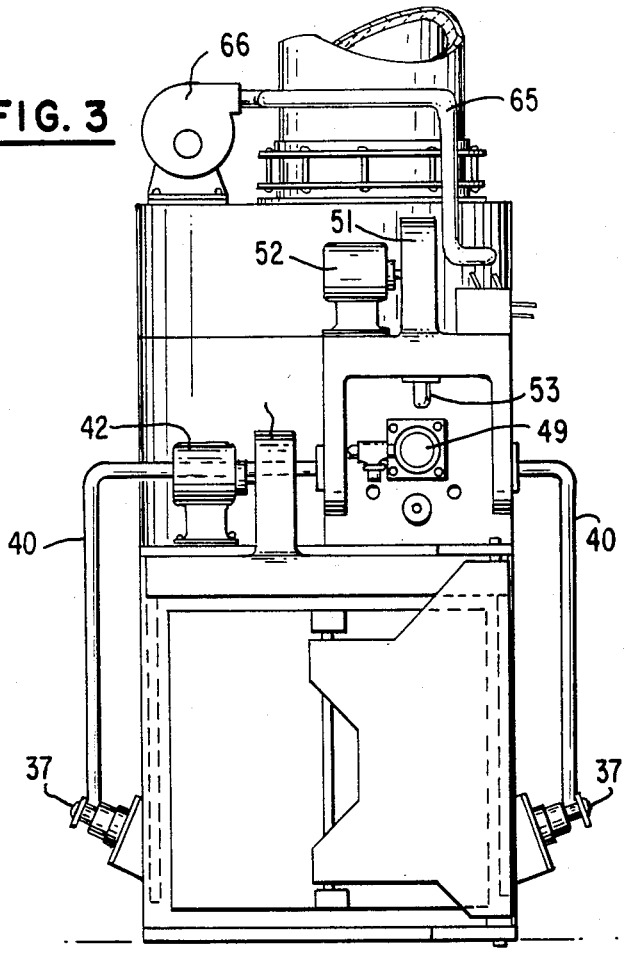
FIG. 3 is an end elevational view of the incinerator of FIG. 1 as seen from the left in that figure.
Figure 4:
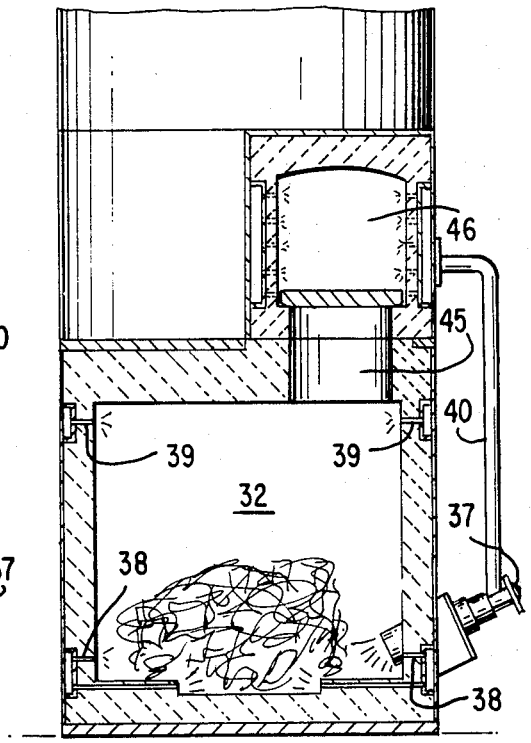
FIG. 4 gives a cross-sectional view along the line 4—4 of the incinerator of FIG. 1.

The products of combustion from the main combustion chamber 32 pass through the orifice 45, seen in FIG. 4, and then into the second stage 46 of the combustion system. To maintain the proper combustion conditions, the second stage 46 includes the burner 49 in FIG. 3, shown operating on gas. Further, the air jets 50 provide secondary combustion air from the blower 51 powered by the motor 52. The blower 51 provides a stronger and larger jet of air through the large nozzle 53 over the burner 49. The ceiling in the second stage 46 becomes especially hot. The air from the enlarged nozzle 53 cools it down to an acceptable, nondestructive temperature. The second stage 46 also includes the temperature sensor 54.

Figure 6:
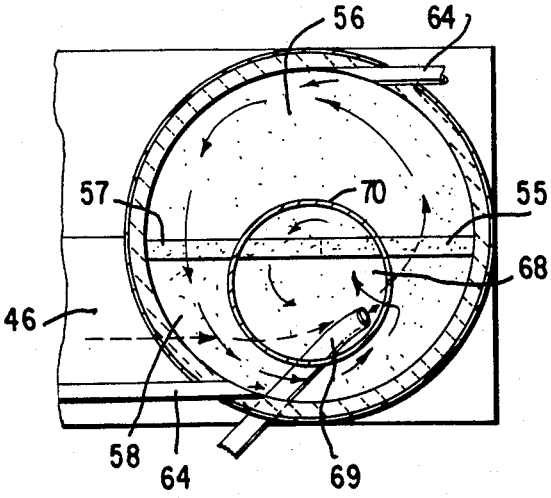
FIG. 6 gives a cross-sectional view of the third stage along the line 6—6 of the incinerator of FIG. 1.

From the second stage 46, the products of the yet incomplete combustion pass through the orifice 55 and move in a horizontal direction into the initial section 56 of the third combustion stage seen in FIG. 6. The first section 56 of the third stage sits at the same horizontal level as does the second stage 46. The gases, because of their heat, then rise over the wall 57 and into the upper combustion space 58 of the third stage. The upper space 58 overlies the second combustion stage 46.

Figure 2:
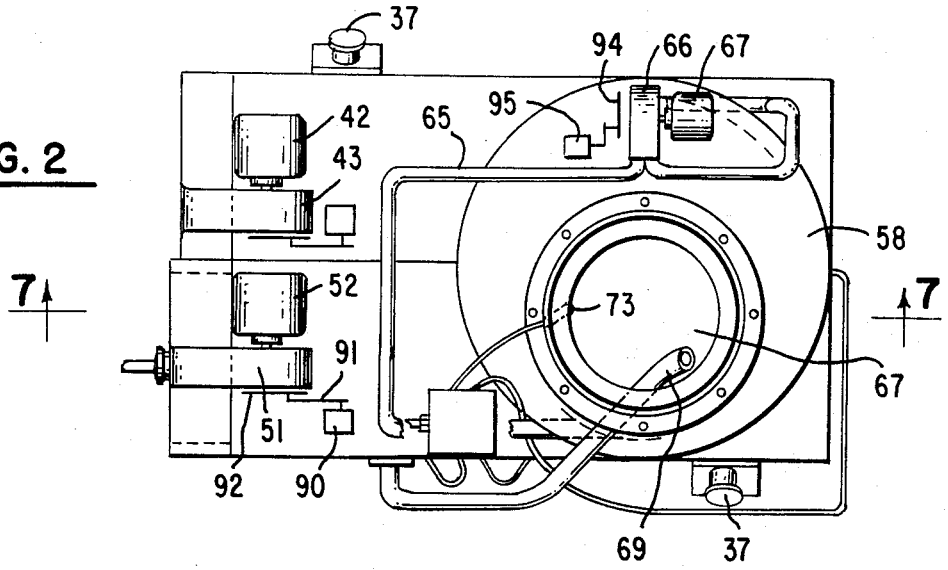
FIG. 2 gives a top plan view of the incinerator of FIG. 1.
Figure 7:
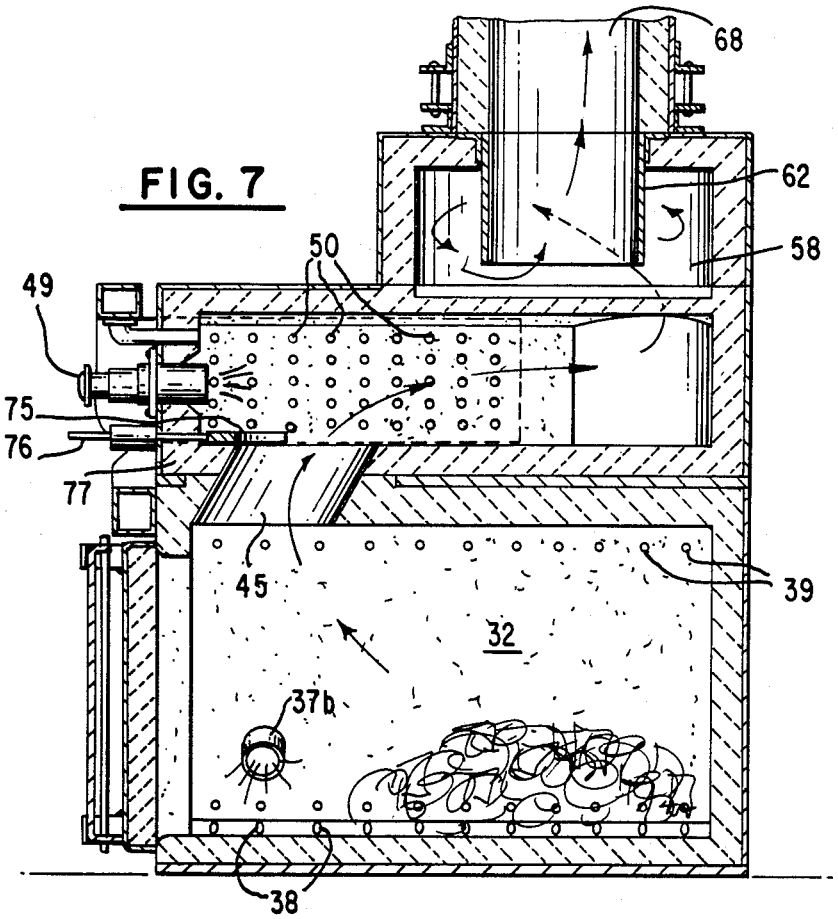
FIG. 7 gives a cross-sectional view along the line 7—7 of all three incinerator stages of FIG. 2.

In order to move out of the upper combustion space 58, gases must pass underneath the cylindrical baffle 62 in FIG. 7. This somewhat tortuous path for the gases thus increases their residence time in the upper combustion chamber 58 of the third stage. The jets 64 in FIG. 6 provide additional air to the combustion gases in the upper chamber 58. The air enters the chamber 58 in a tangential direction to create cyclonic mixing with the gases. The air for the jets 64 first passes through the plenum 65, seen in FIGS. 2 and 3 fed by the blower 66 which the motor 67 operates.

Due to the draft of the stack, the combustion gases eventually pass underneath the baffle 62 and into the stack 68, in FIG. 6. There the jet 69 supplies the final air required for complete combustion. The air from the jet 69 also serves to cool the metallic skin 70 of the stack 68. The sensor 73 in FIGS. 1 and 2 measures the temperature of the gases in the stack 68. The jet 69 receives its air from the blower 51 which provides the air for the jets 50 and the nozzle 53 of the second stage 46 as well.

If the amount of refuse in the main combustion chamber 32 falls below its designed rate, the chamber's temperature may become unacceptably low. Under these conditions, a reduced size for the orifice 45 would keep sufficient heat in the main chamber 32 so that its temperature will remain at an acceptable level. Accordingly, the cover 75 sets over the orifice 45 as seen in FIG. 7. With insufficient refuse in the chamber 32, the cover 75 can move over the orifice 45 to close it off to the extent necessary to maintain an appropriate temperature level in the main chamber 32. When additional refuse enters the main chamber 32, the cover 75 moves away from the orifice 45. The operation of the cover 75 can come under automatic, as well as manual, control.

The rod 76 connects to the cover 75 and passes through the chamber wall 77 to the exterior. There, the operator may manipulate the rod 76 to move the cover 75.

Figure 5:
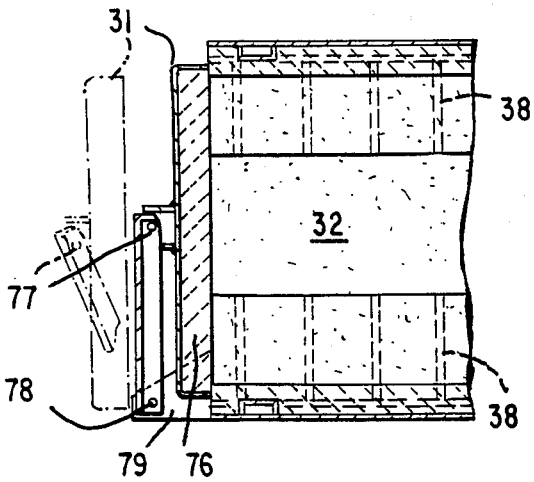
FIG. 5 is a cross-sectional view of the access door along the line 5—5 of the incinerator of FIG. 1.

In FIG. 5, the access door 31 to the main chamber 32 appears in its closed position in solid lines and in its open position in phantom. The door 31 has the refractory covering 76. It thus becomes a part of the insulated furnace body when closed.

The door 31 has the double pivot at the points 77 and 78 to assure its proper seating and a good furnace seal when closed. The brackets 79 attach the second pivot point 78 to the main chamber 32.

In the main chamber 32, seen in FIG. 4, the particulate matter produced in the combustion should have a low lift velocity. This has the purpose of avoiding the lifting of particles from the combustion chamber into, eventually, the environment. To achieve this result, the chamber has a geometry and sufficient size so that the gases passing through it, when heated, have an overall velocity of less than two feet per second. Ideally, the lift velocity should remain below one foot per second. In other words, the gases, at their operating temperature, move no faster than this uppper limit. This takes into consideration the fact that a gas, when heated, expands and creates its own velocity when departing a defined chamber. The lift velocity is defined as the vertical velocity of the gases in the main combustion chamber at its operating temperature.

To avoid increasing the vertical velocity of the gases, the underfire nozzles 38 and the overfire nozzles 39 introduce their air horizontally into the chamber 32. Furthermore, although the air travels through the jets 38 and 39 at a high velocity, they introduce a low volume of gas. This minimizes the average lift velocity throughout the entire chamber 32. Thus, the introduction of the air through the jets 38 and 39 does not introduce a substantial vertical component of motion in the chamber 32.

additionally, limiting of the total amount of air introduced into the main chamber 32 controls the vertical lift in that chamber. Sealing the main chamber 32 and providing air only through the jets 38 and 39 and the burner heads 37 achieves this result.

Further, the temperature of the main chamber 32 should remain under fairly strict control. The temperature should remain sufficiently high to burn the fixed carbon in the refuse. This represents the carbon that does not readily volatilize from the refuse in the chamber. Typically, burning the fixed carbon requires a temperature of at least around 1400° F. It also requires a sufficient residence time of the burning mass for the air and charcoal to combine and undergo combustion.

On the other hand, should the temperature become excessively high, the gases will leave the fixed-volume chamber with an unacceptably high velocity. Moreover, the excessive temperature will volatilize inert matter within the combustible refuse such as zinc oxides and other filler material. Zinc oxide, one of the more common fillers used for coatings and to impart opacity to web substrates, volatilizes at around 1500° F. Other such materials generally volatilize at higher temperatures. As a consequence, the temperature in the main chamber 32 should remain within the range of about 1400° to 1500° F.

To assist in maintaining the proper temperature, the chamber 32 receives an amount of air equal to the stoichiometric amount of its designed Btu rate of the furnace plus or minus 10 percent. If more than this amount enters the chamber, the burning becomes accelerated and the average furnace temperature can rise dramatically.

Adding even more air can then induce a cooling effect. This will reduce the temperature even below 1400° to 1500° F. At that point, of course, the vast amount of introduced air increases the vertical velocity of the gases far beyond the desired upper limit of two feet per second.

An insufficient amount of air produces a condition known as "starved air" combustion. This results in an insufficient temperature in the combustion chamber.

Additionally, the starved air process displays other drawbacks. Initially, it creates carbon monoxide instead of carbon dioxide. This dangerous gas can escape into the environment from the main chamber. As a result, this type of combustion chamber lacks suitability for closed buildings.

Furthermore, the starved air process requires the retention of most of the heat that it generates in order to volatilize combustible materials that may later fully burn. Accordingly, the starved air chamber generally has a small throat at its exit port in order to retain the heat in the main chamber. Specifically, it typically has a release rate as high as 20,000 Btu per square inch of area of the release port. This small opening retains much of the volatized gases within the main chamber and can create a positive pressure on the inside. When opening an access port to the chamber, the internal pressure can force the carbon monoxide as well as burning gases to the chamber's exterior through the port.

By way of comparison, the exit port 45 from the main chamber 32 has a designed release rate of approximately 15,000 Btu per square inch. As a result, the main chamber has a slight negative partial pressure compared to the outside and avoids forcing gases into the room where it sits. Moreover, the introduction of a stoichiometric amount of air results in the formation of carbon dioxide as opposed to carbon monoxide.

A high moisture content in the refuse or other factors could cause the temperature in the chamber 32 to fall below the desired 1400° F. To prevent this condition, the burners 37 can utilize gas or oil to increase the temperature in the main chamber 32 to the desired level.

The 1400° to 1500° F. mentioned above refers to the average temperature throughout the chamber 32. The combustible mass may display an actual fire temperature which exceeds or falls below the average temperature. However, by utilizing a large burning mass, as opposed to introducing small chips of material, most of the refuse, while it burns, experiences the average burning temperature.

In summary, introducing a stoichiometric amount of air for the design capacity of the main chamber 32 achieves two results. First, it assures the burning of all of the fixed carbon. Using less than stoichiometric air would not provide sufficient oxygen to burn the fixed carbon. Moreover, most of the fixed carbon could not undergo volatilization, notwithstanding the elevated heat levels in the main chamber. Consequently, a significant portion of the fixed carbon would remain unburnt and greatly increase the volume of the resultant ash.

Second, as stated above, the stoichiometric air allows most of the material in the main chamber 32 to burn. A "starved air" system causes material in the refuse to volatilize. The volume of this volatilized material increases the total quantity of gases within the main chamber. The movement of this larger volume of gases creates a greater lift velocity within the main chamber. Thus, providing stoichiometric air tends to avoid producing the volatilized hydrocarbons and minimize the lift velocity of the gases in the main chamber 32. This helps avoid the entrainment of particulate matter from there into the environment.

The total volume of the main chamber 32 also affects the temperature of the burning occurring in its interior. Thus, the chamber 32 should have a sufficient volume to preclude its rated heat production from exceeding about 12,000 Btu per cubic foot per hour. Generally, the heat production should fall in the range of about 10,000 to 15,000 Btu per cubic foot per hour. Decreasing the volume, the thus increasing the volume of this figure, will result in the temperature of the main chamber increasing beyond the desired limit.

Particular circumstances may suggest or even dictate a deviation in the indicated volume of the incinerator as related to its heat production. For example, in material with paint products, the temperature should remain lower to avoid vaporizing the pigment material it contains and which later can condense on cooler parts of the system. In this instance, the main chamber should have a sufficient volume to keep the heat production to about 7,500 Btu per cubic foot per hour.

The horizontal area of the main chamber has a direct affect upon the lift velocity of the gases in the main chamber.

The following formula gives the velocity of the gas in the main chamber 32;

$$v=Q/A \quad (1)$$

where v represents the gas velocity in the main chamber;

Q represents the amount of air introduced into the main chamber; and

A represents the chamber's area.

Rearranging this formula gives:

$$A=Q/v \quad (2)$$

As stated above, ideally, the velocity v should amount to about one foot per second. The volume of air introduced Q must stoichiometrically burn the contents inside. To obtain the figure for the required volume of air requires a knowledge of the amount of waste introduced into the incinerator and the Btu content per pound of that waste.

Thus, for a typical municipal system, the furnace may have to burn approximately 40,000,000 Btu per hour. As a generally accepted approximation, dividing that Btu figure by 100 gives the cubic feet of air per hour used by the furnace. In this example, burning the refuse requires 400,000 cubic feet of air each hour. Dividing this amount by 3,600 indicates a need for 111 cubic feet of air per second.

However, this represents the volume of air at standard conditions. At the elevated temperature of about 1400° F. and assuming an ideal gas, the volume increases by a factor of 3.57. Thus, the chamber at burning temperature receives 396 cubic feet of air each second. According to formula (2) above, then, the furnace must have an area of around 396 square feet.

Generalizing the foregoing calculations, the area of the main chamber 32 should suffice to preclude its rated Btu capacity from greatly exceeding 100,000 Btu per square foot per hour. It loosely falls in the range of 75,000 to 125,000 Btu per square foot per hour.

In the second chamber 46, the combustion products of the main chamber 32 receive an excess of air. This provides the combustible materials with sufficient oxygen to assure their complete burning. As stated above, the refuse in the main chamber receives a stoichiometric amount of oxygen; nonetheless, imperfect mixing between the refuse and the oxygen results in less than complete burning. The additional air introduced into the second stage 46 guarantees an adequate supply to complete the combustion process.

Figure 8:
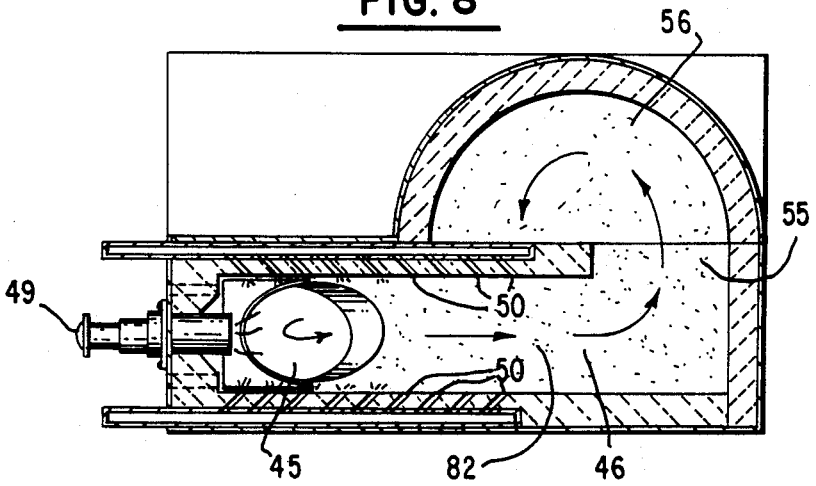
FIG. 8 gives a plan cross-sectional view of the second stage of the incinerator along line 8—8 in FIG. 1.

The additional air enters the second stage 46 through the jets 50. As shown in FIG. 8, the jets 50 introduce the air at a 45° angle relative to the pathway of the gases indicated by the arrow 82 in FIG. 8. This helps to move the combustion ingredients through the second stage 46. Moreover, the angle at which the streams of air from the jets 50 enter the chamber 46 creates turbulance and mixes the air with the combustion gases to complete the burning.

The amount of unburned volatile gaseous material entering the second chamber 46 depends upon the momentary reactions taking place in the main chamber 32. Thus, at a particular time after the introduction of a refuse of a particular type, a bloom, or surge, of volatiles may pass through the second chamber 46. This surge requires an additional amount of oxygen from the jets 50 to assure complete combustion.

The temperature sensor 54 controls both the air jets 50 and the burner 49. After the second stage 46 first reaches its operating temperature of 1500° F., the sensor 54 monitors the temperature of the combustion products passing through. The rising of the temperature above the second, or upper, preset limit, generally 1600° F., indicates the burning of greater amounts of volatile material within the second stage 46. The second stage 46 must then receive additional air to burn with the larger amount of volatile material. Also, the introduced air at the cool ambient temperature of outside the incinerator cools the second stage from its excessive temperatures.

To accomplish that, the sensor 54 in FIG. 1 couples to the controller motor 90 which the linkage rod 91 connects to the vanes 92 of the blower 51. The rising temperature, as detected by the sensor 54, causes the vanes 92 to open and allow more air to pass through the blower 51. This air then travels through the jets 50 and into the secondary chamber 46.

The sensor 54 also couples to the burner 49. The burner 49 maintains a sufficiently high temperature in the second stage 46 to insure the combustion of all volatiles.

When the second stage 46 reaches the first set point temperature of 1500° F., it no longer needs all of the heat which the burner 49 can supply. Consequently, the burner 49 has a valve controlled ultimately by the sensor 54. This valve lowers the burner 49 to keep the temperature in the second stage from rising unnecessarily and wasting auxiliary fuel.

When the temperature as detected by the sensor 54 falls below the upper preset level of 1600° F., the second stage 46 has less volatile matter passing through it. Consequently, the sensor 54 closes the vanes 92 to provide less air into the second stage 46. The smaller amount of air has a less cooling effect upon the contents of the second stage 46. Yet, the lesser amount of volatile material still has sufficient oxygen to complete its combustion.

Further, the lowering of the temperature in the second stage 46 may require additional heat from the burner 49. The burner 49, in fact, should provide sufficient heat to maintain the second stage 46 at the first set point of 1500° F. The resulting temperature then effectuates the proper combustion of the volatile material in the second stage.

Similarly, the heat sensors 44 detect the temperature in the main chamber 32. When the chamber 32 contains insufficient refuse to maintain the desired temperature of 1400° F., the sensors 44 increase the amount of fuel feeding into the burners 37. The additional heat produced by the burners 37 brings the temperature of the main chamber 32 to the desired level.

Should the temperature in the chamber 32 increase beyond the desired 1400° F., the sensors 44 turn down the burners 37. This prevents the buildup of excessive heat within the chamber 32.

The gases leaving the exit port 55 of the second stage 46 must follow a tortuous path until they enter the main stack 68. Moreover, these gases have only a very small space beneath the baffle 62 through which they pass to reach the main stack 68. This small space retains the gases within the third chamber 58 and thus serves as a choke on the progress of the gases through the system.

Accordingly, this resistance to the progress of the gases increases their retention time in the system. It also creates greater turbulence and mixing of the introduced air with the combustion gases in the second chamber 46. The greater residence time, in addition, allows for the burning of the small particles as well as the vapors and the fumes. Retaining the gases also helps to maintain the second stage 46 within its desired temperature range without increasing the use of auxiliary fuel through the burner 49.

The gases in the third stage 58 receive air from two sources. First, cyclonic air, provided by the upper blower 66 powered by the motor 67, enters through the jets 64. This air also induces some mixing for more complete combustion. Further, the created cyclonic swirl increases the residence time of the gases in the third stage.

The thermal sensor 73 controls the amount of air introduced by the blower 66 through the ports 64. The third chamber 58 always receives some air from the jets 64. However, an increase in the temperature detected by the sensor 73 indicates that more volatile material has appeared in the chamber 58. This material, of course, supplies the detected heat. This additional volatile material requires additional air. Accordingly, above a lower set point of around 1750° F., the controller causes the iris 94 on the blower 66 in FIG. 2 to open further. This allows the blower 66 to provide a larger amount of air than it does below the first set point of 1750° F.

However, the motor 95 controlling the iris 94 has a response time of about 13 to 20 seconds. This allows for slow, gradual adjustments to the amount of air introduced into the third chamber 58. During this response time, the temperature within the third chamber may tend to reverse its prior trend, indicating the need for less alteration in the amount of air introduced. Accordingly, the iris 94 responds sufficiently slowly to allow for gradual changes rather than jumping between two values. Yet, at 13 to 20 seconds, it displays sufficient speed to allow for the introduction of enough air to prevent the development of smoke in the third chamber 58.

The sensor 73 also controls the blower 42 for the main chamber 32. A temperature in the third chamber 58 above the lower set point of 1750° F. indicates an excessive rate of combustion in the main chamber 32. The refuse causing the high temperature has already entered the main chamber 32; accordingly, the temperature there cannot be lowered by removing some refuse. However, lowering the amount of air introduced through the jets 39 slows down the combustion in the main chamber 32. The latter effect maintains the temperature in the third chamber 58 below the desired set point of 1850° F.

When the temperature at the sensor 73 drops below the lower set point of 1750° F., the reverse occurs. Accordingly, the air jets 64 provide the lower amount of air into the final combustion stage 58. And, the blower 42 introduces the higher, or normal, amount of air through the jets 39 into the main chamber 32.

If the third stage's temperature exceeds its upper set point of 1850° F., it is receiving too much heat from the second stage. In this instance, neither the second nor the third stage requires even the small amount of heat produced by the burner 49 at its minimum setting. The burner 49, however, cannot operate with less than a minimum volume of fuel passing through it. When the third stage sensor 73 rises above its upper set point, the burner 49 simply shuts off. Should the sensor 73 subsequently detect that the temperature in the third stage 58 has fallen below 1850° F., the valve on the burner 49 opens and its pilot light ignites the burner fuel.

Lastly, the air for the additional third-stage jet 69 comes from the second-stage blower 51. The jet 69 provides the air with a slightly upward and rotating direction around the incolog cylindrical baffle 62. This keeps the baffle 62 cool and below its destruction point. At the same time, the jet 69 helps provide a forced draft upwards through the main stack 67. This avoids the necessity of a tall stack for the third chamber.

Figure 9:
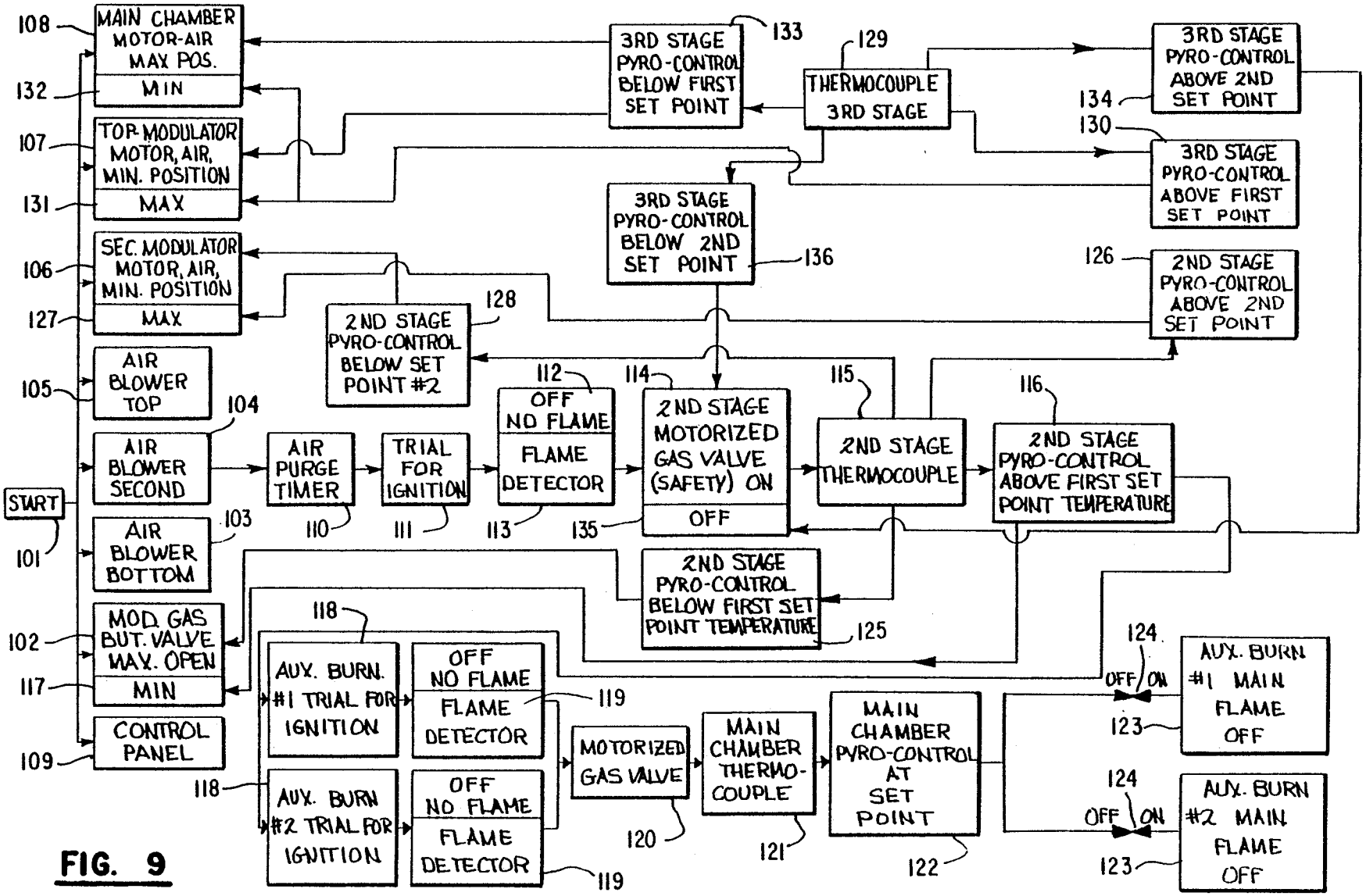
FIG. 9 gives a block diagram of the control circuit for the incinerator of FIGS. 1 through 8.
Figure 10:
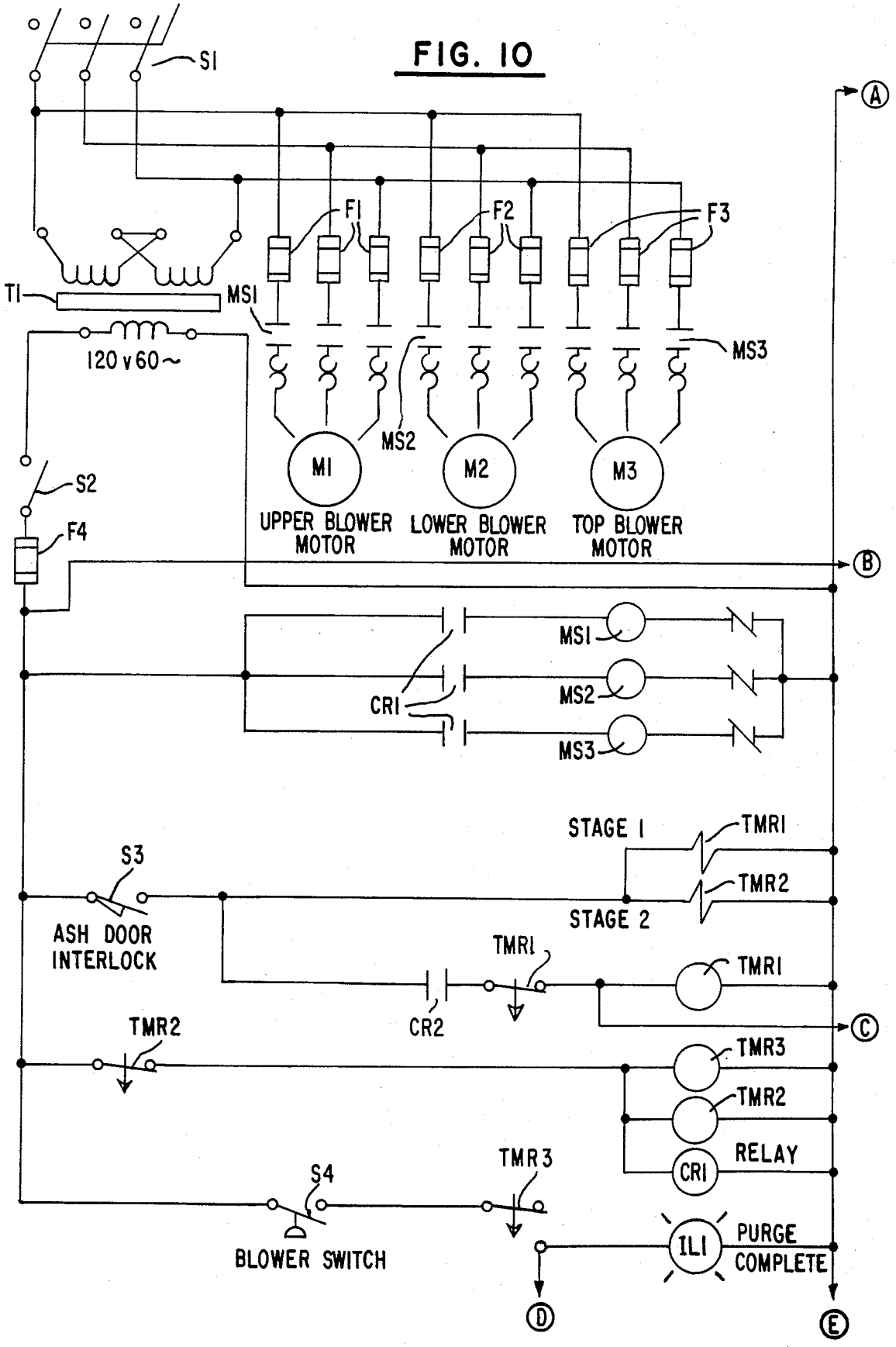
FIGS. 10 to 13 give the electrical circuitry, in a ladder diagram, to accomplish the control of FIG. 9.
Figure 11:
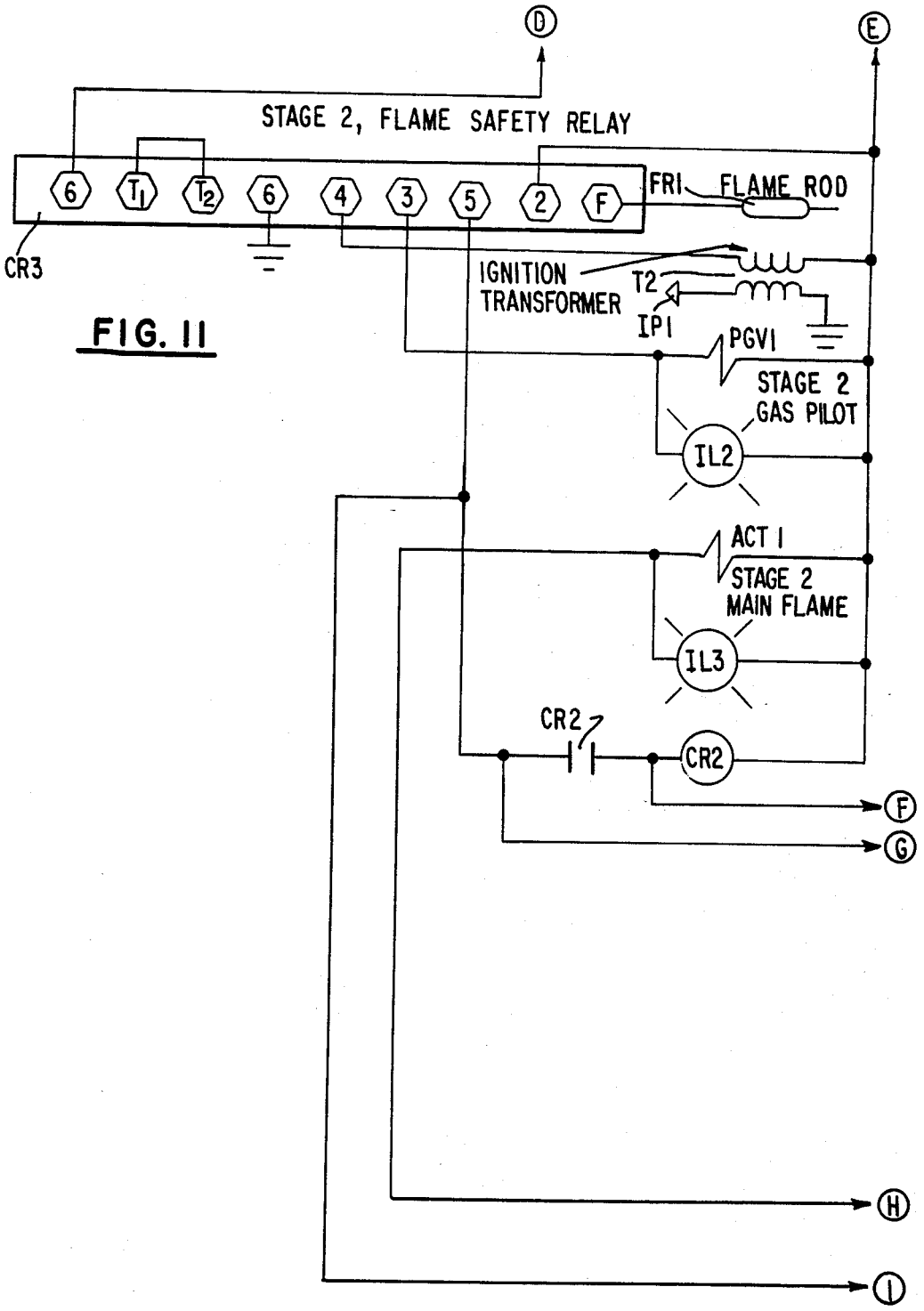
Figure 12:
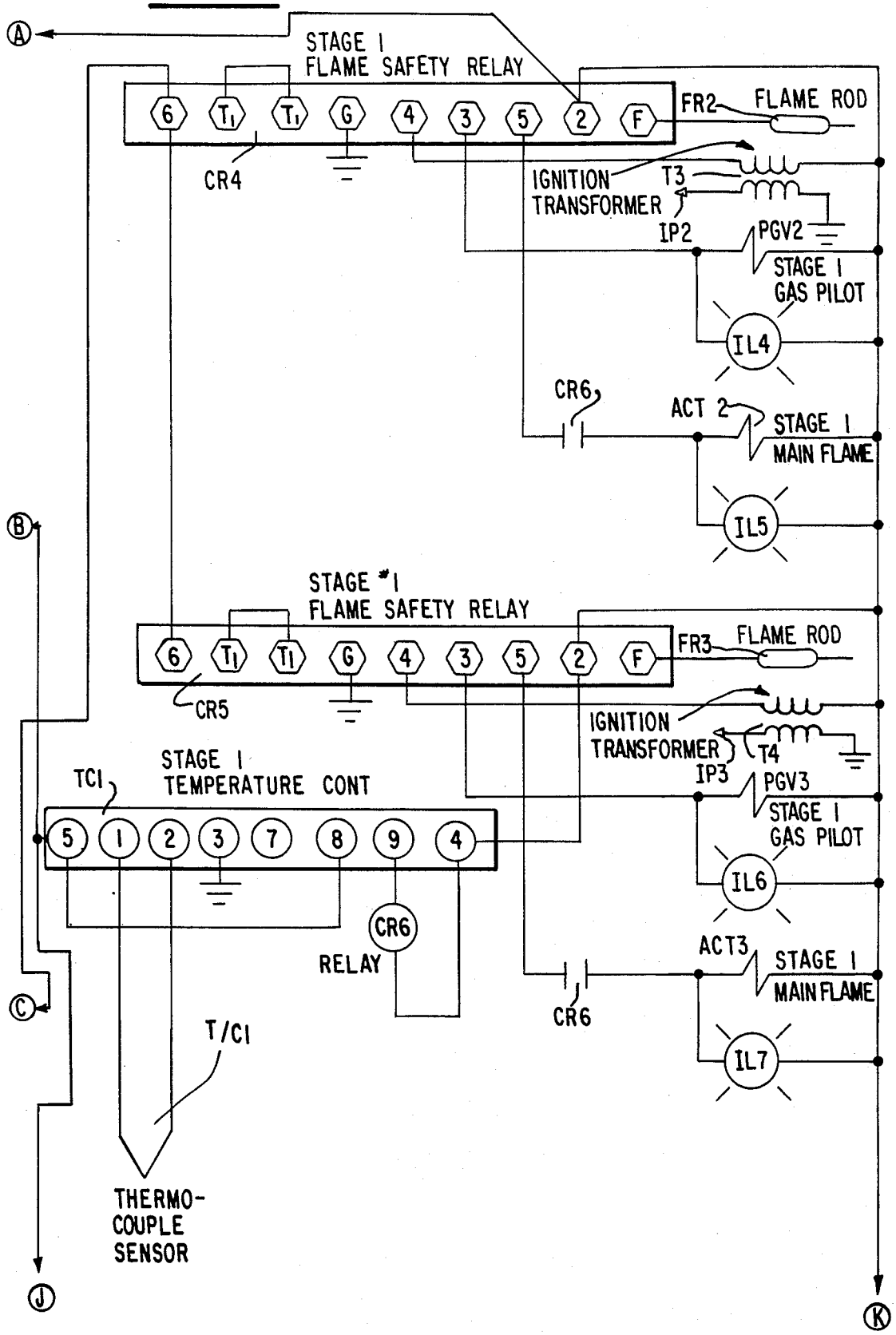
Figure 13:
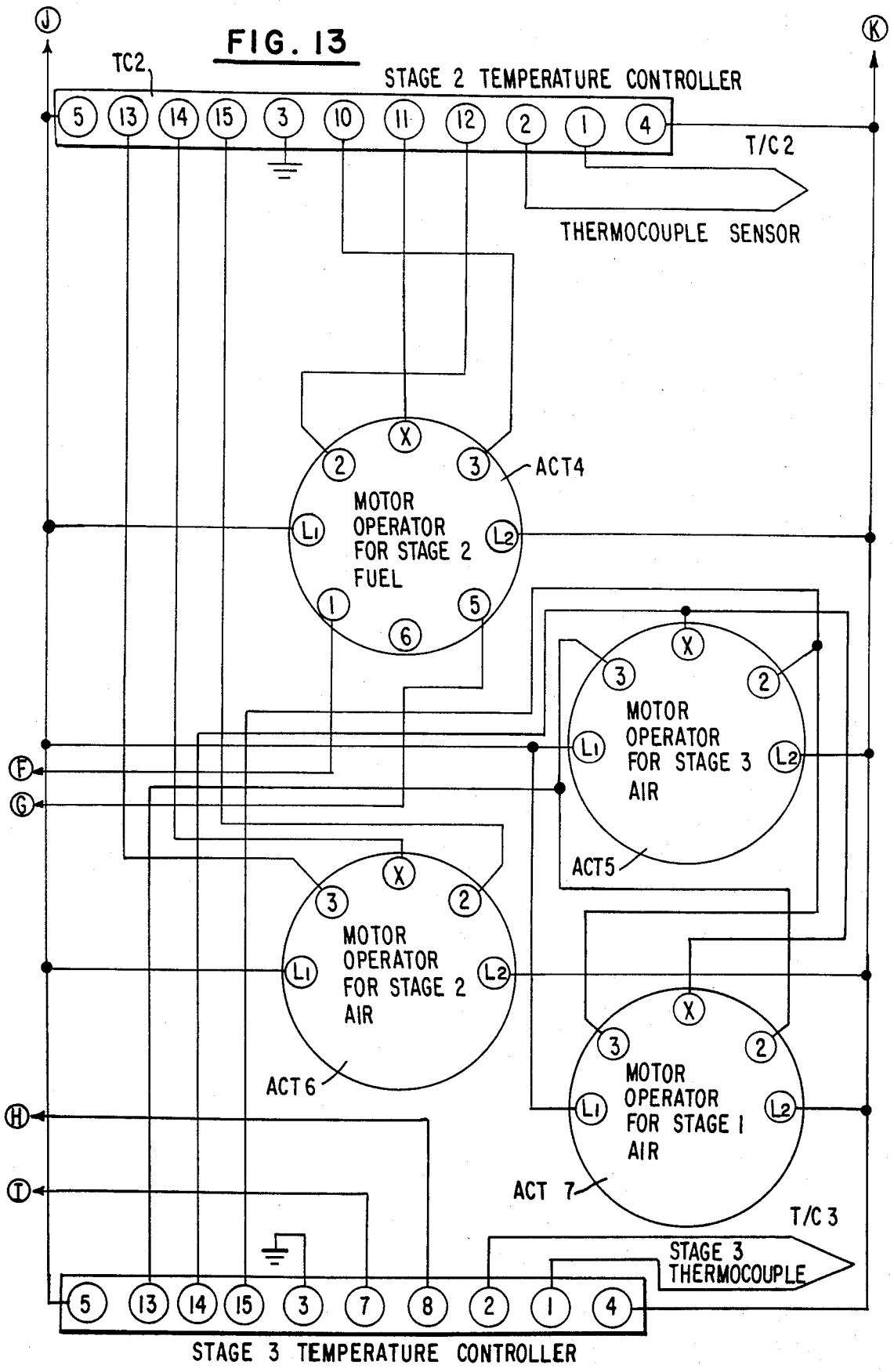

Upon pushing the start button 101 in FIG. 9, the valve to the burner 49 turns to its maximum open position as indicated by the square 102. The motors 42, 52 and 67 for the blowers 43, 51 and 66, respectively, go to maximum operation as shown by the squares 103, 104, 105. The modulator motors also position the irises on the blowers to their minimum positions as indicated by the boxes 106, 107, 108. The control panel also becomes electrically energized as indicated by the box 109; this includes the instruments, relays, and controls contained in the panel.

All of the combustion zones then receive a purge of air from the blowers before ignition commences. As indicated by the box 110, ignition can occur only after the air-purge timer has continued the purge for a sufficient period of time.

At the box 111, the pilot light to the burner 49 ignites. The flame detector determines whether this pilot has become lit. If not, it prevents the system from proceeding further as indicated by the box 112.

However, if the flame detector discovers a fire at the box 113, a motorized gas valve to the burner 49 opens, as indicated at the box 114. At the beginning, the burner 49 heats the second stage 46 to an acceptable temperature before any refuse enters the main chamber 32. The thermocouple 54, at the box 115, measures the temperature of the second stage 46. Specifically, it indicates, at the box 116, when the secondary chamber 46 has reached its first set point so that the system may proceed further.

At this point, the modulated gas valve in the burner 49 goes to its minimum level in order to conserve fuel, as indicated at the box 117. Also, the pilots for the main chamber burners 37 ignite as indicated by the box 118. If these actually become lit, then the detectors, at the box 119, allow the respective gas valves to turn on at the box 120 to heat the main chamber 32.

The thermocouples 44 detect the rise in temperature in the main chamber 32, as indicated at the box 121. The burners 37 continue at their maximum strength until the main chamber has reached its set point temperature of 1400° F. at the box 122. At 1400° F., the burners 37 in the main chamber turn off as indicated by the boxes 123.

Naturally, the temperature in the main chamber could subsequently fall below the set point. Should this occur, the on-off valves allow the burners 37 to turn back on and provide additional heat. The double arrows 124 indicate a continuing interplay between the measurements made by main chamber thermocouples, shown by the box 121, and the settings of the main chamber burners 37, indicated by the boxes 123. Typically, when the main chamber 32 receives refuse, the combustion of this material provides sufficient heat to keep the main chamber above its set point; with burning refuse inside, it rarely will have need for the burners 37.

As alluded to above, during the start-up operation, the second stage sensor 54 brings the second stage pyrocontrol to its first set-point temperature as indicated by the box 116. This places the modulating gas butterfly valve of the gas burner 49 at its minimum position shown in the box 117. The second-stage thermocouple, at the box 115, may also bring the pyrocontrol below its first set point at the box 125. This causes the second-stage gas burner 49 to return to its maximum setting at the box 102.

When the main chamber 32 contains burning refuse, the temperature detected by the second-stage thermocouple 54 may continue to rise. Eventually, as shown at the box 126, the second-stage pyrocontroller may exceed its second set point. This causes the modulator motor 90 for the second-stage blower 51 to go to its maximum air position as indicated at the box 127. More air then enters the second-stage 46 in order to achieve the combustion of the volatiles that have reached that portion of the incinerator from the first stage 32.

However, the second-stage pyrocontroller may, at times, sense, at the box 128, that the temperature of the second stage has fallen below its second, or upper, set point. That causes the modulator motor for the air to the second stage to go to its minimum position as indicated at the box 106. Thus, the thermocouple 54 may sense, at the box 115, the temperature falling above or below the upper set point of the second stage pyrocontroller at the boxes 126 and 128, respectively. This causes the modulator motor for the air to the second stage to introduce the minimum or maximum air at the boxes 106 and 127 respectively. As the result in either event, the second stage 46 receives the proper amount of oxygen to burn the volatiles reaching it.

The ignition in the main chamber 32 gives rise to volatiles which rise through the second stage and may reach the third stage where they complete their combustion. This combustion heats the third chamber as does the burning occurring in the second stage 46. The thermocouple 73 in the third stage 58 detects the temperature of the third stage as shown in the box 129.

The temperature of the third stage may rise above the first set point of the third stage pyrocontroller. When this occurs, the third stage pyrocontroller, at the box 130, introduces the maximum amount of air through the third stage blower 66, shown at the box 131. This action provides an adequate oxygen supply to burn all the material reaching the third stage as well as a cooling effect. The pyrocontroller also causes the modulator motor for the air in the main chamber 32 to go to its minimum position indicated at the box 132. The overall rate of combustion in that chamber then declines in order to avoid flooding the third stage with an amount of volatiles that it cannot handle.

The third stage pyrocontroller also operates reversibly about its first set point. Thus, if the thermocouple 73 sensing at the box 129 detects that the third stage has fallen below its first set point, the third stage pyrocontroller, at the box 133, causes the modulator motor for the main chamber air to return to its maximum position at the box 108. This maintains the usual rate of combustion in that area. Further, the modulator motor for the air in the third stage returns to its minimum position at the box 107 since the third stage now needs less air.

The temperature in the third stage can continue to rise and be detected by the thermocouple 73 at the box 129; it may eventually exceed the second set point of the third stage pyrocontroller at the box 134. Should that occur, the second stage motorized safety gas valve turns completely off, as seen at the box 135. This occurs since the products of combustion have become sufficiently hot to maintain the temperature realm in the second and third stages with no additional fuel. When the temperature falls below the third stage's second set point, the third stage pyrocontroller, at the box 136, turns on the motorized safety gas valve for the second stage burner 49 at the box 114.

FIGS. 10 to 13 provide an electrical circuit that will properly control the incinerator shown in FIGS. 1 to 8. The components that have found use in the circuit appear in the Table. During the time that the third stage pyrocontroller lies below its second set point and the second stage pyrocontroller exceeds its first set point, the second stage burner 49 utilizes its minimal amount of gas.

Figure 14:
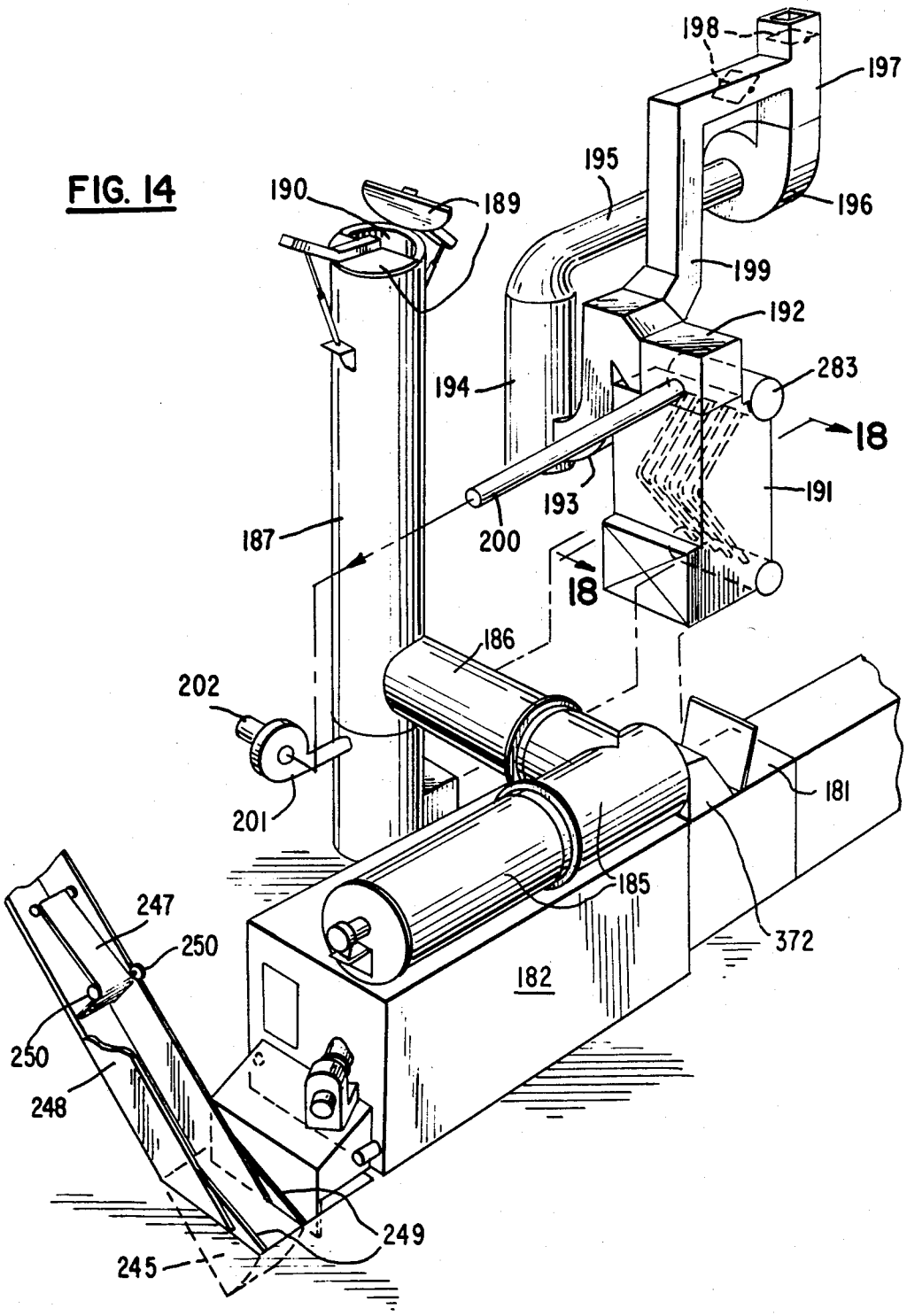
FIG. 14 gives an isometric view of an incinerator-boiler having two separate heat recovery facilities.

FIG. 14 gives an overall isometric view of an incinerator having heat recovery at two separate locations.

TABLE

Components Used in the Circuit of FIGS. 10 TO 13

| Identification | Component |
|---|---|
| ACT1-ACT3 | V4055A1031; Honeywell |
| ACT4-ACT7 | MP2150-500-001; Barber Coleman |
| CR1, CR2, CR6 | 700-N-400A1; Allen Bradley |
| CR3-CR5 | RA890G; Honeywell |
| F1, F2 | 30 amp. |
| F3 | 8 amp. |
| F4 | 5 amp. |
| FR1-FR3 | C7009A; Honeywell |
| IL1-IL7 | 800T-P26; Allen Bradley |
| IP1-IP3 | Eclipse 16160 |
| M1, M2 | 15 HP |
| M3 | 3 HP |
| MS1, MS2 | 707-CAB70; Allen Bradley |
| MS3 | 707-AAB65; Allen Bradley |
| PGV1-PGV3 | V4046C1054; Honeywell |
| S1 | 440 V, 3 Ph, 60 Hz. Switch |
| S2 | 120 V Switch |
| S3 | 9007-B54B2; Square D |
| S4 | C437H1043; Honeywell |
| TI | T-53008 (500 Vamp) ACME |
| T2-T4 | 22042; Honeywell |
| TC1, TC2 | 52302-409; Alnor |
| T/C1-T/C3 | C. S. Gordon 1410-12: 1153-190-12: TH2706-A |
| TMR1, TMR2 | BR111A600; Eagle Signal |
| TMR3 | BR107A600; Eagle Signal |

The refuse hopper 181 permits the introduction of refuse in bulk form. From there, the refuse enters the main combustion chamber 182 for burning. The gaseous combustion products then travel to the second combustion stage 185. They subsequently pass through the third stage of combustion 186 to the vertical stack 187. The stack 187 forms a "T" with the third combustion stage 186.

When the cupola cap 189 opens, flue gases will travel vertically through the stack 187 and depart through the opening 190. However, when the scrubber and boiler system, discussed below, operate, the cupola cap 189 closes. This causes the gases to be routed from the stack 187 through the boiler-convection section 191 to permit further heat recovery.

From the convection-boiler unit 191, the gases flow through the plenum 192 into the inlet duct 193 which includes a jet spray for cooling the gases to about 175° F. The cooled gases then pass through the scrubber 194 which removes chlorine by adding sodium hydroxide to create sodium chloride. The gases departing the scrubber 194 pass along the duct 195 to the induced draft fan 196. This expels them into the stack 197.

However, the scrubber 194 requires a constant pressure drop and, thus, a constant gas volume passing through to remain effective. Consequently, a set of dampers 198, linked together, shunts a portion of the gases from the stack 197 into the duct 199 which reintroduces it into the duct 193. This assures the scrubber 194 of its required gas volume.

Occasionally, the gas entering the convection boiler 191 may have an excessively high temperature. This would cause some of the inert particulate matter entering as a metallic vapor. The metal vapor would then contact the tubes inside the boiler section 191 and condense to form a solid slag buildup. This would impede both heat transfer and the flow through of gases.

Accordingly, keeping the temperature of the gases in the convection boiler 191 below the vaporization temperature of this material will prevent this deleterious result. Thus, a portion of the cool gases from the plenum 192 may be recirculated and drawn through the conduit 200 by the blower 201 operated by the motor 202. These cooled gases then reenter the gas stream at the bottom of the stack 187.

The cool gases mix with those from the third stage 186 and keep their temperature below the vaporization point of the inert substances. The metallic vapors then condense back into the solid state in a powder form. This powder could contact and adhere to the water tubes in the convection boiler section 191. However, they readily dislodge with the aid of conventional sootblowers and do not permanently affect the boiler 191.

Alternatively, the lower section of the stack 187 may receive ambient air instead of the gas from the plenum 192. Although reducing the efficiency of the heat recovery by the boiler 191, it will keep the temperature of the gases from the third stage 186 at an acceptable level.

Figure 15:
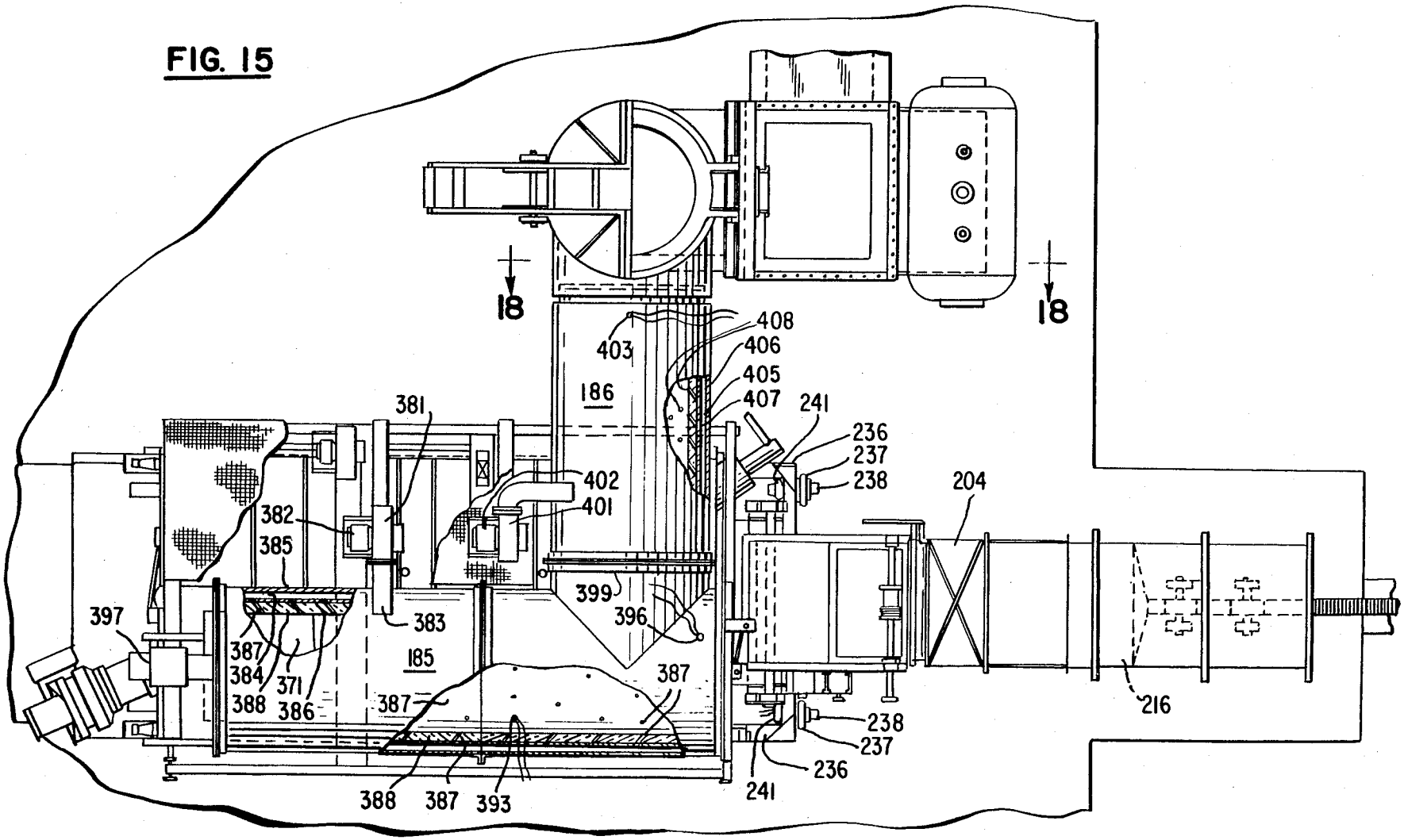
FIG. 15 provides a top plan view of the incinerator of FIG. 14.
Figure 16:
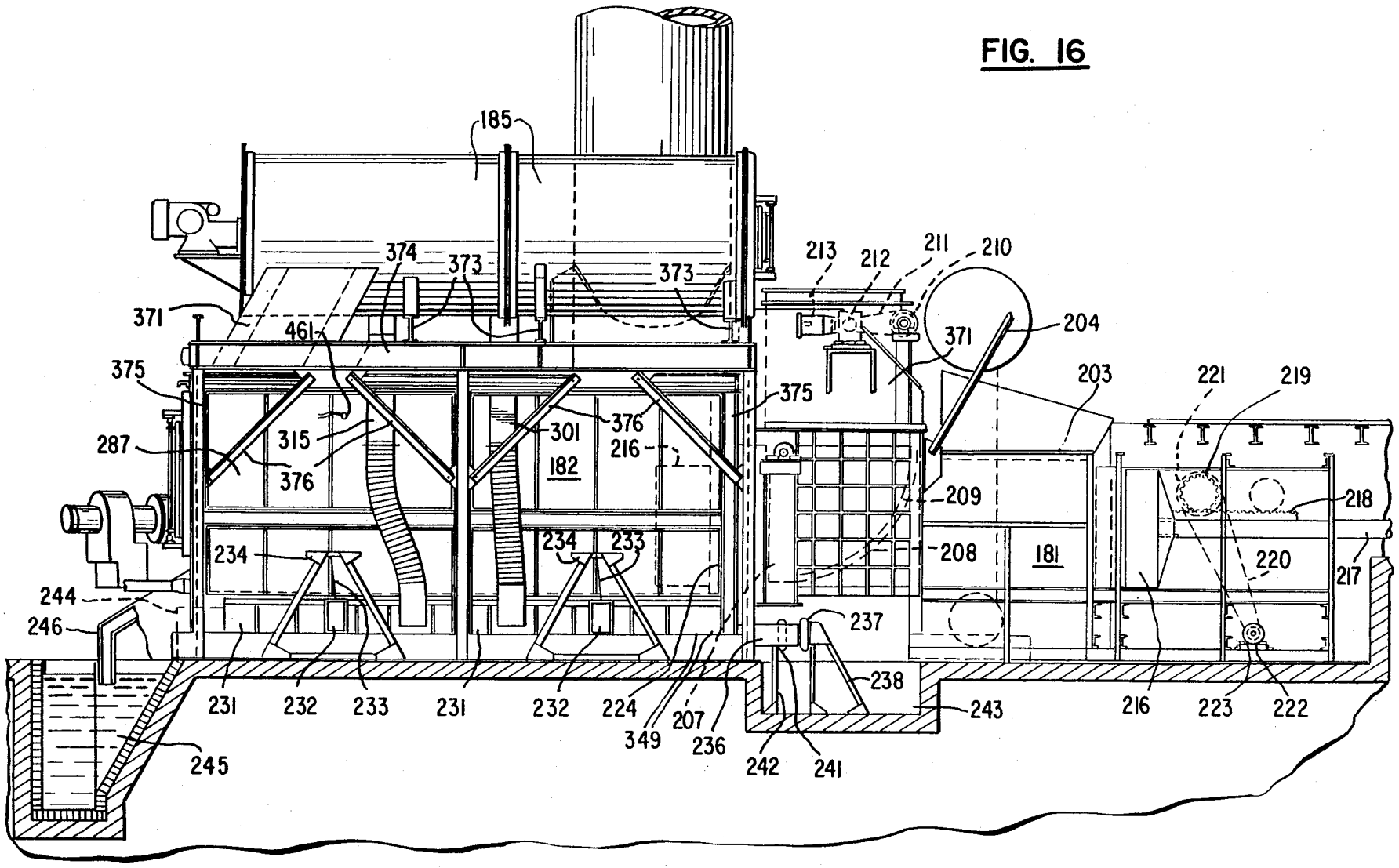
FIG. 16 is a side elevational view showing the first and second stages of combustion of the incinerator of FIG. 14.

In FIGS. 15 and 16, the refuse enters the opening 203 of the hopper 181. The hopper door 204 moves from its open position shown in the drawings, closes, and completely seals off the opening 203 to create an airlock. The closing of the hopper door 204 permits the refractory door 207 of the main combustion chamber 182 to open. The door 207 has the skirt 208 attached to it. The skirt prevents refuse in the hopper 181 from blocking the path of the door 207 as it opens. The skirt 208 attaches to and moves with the door 207.

The cable 209 also attaches to the door 207 and sits in a V-shaped notch in the skirt 208. It then travels to and winds onto the winch drum 210. As the drum 210 rotates, the cable 209 winds upon it to open the door 207. The axis of the drum 210 connects to a drive sprocket around which is wrapped the chain 211. The sprocket, in turn, connects to the reducer 212 which the motor 213 drives.

With the door 207 open, the ram head 216 can push the refuse into the main chamber 182. The ram head 216 connects to the beam 217 which carries the spur gear rack 218 on its upper surface. The drive system which moves the beam 217 includes the rack gear 218 and the pinion gear 219. The chain 220 passes around the sprockets 221 which couples to the gear 219. The chain 220 also travels over the sprocket 222 which couples to the motor 223 through a reducer drive not shown. The motor 223 then powers the movements of the ram head 216.

The ram head 216, when introducing the refuse into the chamber 182, travels all the way to the furnace entrance 224. There, at its most inward position, it has the position shown in phantom. After reaching the limiting position shown in phantom, the ram drive reverses itself and the ram head 216 retracts to the position shown at the right. The refractory door 207 then closes and the hopper cover 204 opens.

An air knife surrounds the refractory door 207. This stream of air captures any fumes that would otherwise escape through the door into the surrounding environs. Thus, it provides an effective seal around the door 207. The air from the air knife subsequently enters the main chamber 182 through over-fire jets, discussed below. Any fumes contained in this air then undergo normal combustion to avoid pollution.

As the refuse enters the chamber 182, it sits upon the moving floor 231 to which connects the suspension brackets 232. The chains 233 then extend from the floor's brackets 232 to the A-frames 234. The chains 233 suspend the moving floor 231 from the A-frames 234 and allow it to pivot. However, the floor 231 only pivots a small distance, approximately three inches, which occurs at the bottom of an arc. Thus, most of its direction lies in the horizontal plane.

The yoke 236 connects to the floor 231 and abuts against the airbag 237. The airbag 237, in turn, attaches to the structural frame 238. To move the yoke 236, and thus the floor 231, the airbag 237 rapidly fills with air to push the yoke 236 to the left as seen in FIG. 16. This imparts an acceleration of about 0.5 g, where g represents the acceleration of gravity of 32 ft./sec. squared.

As the bag 237 fills to its predetermined maximum expansion, the other airbag 241 cushions and decelerates the motion of the yoke 236 to the left. The airbag 241, coupled to the frame 242, has a predetermined internal pressure of about 50 lbs. As the bag 237 fills and pushes the yoke 236 against the bag 241, a relief valve allows some of the air inside the bag 241 to escape. This maintains the pressure within the airbag 241 at a substantially constant value.

When the airbag 237 has reached its maximum expansion, the floor 231 has moved to its most leftward position. At that time, a valve in communication with the airbag 237 opens and allows the pressure inside to fall to its preset lowest level of about 20 p.s.i. Further, additional air enters the bag 241 to maintain its pressure at its level of about 50 lbs. As a result, the yoke 236 moves slowly to the right, taking the floor 231 with it.

Thus, the airbag 237 initially fills rapidly to effect a fast leftward motion of the floor 231. Then the bag 241 fills slowly causing the floor 231 to move at a slower rate back to the right. This overall effect causes the material on the moving floor 231 to inch in small increments to the left.

In other words, the airbag 237 accelerates the yoke 236 and the floor 231 to the left. The yoke 236, and thus the floor 231, stop rapidly when the yoke 236 bumps against the airbag 241. This rapid stopping causes the material on the floor 231 to move to the left in incremental steps. Then, the air reenters the bag 241 to slowly reposition the floor 231 to the right for a further sequence of motion. The structural frames 238 and 242 sit within the well 243 which provides space for these members.

As the material or refuse moves across the moving floor 231 from right to left, it also undergoes combustion. By the time it reaches the left end 244 of the floor 231, it has become ash. The ash then falls off the left end 244 of the floor 231 into the pit 245 filled with water. The water quenches the hot ash and, with the hood 246, acts as an air seal for the furnace.

A scoop system removes the ash from the pit 245. In FIG. 14, the scoop 247 descends along the track 248. Eventually, the scoop 247 gest to the rails 249. The wheels 250 then ride on the rails 249 to position the scoop over the pit 246. At its lowest point, along the rails 249, the scoop 247 drops into the pit 246 to occupy the position shown in FIG. 17. Then, a chain connected to a motor pulls the scoop 247 back up the rails 248. As it ascends, the scoop 247 removes the ash contained in the pit 246.

Figure 19:
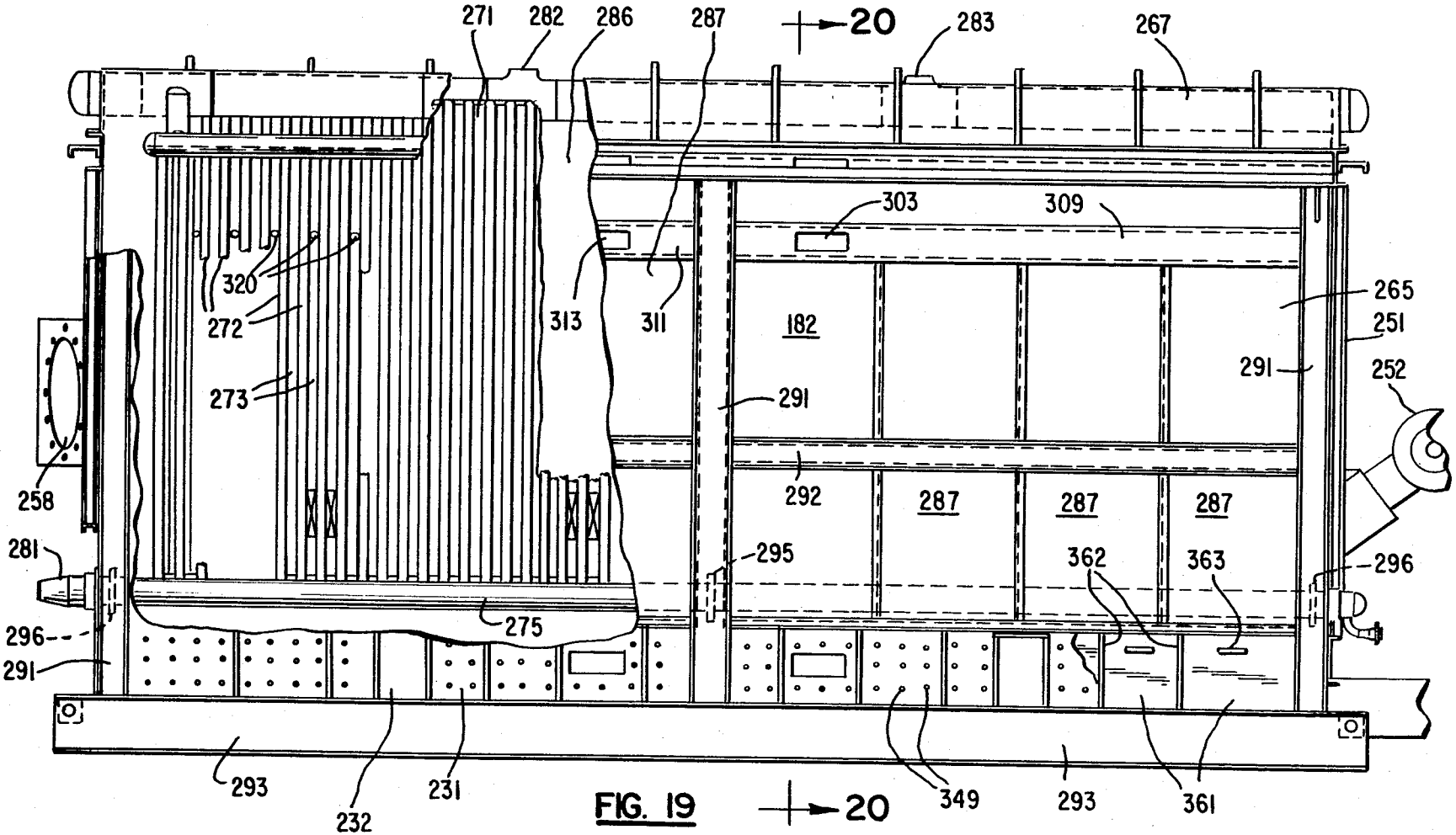
FIG. 19 gives a side elevational view, partly in cross-section, of the main combustion chamber (stage 1) of the incinerator-boiler of FIG. 14.
Figure 20:
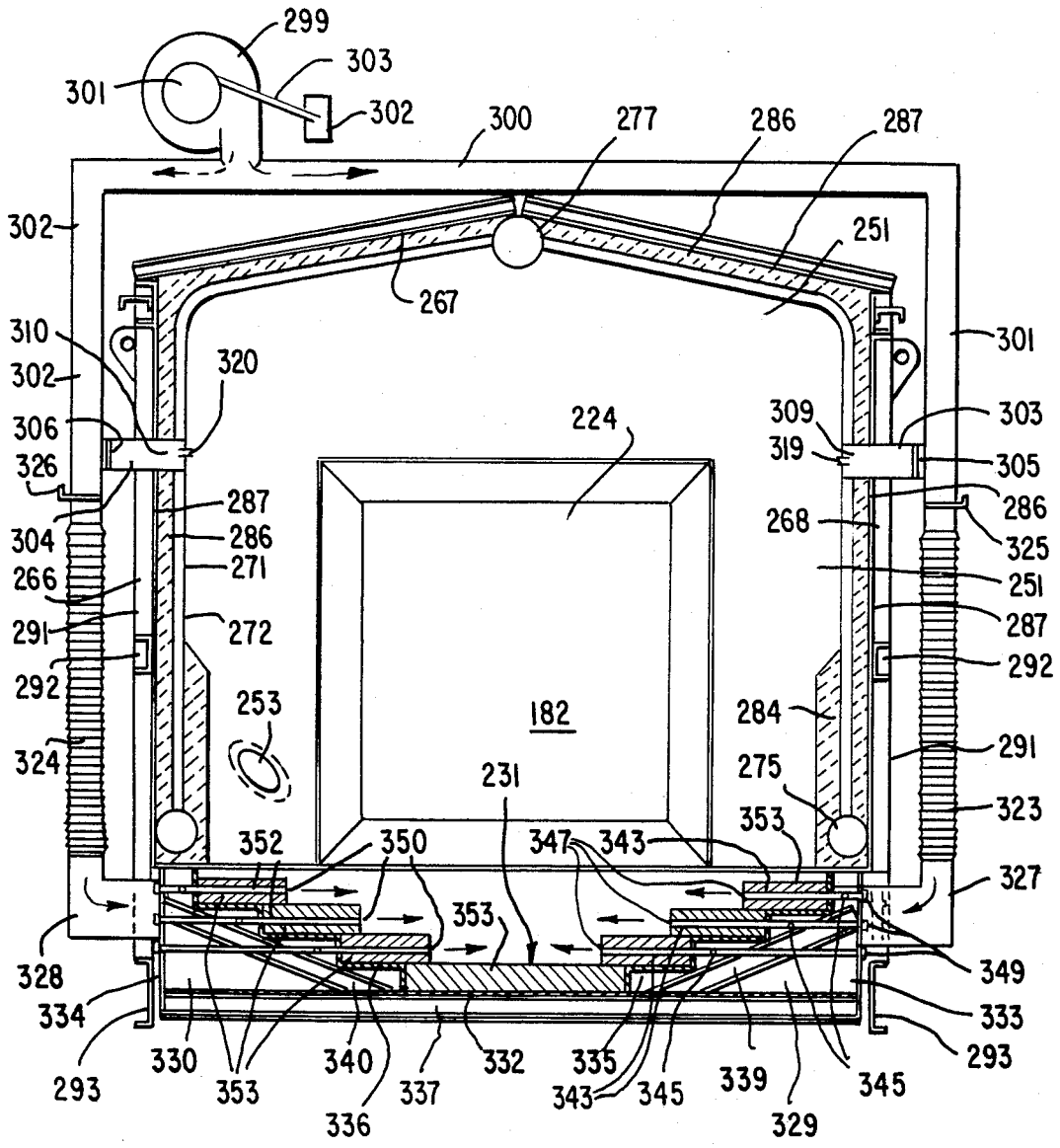
FIG. 20 gives a cross-sectional view along the line 20—20 of the main combustion chamber of FIG. 19.

As seen in FIG. 20, the main chamber 182 includes the end wall 251 which surrounds the opening 224 through which refuse enters. The end wall 251 also supports the ignition burner 252 seen in FIG. 19. In FIG. 20 appears the access opening 253 for the burner 252. The ignition burner 252 serves to initially set the refuse on fire. If large enough, it can also supplement the heat produced in the main chamber 182 when it lacks sufficient refuse.

Figure 17:
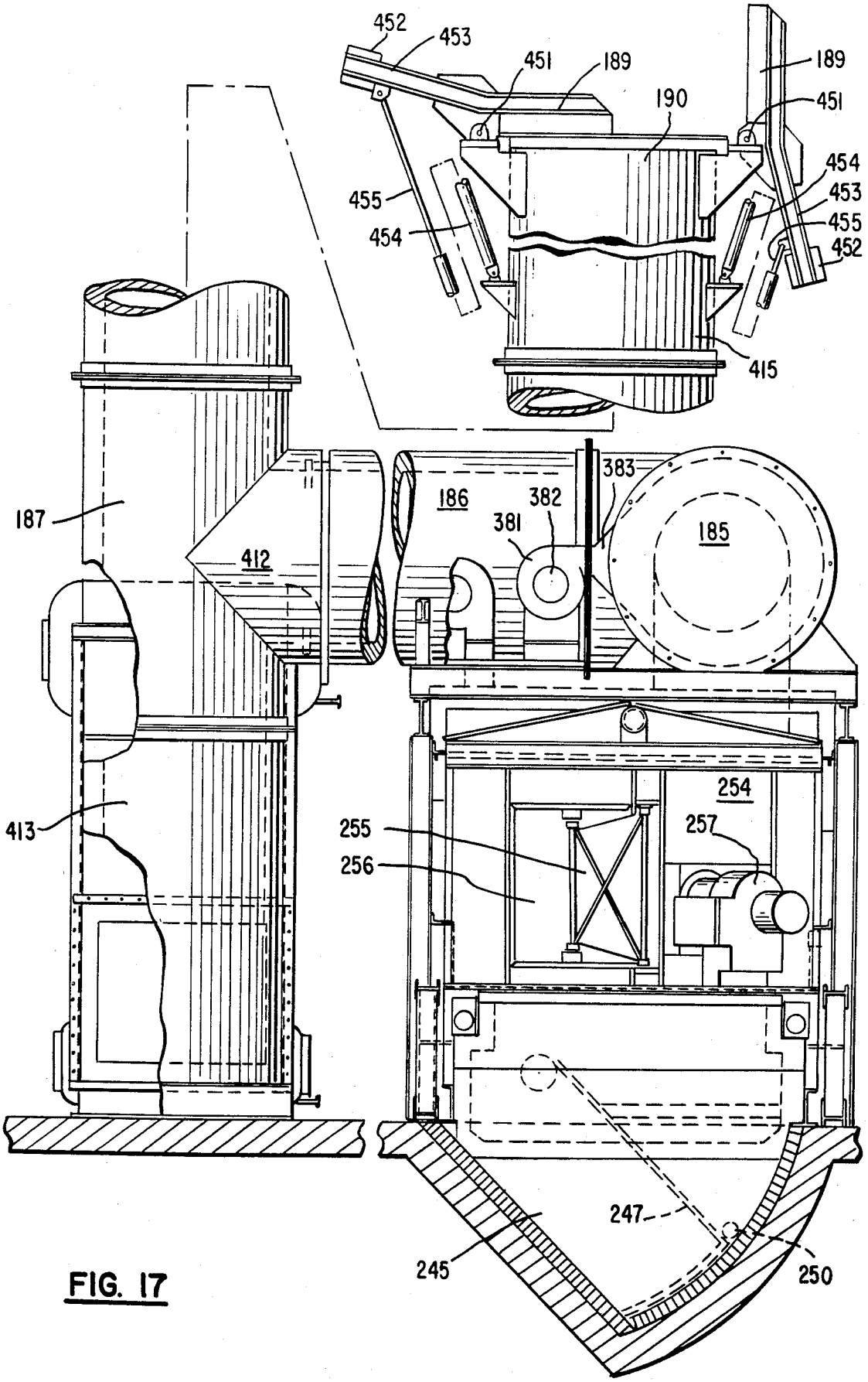
FIG. 17 gives an end elevational view of the first, second and third combustion stages of the incinerator of FIG. 14.
Figure 18:
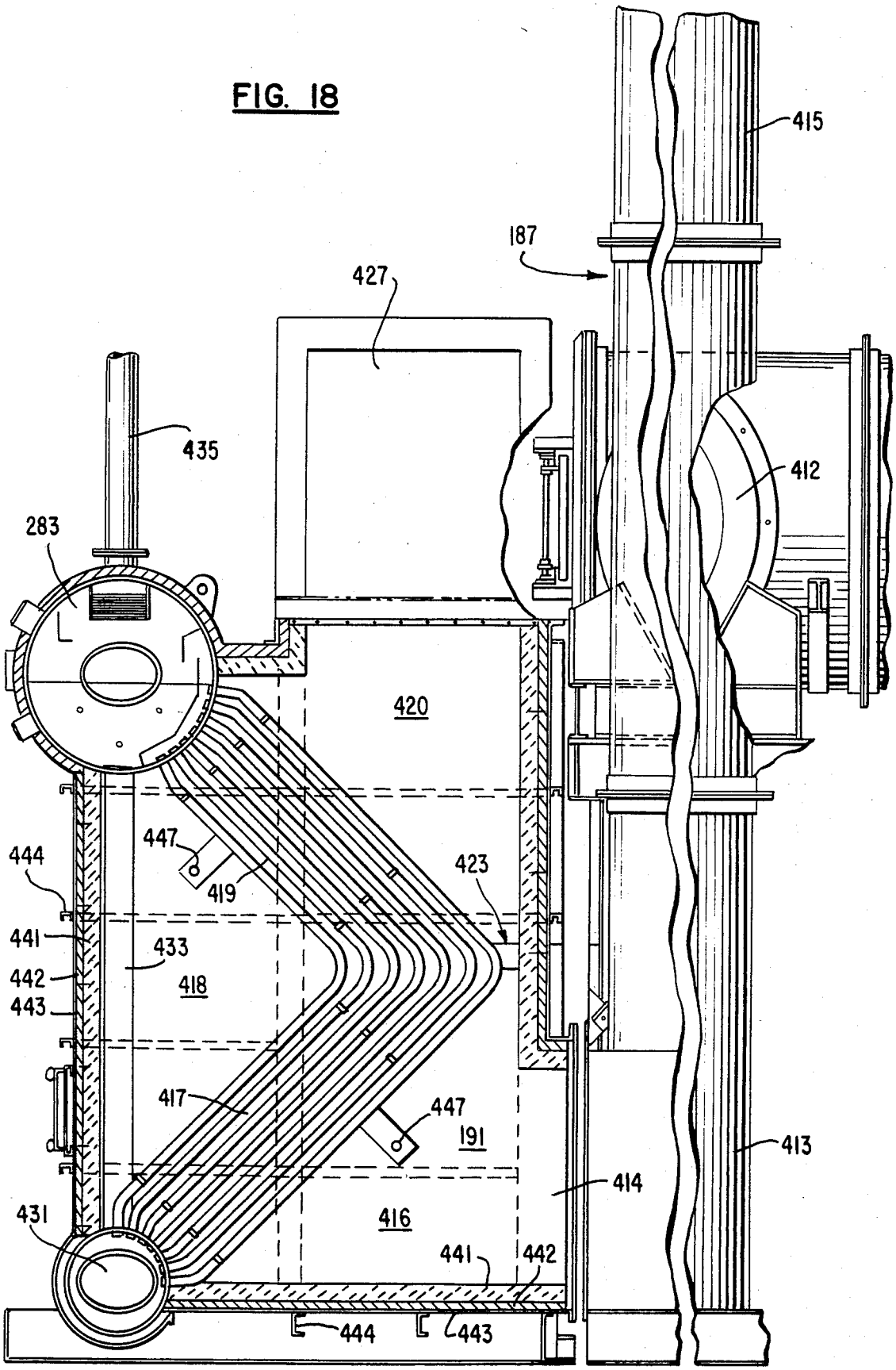
FIG. 18 gives a cross-sectional view of the convection boiler along the line 18—18 of the incinerator of FIG. 14.

The end wall 254, which appears in FIG. 17, forms the other end of the main chamber 182 as seen in FIG. 20. In the end wall 254, the access door 255 covers the access port 256. The port 256 permits the inspection and any necessary repairs of the main chamber 182.

In addition, the oil burner 257 communicates with the main chamber 182 through the end wall 254. As mentioned above, the main chamber 182 serves as the first stage of combustion for refuse placed inside. Moreover, it acts as a boiler to produce steam for the usual energy requirements of a building or other facility. If the main chamber 182 contains no refuse, the burner 257, operating on external oil, provides the heat to produce the usual amount of steam. In other words, the oil burner 257 permits the main combustion chamber 182 to operate as a furnace in the absence of refuse. The attachment plate 258 for the burner 257 appears in FIG. 19.

The loader end wall 251 and the far end wall 254 have an exterior surface of metal. Inside of that lies an interior lining of refractory and a layer of insulation separating the other two components.

As seen in FIG. 20, the side walls 265 and 266 and the ceiling, or roof, 267, with the moving floor 231, complete the main chamber 182. In FIGS. 19 and 20, the membrane wall 271 forms the interior surface both of the side walls 265 and 266 and of the roof 267. The membrane wall 271 has a construction of two-inch diameter metal tubes 272 on four-inch centers. One-fourth inch thick bars or thins are welded to the tubes 272 and fill the space between them. The tubes 272 and the fins 273 together form a continuous membrane wall and ceiling.

The two-inch tubes 272 have a welded or swagged connection to the four-inch lower headers 275 and 276 in the side walls 265 and 266, respectively. Each of the lower headers 275 and 276 has a diameter of four-inches. The tubes 272 have a similar joinder to the upper header 277 which has a six-inch diameter.

The tubes 272, the lower headers 275 and 276, and the upper header 277 constitute the steam-forming mechanism of the main combustion chamber 182. In operation, water first enters the lower headers 275 and 276 through the opening 281. It then passes upwards through the tubes 272 to the upper header 277. From there it departs as steam steam drum 283 of the convection boiler 191. There, the water separates from the steam, and the latter can be put to the usual uses.

The lower three feet of the membrane wall 271 has a coating of hard-faced refractory 284. This refractory 284 protects the membrane wall 271 against abrasion from the refuse inside the main chamber 182 travelling under the action of the moving floor 231.

A painted ceramic coating covers the membrane wall 271 above the refractory 284. The coating protects the wall from corrosion due to the reducing atmosphere inside the main chamber 182.

Equation (2) gives the horizontal area that the main chamber 182 should possess to keep the lift velocity sufficiently low. As seen in FIGS. 14, 19 and 20, vertical cross-sectional planes through the chamber 182 display a generally rectangular outline. Particularly is this so for cross sections taken perpendicularly to the longitudinal axis of the chamber. If these cross sections has a rounded configuration, then the bottom of the chamber would possess less area than its middle. The smaller area there would increase the velocity of the gases in that location. The fast moving gases would then induce the lifting of particles from the burning refuse and the placing of them into the environment as a pollutant. The square configuration keeps the gas velocity low to avoid this deleterious result. The incinerator without heat recovery, seen in FIGS. 1 to 8, similarly has a rectangular cross section.

In general, the design criteria given for the main chamber 32 seen in the prior figures apply to the incinerator of FIGS. 14 to 20. Thus, the main chamber's volume should fall within the range of 10,000 to 15,000 Btu per cubic foot per hour, generally centering on the figure of 12,000. As discussed above, particular circumstances may change that, for example, to 7,500 for paint-containing material.

As suggested above, the main chamber 182 should have an area to give a burning capacity for the refuse of approximately 75,000 to 125,000 Btu per square foot per hour, with the middle of that range usually representing the ideal figure. At times, the main chamber may have a hearth with an even larger area than given above. For example, the refuse may contain an amount of low Btu waste. This remnant may simply require a place to finish its combustion. It has so little heat that it must keep all of it to effectively burn. To accommodate this situation, the main chamber 182, in FIG. 16, for example, may include a small extension just beyond the throat 37.1 and before the ash pit 245. With a low ceiling and no water tubes, the heat produced by the low Btu material in the extension remains to effectuate combustion. The extension, by allowing for a complete burnout, reduces the amount of the ash that must be removed from the system.

Aside from an extension, where used, the main chamber should typically display a general configuration that induces efficient burning. The height above the hearth floor and width should about equal each other. The length generally amounts to twice or three times the width. Preferably, the length-to-height ratio does not exceed about 2.5. Similar remarks apply to the non-heat-recovery systems of FIGS. 1 to 8.

The side walls 265 and 266 have a layer of insulation 286 adjacent to the membrane walls 271. The insulation 286 minimizes the loss of heat from the water within the tubes 272. The metal casing 287 covers the insulation 286 and represents the exterior surface for the side walls 265 and 266 and the ceiling 267.

The vertical columns 291 and the horizontal beams 292 impart a rigidity to the side walls 265 and 266. The columns 291 connect to the base beam 293. The bottom headers 275 and 276 also connect to the columns 291 for structural integrity. A weld 295 provides the connection of the lower headers 275 and 276 to the middle column 291. At the side columns 291, the cylindrical sleeves 296 support the headers with an expansion joint.

The refuse within the main chamber, of course, requires air to support its combustion. The blower 299 forces air into the cross duct 300 in FIG. 20. The amount of air entering the system falls under the control of the iris 301 on the blower 299. In turn the motor 302 controls the iris 301 through the linkage 303.

The air from the cross duct 300 then enters the vertical ducts 301 and 302. From the vertical ducts 301 and 302, the air passes through the connectors 303 and 304, respectively. The dampers 305 and 306, respectively, control the amount of air entering the connectors 303 and 304. The dampers 305 and 306 receive a manual adjustment at the time of the initial construction of the equipment.

From the connectors 303 and 304, the air enters the over-fire air ducts 309 and 310. The ducts 309 and 310 extend over the right half of the length of main chamber 182 as seen in FIG. 19. The air duct 311 and another duct not seen in FIG. 19 extend over the left half of the main chamber 182 and receive their air through the separate connector 313 and another connector not shown in FIG. 19. These connectors, in turn, receive their air from the vertical duct 315 seen in FIG. 16 and another duct not shown.

A separate blower feeds these vertical ducts through their own cross duct similar to the cross duct 300. Thus, each of the two halves of the main chamber 182 has its own separate air system. Alternately stated, the blower system shown in FIG. 20 feeds the half of the combustion chamber 182 near the loader end. An identical blower system with similar components feeds the half of the main chamber 182 near its ash end.

In FIG. 20, the air from the over-fire ducts 309 and 310 pass through the jets 319 and 320, respectively, into the main combustion chamber 182. The height of the jets 319 and 320 places them above the burning mass in the main chamber 182. Consequently, they have very little likelihood, if any, of becoming plugged by the combustion process.

The air from the vertical ducts 301 and 302 also travels to the flexible ducts 323 and 324. The dampers 325 and 326 control the amount of air that enters the ducts 323 and 324.

The air next passes into the elbow-shaped ducts 327 and 328 respectively which have permanent fastenings to the moving floor 231. From the elbow ducts 327 and 328, the air enters the plenums 329 and 330, respectively. The plenums 329 and 330 are formed from the bottom plate 332, the side plates 333 and 334, respectively, and the step plates 335 and 336. The channel member 337 supports the bottom skin 332 while the angular channels 339 and 340 provide structural bracing for the steps 335 and 336 respectively.

The air from the plenum 329 enters the tubes 343 through the openings 345. From there, they pass through the orifices 347 into the main chamber 182. With refuse in the main chamber 182, the air from the orifices 347 actually passes directly into the burning refuse as under-fire air.

The caps 349 cover the ends of the tubes 343 opposite to the openings 347. Should the tubes 343 become clogged, the caps 349 are temporarily removed. This permits the routing out of the tubes 343, followed by the replacement of the caps 349.

Similar remarks apply to the plenum 330 which provides its air through the nozzles 350 in the tubes 352. The refractory bricks 353 protect the stepping plates 335 and 336, for both halves of the chamber 182, the bottom skin 332, and the tubes 343 and 352.

As shown in FIG. 20, the nozzles 347 and 350 as well as the bricks 353 surrounding them all have vertical faces. This helps avoid refuse from entering and jamming the tubes 343 and 352. If the nozzles 347 and 350 had sloping faces, the weight of the refuse would force debris into them and likely block the flow of air.

The vertical faces of the orifices 347 and 350 and the horizontal orientation of the tubes 343 and 352 behind them propel the air horizontally into the main chamber.

This horizontal movement of the air helps place it into the burning mass of refuse where needed. More importantly, it avoids imparting a vertical component of motion to the flowing air. This helps maintain the average lift velocity in the main chamber to sufficiently low value to avoid entraining undesired particles.

The velocity at which the air enters the main chamber 182 from the nozzles 347 and 350 affects the size of particles entrained in the moving gases. Increasing this velocity results in lifting larger particles from the burning refuse. If the lifted particles have a composition of an inert material, they will never burn and very likely will enter the environment as a pollutant. If the particles can undergo combustion, their size may preclude their complete burning before they depart the incinerator and enter the atmosphere. Again, they pollute the environs.

Accordingly, the air must move through the orifices with a gentle velocity. Placing one's hand at about two feet from the orifices,, a person must only barely feel the jet of air. Generally limiting the departure velocity of the air from the jets to about 300 feet per minute (i.e., about 3.4 miles per hour) accomplishes this result. An upper velocity of 150 feet per minute provides greater assurance.

Naturally, the slow velocity of the gases means that very little air can enter the chamber through any one of the orifices 347 or 350. Accordingly, the main chamber 182 must have a sufficient number of the jets 347 and 350 to receive the air required to maintain stoichiometric air (±10%) for the burning refuse.

For the incinerator shown, each step 335, and thus the layers of refractory 353, extend horizontally about 18 to 24 inches into the chamber 182. Each step contains a row of orifices. Furthermore, within each row on one of the steps, the orifices occur at about eight to nine inch spacings. An incinerator of 20 feet by 10.5 feet by 10.5 feet size may have 240 of these orifices.

This large number of orifices permits the entry of sufficient air, albeit moving slowly, to maintain stoichiometric conditions. In fact, they provide approximately 75% of the required stoichiometric air (±10%) directly into the mass of burning refuse where it is needed.

As seen in FIG. 19, the panels 361 can slide vertically in the channels 362. They fit snugly against the horizontal beam 293 and the exterior plates 287. Doing so, they provide a seal against any gases escaping from the opening between the moving floor 231 and the side walls 265 and 266. They also prevent air from entering in the opposite direction along the same path. The handles 363 facilitate the removal and insertion of the panels 361. Removing the panels 361 permits access to the caps 349 and thus allows the cleaning of the jets 345 and 352.

The gaseous products of combustion, which includes incompletely burned material, leave the first combustion stage 182. Passing through the throat section 371, they enter the second stage combustion chamber 185 as shown in FIG. 16. The cross sectional area of the throat 371 in FIG. 16 controls the rate at which the gases can pass from the main combustion chamber 182 into the second stage 185. The throat 371 should have a cross sectional area to permit the passage of a maximum of about 15,000 Btu per square inch per hour.

In other words, the main chamber 182 is designed to burn at a certain Btu capacity. This imposes the limitations stated above with regards to the incinerator of FIGS. 1 to 9, on the main chamber's area and volume. In addition, the exit throat 371 should then have a sufficiently large cross sectional area so that it will have a maximum throughput of heat of about 15,000 Btu per square inch. As seen in FIG. 16, the cross sectional area is represented by a plane at right angles to the center line axis of the throat 371.

The throat, as with the incinerator of FIGS. 1 through 8, may include a manually or automatically controlled moveable plate. The plate, when covering at least part of the throat 371, will retain heat within the main chamber 182 to assure proper combustion conditions there. In normal use, the plate would retract and present the full area of the throat 371 to the escaping gases.

The gas from the main chamber 182 does not enter the second chamber 185 at a 90° angle. A right-angle entry impedes the transfer of the fluid. Rather, the center line axis of the throat 371 makes an angle of approximately 60° with the center line axis of the second chamber 185.

The second chamber 185 also receives smoke combined with air and other gases from a smoke hood 372 over the refractory door 207. This captures the gases that may escape from the entrance area of the main chamber 182 upon the introduction of a slug of refuse.

Upon the initial placement of refuse into the chamber 182, it may tend to suddenly gasify from the heat. This can occur during the extraction of the ram head 216 from the main chamber 182. During this time, the refractory door 207 remains open as the ram head passes. Any smoke escaping from the entrance 224 enters the smoke hood 372. This smoke travels along a conduit not shown and enters the second chamber near the throat 371. Any combustible material within the smoke and gases from the smoke hood 372 then fully burns during the passage through the second and third stages 185 and 186. This precludes placing these pollutants directly into the atmosphere.

The second chamber 185 as well as the third chamber 186 have a location above the main combustion chamber 182. The chambers 185 and 186 rest upon the I-beams 373 which connect to the longitudinal beam 374. A similar longitudinal beam rests on the opposite side of the main chamber 182 from that shown in FIG. 16. The longitudinal beams 372, in turn, sit upon the columns 375. The truss braces 376 provide stability between the longitudinal beams 374 and the columns 375.

The gases within the second stage 185 require additional oxygen to complete their combustion. The blower 381, seen in FIG. 15, powered by the motor 382 provides this air. The air from the blower 381 travels through the duct 383 and into the plenum 384 formed by the outer metal wall 385 and the inner metal wall 386. The air from the plenum 384 then passes through the jets 387 into the second stage 185.

The jets 387 introduce the air at an angle of 45° relative to the main axis of the chamber 185. This angle helps provide the turbulence necessary to mix the air with the burning gases. It also helps maintain the forward velocity of the gases through the reburn tunnels.

Moreover, the jets are arranged in rings with each ring generally containing a minimum of eight jets. In the region of the throat 372, the rings have fewer jets because of the entrance port from the first stage 182.

The second stage 185 includes approximately eight rings of jets. The adjacent jets on a particular ring are at about a 45° arc from each other. The locations of the jets on any one particuar ring have an offset of 22° from the radial location of the jets on the adjacent rings. This helps diffuse the air across all sections of the second stage 185. The refractory wall 388 encases and protects the jets 387 as well as the inner metal wall 386.

Any heat escaping from the second chamber 185 through the refractory wall enters the plenum 384. There it serves to heat incoming air that eventually enters the second chamber 185 through the jets 387. This heating of the air in the plenum 384 recaptures the heat lost from the second chamber 185. The heat eventually reaches the boiler unit 191. This air in the plenum 384 prevents substantial heat loss and thus increases the efficiency of the incinerator as a steam generator.

In a symbiotic fashion, the cool air in the plenum 384 keeps the metal skin 385 from becoming heated to a temperature where it could suffer damage. The blower 381, of course, continually provides fresh, cool, moving air, which provides this important protection to the structure of the second chamber 185.

The third chamber 186 also has a plenum with a structure similar to that of the second chamber 185. As a result, the above benefits apply there, too.

The double-walled plenum with rings of jets effectively surrounds the entire traveling, burning fireball with a layer of air. This blanket of air appears to reduce the production of nitrogen oxide pollutants by the combustion process. The low temperature in the main chamber also helps avoid the undesired nitrogen oxides.

The second stage 46 in the incinerator 30 of FIGS. 1 to 8 only introduces air from the jets 50 on two sides of the fireball. Thus, the air does not surround 360° of the fireball as in the incinerator of FIGS. 14 to 20. Yet, the former design produced only about 45 ppm. (parts per million) nitrogen oxide.

The thermocouple 393 measures the temperature of the gases about halfway through the second combustion chamber 185. When the temperature rises above a predetermined level, generally around 1700° F., the blower 381 with its motor 382 introduces a greater amount of air through the jets 387 into the second combustion chamber 185. Specifically, a modulating motor opens the iris diaphragm over the blower 381. When the temperature as measured by the thermocouple 393 falls below the predetermined level, the blower 381 introduces a lower quantity of air into the second chamber 185.

The thermocouple 396 measures the temperature of the gas stream near the end of the second stage 185. It controls the amount of fuel supplied to the second stage burner 397. In operation, it proportionately modulates the valve on the fuel line for the burner 397.

At and above 1,650° F., the thermocouple 396 puts the burner 397 at its lowest fuel position. At this temperature the burner 387 does not turn off; it simply operates at its lowest operational value. For the temperature range of 1,550′ to 1,650′ F., the thermocouple 396 provides a proportionate amount of fuel to the burner 397. Below 1,550′ F., the burner 397 operates at its maximum value. This keeps the second stage above its minimum desired temperature of 1,400°. Above that temperature, hydrocarbons fully and rapidly burn to water and carbon dioxide.

From the second chamber 185, the gases pass to the tertiary chamber 186. The connection between these two portions appears along the line 399 in FIG. 15. Beyond that point, the tertiary chamber 186 receives its air from the blower 401. The motor 402 operates the blower 401 which remains under the control of an iris. The motor directing the iris on the blower 401 responds to the thermocouple 403.

The third stage 186 has a structure very similar to that of the second stage 185. Air from the blower 401 enters the plenum 405 between the outer and inner metal walls 406 and 407, respectively. From the plenum 405, the air passes through the jets 408 into the third stage 186. The benefits of passing cold air between the plenum walls 406 and 407 have received discussion above with regards to the secondary chamber 185.

When the temperature of the thermocouple 403 exceeds its lower set point of about 1,400° F., the iris on the blower 401 moves to its maximum open position and admits the larger amount of air. Below 1,400° F., the iris closes partially, and the blower 401 introduces less air.

The third-stage thermocouple 403 also has an upper set point of about 1,500° F. Below that temperature, as with the incinerator of the earlier figures, the system operates normally. Exceeding the upper set point indicates an excessive combustion in the prior chambers.

Accordingly, when the thermocouple 403 exceeds the second set point, the loader turns off to prevent the introduction of refuse into the main chamber 182. This keeps the combustion from becoming even more intense.

Additionally, the thermocouple 403 above the upper set point lowers the amount of air introduced into the main chamber 182. Specifically, in FIG. 20, it controls the motor 302 which determines the position of the iris 301 and thus the air entering the blower 299. Decreasing the air in the main chamber 182, of course, reduces the combustion rate there. This lowers the intensity of the combustion in order that the system can handle the resulting products.

When the third-stage thermocouple 403 falls below the second set point, the system returns to normal. The loader turns on and the main chamber 182 receives its full amount of air.

The upper set point, of course, will differ depending upon the circumstances surrounding the operation of the particular incinerator. For example, the fourth stage, as discussed above with regard to FIG. 14, may add cooler gases to the lower portion of the stack 187. This cools the gases before they reach the boiler 191 and avoids vaporized inorganics from condensing on the surfaces of the boiler. Thus, the addition of the cooler gases at the fourth stage permits an elevated temperature at the exit of third stage 186 where the thermocouple 403 resides.

As discussed below, the third stage may have an operating temperature of up to 2,000° F. This helps assure complete combustion and the stripping of chlorine atoms from chlorinated hydrocarbons.

As the foregoing suggests, the temperatures of all the set points may vary depending upon a variety of factors. For example, the nature of the refuse undergoing incineration may dictate a particular set of values for the set points. Details of construction may suggest different set points, as exemplified by the fourth-stage, when present, raising the upper set point of the third-stage thermocouple 403.

Furthermore, the location of the thermocouples in the gas stream formed from the second and third stages will affect the specific temperatures of their set points. For example, the second-stage thermocouple 393 in FIG. 15 sits closer to the burner 397 of the second stage 185 than does the second-stage thermocouple 54 in FIG. 1. The two thermocouples 54 and 393 perform the same function with regards to controlling the amount of air provided in the second stage. Yet, the latter has a higher temperature setting because of its closer proximity to the second-stage burner and the heated gases from the first stage.

In addition, the individual peculiarities of each incinerator, although ostensibly constructed to the same overall configuration, may require some adjustment of the actual temperatures for the various set points. The particular type of refuse placed inside of an incinerator often dictates further modification. When properly adjusted, however, the set points and the operations they control permits the incinerator to burn refuse without the production of smoke and other types of pollutants.

As suggested above, the second and third stages 46 and 56 to 58 of FIGS. 1 to 8 function equivalently to the similar stages 185 and 186 for the incinerator-boiler of FIGS. 14 to 20. In fact, due to their equivalent function, the round tunnels forming the second and third stages 185 and 186 could actually find use for the incinerator 30 of the earlier figures. The gases departing the main chamber 32 there would simply enter second and third stages having a very similar structure as the chambers 185 and 186.

The incinerator 30 of FIGS. 1 to 8 does not provide for heat recovery. Yet, it can make use of the circular tunnels 185 and 186 for its second and third stages. The circular tunnels with the double-walled air plenums avoid the development of pollutants on incinerators without heat recovery facilities.

The circular cross-sectional shape of the tunnels 185 and 186 in FIGS. 14 to 20 presently appears more propitious, especially for larger units. This represents the preferred design since the cyclonic action, discussed above for the incinerator of FIGS. 1 to 8, becomes nullified with larger third stages. The tunnels 46 and 56 to 58 with the square cross-sectional appearance, as in FIGS. 1 through 8, however, have also provided satisfactory service, especially for smaller model sizes with cyclonic action in the third stage. Other configurations in the future may also prove acceptable and, perhaps, preferable.

Regardless of their shape, the tunnels have particular functions to accomplish. The fumes entering the second stage require additional heat to vaporize any combustible fluids entering from the first stage. The temperature of the resulting hydrocarbon gases must also rise to their combustion point. Furthermore, the heated gases in the second stage require some oxygen, generally in the form of air, to burn with. The air entering the second stage also helps to propel these gases through that stage into the third combustion stage.

The heated burning gases in the latter stage simply require air to complete their combustion. Further, their burning may raise the temperature of the third stage to an unacceptable level. Accordingly, the introduced air or other gases may reduce their temperature to a controllable level. As a consequence, the amount of air required in the third stage for complete combustion differs from that in the second stage.

More importantly, the changes in the second stage's requirement for air will often vary from the changes for the third stage. This, in particular, depends upon the amounts and kinds of refuse introduced into the main chamber. Accordingly, allowing the air entering the two stages to change only by the same proportion would severely limit the amount, kind, and timing of the entry of refuse into the main chamber. The separate controllability of the two chambers removes much of these limitations. As a result, the two reburn tunnels can accommodate rapidly varying outputs of the kinds and temperatures of gases leaving the main chamber and entering the second combustion stage.

Because of their versatility, the second and third combustion stages may find use as a "fume burner" by themselves, i.e., without the main chamber. In other words, they may attach to a source of combustible gases in a moving fluid stream. They would then assure that the entrained material completely burned to provide a departing stream free of many pollutants.

The fluid upon which the reburn tunnels operate may simply represent the exhaust of a combustion chamber different than those shown in the figures. Alternatively, they may constitute part of the products of a chemical reaction. The particular source from which they emanate does not represent the important consideration. Rather, they should arrive at the reburn tunnels in a manner which allows the tunnels to effectuate complete combustion.

Generally, the size of combustible particular matter entering the second stage should not exceed about 100 microns. That permits their complete burning if they remain within the reburn tunnels at a temperature above about 1,400° F., for one second.

To provide the proper residence time, they should enter the reburn tunnel with a velocity no greater than about 40 feet per second. They will, however, usually enter at a speed of at least 20 feet per second. As discussed below, if the entering gas does not fall within these limits, then alterations in the construction and design of the reburn tunnels become indicated.

For example, hydrocarbon particles exceeding 100 microns in size require a greater residence time within the tunnels. This in turn suggests longer reburn tunnels to provide a sufficient period of residency to completely burn the large entering particles. Alternatively, the prior removal of excessively large particles, for example with cyclonic separators, will permits the use of the standard length reburn tunnels.

Whether emanating from one of the shown main chambers of from another source of fumes, the entering material must remain within the reburn tunnels for a sufficient period of time to undergo complete combustion. As stated above, a maximum particle size of around 100 microns typically requires about $\frac{3}{4}$ to one second to completely burn. For complete assurance for the 100 micron particles, the gases should preferably remain in the tunnel for the whole one-second period.

The tunnels as shown have a mean design temperature of about 1,800° F. Naturally, this varies depending upon the particular location in the tunnels at which temperature measurements are taken. Nearer to the burners at the entry end of the second stage, the temperature substantially exceeds that figure. Moving toward the end of the third stage, the temperature may well fall below that figure.

The complete burning of the 100 micron hydrocarbon particles with the residence times and temperatures given above require a high degree of turbulence in the second and third stages. The jets force the air into these chambers at a sufficient velocity to reach these particles. Without the turbulence, higher temperatures and longer residence times become necessary to burn the particles.

The gases passing through the tunnels have a mean velocity of around 32 feet per second. Achieving a particular velocity, of course, first involves selecting an appropriate overall cross-sectional area of the tunnel. The amount and velocity of combustible gaseous material introduced into the tunnels, the volume of air introduced through the jets, and the amount of gas and its associated air provided by the burner also affect the velocity.

As suggested above, the gases should remain within the tunnels for at least $\frac{3}{4}$ second. At a mean velocity of 32 feet per second, this requires the two tunnels to have a combined length of about 24 feet. For the preferred residence time of one second, the length should increase to 32 feet.

In particular, the velocity of the gaseous material within the tunnels also appears in Equation (1), given above, for the gases in the main chamber. Should the operating temperature of the tunnels vary from the desired 1,800° F., then the velocity of the gases also changes. This derives from the fact that the volume of the gases increases linearly with the temperature, assuming an ideal gas. This phenomenon takes the form of the following equation:

$$Q_1 = T_1(°F.) + 460 \quad (3)$$

$$Q_2 \quad \overline{T_2(°F.) + 460}$$

Where $Q_1$ and $Q_2$ are the volume of gas in the tunnels at the temperature $T_1$ and $T_2$, respectively.

To assure the combustion of the hydrocarbons, the temperature of the tunnels must remain above 1,400° F. Combining equations (3) and (1) above, the flue gases travel at 26 feet per second at that temperature. Similarly, 2,200° F. represents the upper limit of the temperature in the tunnels. When that occurs, the gases travel at about 37 feet per second. Thus, the normal operating temperature range of the tunnels will provide the gases with a velocity between 26 and 37 feet per second. Ideally, they move at about 32 feet per second.

As stated above, the incinerator with the reburn tunnels shown in FIGS. 1 to 8 achieved combustion while producing less than about 45 parts per million (ppm) of nitrogen oxide. Because of their ability to surround the burning gases with a layer of air, the reburn tunnels in FIGS. 14 to 20 may reduce that level even further.

The illustrated incinerators, in achieving substantially complete combustion, avoid the production of carbon monoxide. Measurements on the exhaust show a level of carbon monoxide of less than about 10 parts per million corrected to 50% excess air. The actual production rate may have actually been less than that. In comparison, the State of Illinois Air Pollution Control Board at one time considered a standard to implement the Federal Clean Air Act of 1970. The Board then contemplated a maximum carbon monoxide level of 500 parts per million. The incinerators described above produce less than 1/50 of that amount of carbon monoxide.

The hydrocarbon content of the exhaust fumes also remains below a level of about 10 ppm. Incinerators do not yet have a specific standard for hydrocarbon content. The present standard only concerns the production of smoke, which may result, inter alia, from an excessive hydrocarbon content.

The residence time of the material from the main chamber and the low gas velocities there insure the complete burning of particles of combustible material in the reburn tunnels. For the usual bulk municipal refuse, the exhaust generally contains no more than about 0.08 grains of particulate matter per standard cubic foot of gas, corrected to contain 12% carbon dioxide.

Various conditions, of course, can cause the incinerator to exceed that level. For example, if the refuse contains more than 2% by weight of chlorine, the exhaust will carry more particulate matter. This results from the fact that chlorine acts as a scavenger. Consequently, it combines with other materials found either in the ash fraction or with the ash residues on the walls and the flues in the main chamber. When it does so, various oxides, normally stable at the furnace temperatures, convert to a vaporous chloride. After the incineration process, these chloride vapors, when the gases cool, condense and appear as particulate matter.

Further, various inert inorganic ingredients not normally found in quantity in the average municipal wastes, can also vaporize at the main chamber temperatures. The discussion of paint pigments above gives an example of this phenomenon. When the exhaust gases of the system cool, these inorganics condense into polluting particulate matter. For waste containing either the chlorine or the inorganic material vaporizing at low temperatures, modifications to the design of the system or the operating parameters can often avoid the deleterious production of particulate pollutants.

Optimizing the conditions of combustion in the main chamber and the two reburn tunnels, of course, cannot suffice to remove all possible pollutants; the very nature of some components will cause them to remain in the gas stream in an undesirable form. For example, chlorine and sulfur oxides will remain regardless of the conditions achieved in the three combustion stages; they do not undergo burning to a "safe" material. Their removal requires further equipment downstream of the third stage. In the incinerator shown in FIG. 14, as discussed below, the scrubber 194 serves the specific purpose of removing free chlorine and chlorine salts.

Turning to FIG. 17, the gases in the system as shown, depart from third stage 186 and enter the T section 412. In normal operation, the gases from the T 412 pass downward through the lower section 413 of the stack 187. To assure that the gases pass in this direction, the cupola cap covers 189 remain closed and block the opening 190 from the upper portion 415 of the stack 187; both covers close (rather than one being shut and the other open as indicated in FIGS. 14 and 17). Furthermore, to assist the downward passage of gases through the lower stack section 413, the induced draft fan 196 pulls the gases through the boiler-convection unit 191 shown in FIGS. 14 and 18.

As stated above, with regards to FIG. 14, the cooled gases, after passing through the boiler 191, may return via the conduit 200 to the stack 187. Specifically, in this fourth stage the cooler gases mix with and cool the fluid departing the third chamber 186. In particular, the returning gases enter the lower stack section 413 below the T section 412.

The lower stack section 413, when used as a fourth stage, has a construction similar to the second and third stages 185 and 186 to introduce the recycled gas. This, of course, includes a double-wall plenum feeding rings of jets. The jets, opening into the stack section 413, may fall in staggered rings of eight with 45° separating adjacent jets on a ring.

The use of a fourth stage at the lower stack section 413 can also benefit the operation of the third stage 186. The cooling thus effected allows the third stage to operate at a substantially elevated temperature. Thus, the third stage may well operate at temperatures up to 2,000° F. and more effectively complete the combustion process in the gases passing through. It also increases boiler efficiency since it introduces smaller amounts of excess air. The increased temperature also assists in stripping chlorine off of banded hydrocarbons. To achieve this temperature, the third stage thermocouple 403 may have an upper set point of 2,000° F.

Instead of recycled gases, the fourth stage may employ an added fluid to cool the gases. Water in liquid form has a high heat capacity and will absorb substantial heat.

Ambient air and steam can accomplish the same result. However, lacking the latent heat of vaporization of water introduced at a temperature below 212° F., only through the introduction of greater amounts of these fluids can the same results be achieved. Thus, air and steam, although effective, perform with less efficiency.

Recirculating the gases from the stack, however, avoids the necessity of introducing external air or other media to lower the temperature of the gases in the boiler section 191. The ambient air, for example, could enter at either the third chamber 186 or the lower stack section 413. In either event, however, adding the excess cold air involves the loss of the amount of heat required to bring the added air up to the temperature of the boiler 191. The boiler efficiency accordingly suffers. In particular, nitrogen, a 79 percent constituent of air remains inert during the combustion, yet becomes heated, and merely escapes as flue gas from the stack.

The boiler 191, of course, cannot recover the heat required to bring the excess cold air up to the boiler temperature. However, the gas from the stack already exists at the boiler's slightly elevated temperature. Most of the heat captured by the gas recirculated from the stack will, accordingly, be recovered by the boiler 191. As a consequence, recirculating the stack gas to cool the combustion gases leaving the third stage avoids the waste entailed by the use of external excess cold air for the same purpose.

An economizer can further reduce the heat loss from the stack. However, in burning wastes with high chlorine content, hydrogen chloride can condense and attach to the metal of the economizer if its skin temperature falls below the dew point. Thus, economics dictate the final selection of a full, a partial, or no economizer.

The gases, after traveling downward through the lower stack section 413, pass through the entry 414 of the water-tube boiler-convection section 191. While in the boiler 191, they flow from the lower plenum area 416, across the lower section of water tubes 417, and into the middle plenum 418. The gases then pass across the upper tube section 419 to the upper plenum 420. The baffle 423 insures that the gases move along this path and prevents their direct travel from the lower plenum 416 to the upper plenum 420.

From the upper plenum, the gases move through the breaching connection 427 and then either to the atmosphere or, if required, to a collector device such as the scrubber 194 of FIG. 14, a bag house or a precipitator. In the latter instance, they would, after treatment, enter the atmosphere.

The boiler-convection section 191 has, as a boiler, a conventional water drum 431 which passes water through the lower tube section 417, the upper tube section 419 and then to the steam drum 283. The natural circulation provided by the heat imparted to the water assures this flow of water without the necessity of auxiliary pumps. In the steam chamber 283, the steam moves to the upper portion of the drum 283 while the water falls to the lower portion and can return via the conduit 433 to the water drum 431. The produced steam leaves the drum 283 through the pipe 435.

The tube sections 417 and 419 may have either bare or fin tubes. When using the latter, they may also include the sootblowers 447 which impel air or steam across the tube sections 417 and 419 to dislodge any adhered material. Further the boiler 191 may take the form of a fire tube unit or coil-tube forced circulation boiler instead of the water tube equipment seen in the drawings.

The outer wall of the boiler-convection section 191 has the inner layer of refractory 441, the intermediate layer of insulation 442, and the outer skin 443. The channel stiffeners 444 provide strength to the outer wall 443.

As discussed above, the induced draft fan 196 pulls the air across the lower and upper tube sections 417 and 419 to compensate for the pressure drop that occurs there. The I.D. Fan 196 responds to a pressure transducer located near the exit of the third stage 186. The transducer measures the static pressure and controls the I.D. fan's operation to maintain a desired pressure.

Locating the transducer at the end of the third chamber allows it to compensate for air introduced in any of the chambers 182, 185 or 186. This it could not do if located in the first chamber. In the latter case, the additional introduced air could increase the velocity in the reburn tunnels to unacceptable levels. As a result, the gases would not remain there for a sufficient period of time to complete combustion. Locating the transducer at the exit of the third stage avoids this undesirable result. Conveniently, the I.D. fan maintains a velocity of about 40 feet per second at the exit of the third stage.

In the incinerator-boiler of FIGS. 14 to 20, heat is obtained from the main chamber 182 and the boiler 191. In other words, the refuse begins its combustion in the first stage 82 where it provides some heat for other purposes. The gases then enter the second and third stages where no heat recovery occurs. After the third stage, they then travel to the boiler for further heat recovery.

The recovery of heat, thus, does not constitute a process occurring at all stages of combustion. Nor, could it efficiently do so. In the main chamber, an exothermic reaction typically takes place; however, endothermic reactions can occur with plastic and rubber waste. The initial burning of the refuse thus normally produces excess heat. In the second stage, volatilized combustibles require additional heat to reach their combustion temperature. The system often requires auxiliary fuel at the burner 397 to maintain acceptable burning conditions. Clearly, there is not recoverable excess heat at this stage. Similarly, the third stage may require all the available heat to allow combustion to proceed to completion.

After the third stage, the burning has run its course. The heat is no longer required to support combustion. At this point, the gases may safely give up this heat content to the second heat recovery unit, the boiler 191.

Should a malfunction occur downstream of the stack section 187, the cupola caps 189 may open to direct to vent the combustion gases to the atmosphere. This avoids damaging the components and also precludes smoke from entering the surrounding area and possibly injuring the operating personnel.

As shown in FIG. 17, the cupola caps 189 rotate about the pivot point 451. Normally, the combination of the weights 452 and the lever arms 453 keep the cupola caps 189 open. Closing them requires the positive action of the air cylinders 454 to extend the cylinder rods 455. When this occurs, the cupola caps 189 close.

The chart shown in FIGS. 21*a* and 21*b* diagrams the operation of the various components of the incinerator through the several stages of its operation. It illustrates the operations of the incinerator under the varying conditions that it encounters.

Several items on the chart include associated detectors and alarms. For example, the burners have flame safety detectors and alarms. For the system to operate, these detectors must indicate that the burner actually has a flame. Otherwise, an alarm will notify the operator that the system requires attention.

Moreover, for some types of malfunction, the incinerator may shut down completely. For example, the combustion air blowers and the blowers for the burners have associated pressure switches. When the indicated blowers should normally operate at a particular time, these detectors must indicate that they, in fact, do so. All of this represents standard technology associated with burners, blowers, and the like.

Rows I to XXV describe various stages in the operation of the system. Specifically, rows I to IV illustrate the initial start-up of the system. Rows IV to XII describe the normal operational modes of the system. The normal and abnormal partial and complete shutdown modes of the system appear in rows XIII to XXV.

Column A labels the various modes of operation that each of the rows describes. Columns B to V indicate the conditions of various operating components in the different modes of operation.

In the charts of FIGS. 21*a* and 21*b*, the letter "X" indicates an indeterminate setting of a controller or detection by a transducer. In other words, the mode of operation discussed on a particular row does not depend upon the particular setting or condition of the component having an "X" in its column. Similarly, a blank space simply means "off". Lastly, the letter "N" signifies a normal condition for the safety interlocks contained in columns B to J. "A.F." indicates that the boiler-convection unit 191 must have an air flow through it.

As discussed above, rows I to IV in FIG. 21A briefly relate the conditions of operation of the incinerator-boiler during the commencement of its operation. In particular, row IV shows the condition of the system as it just arrives at operational status. At this point, the temperature of the second stage has reached its first set point. This indicates that the main chamber and the second stage have become sufficiently hot to effectuate the combustion of refuse placed in the former. Accordingly, the fuel for the ignition burner at this point turns on in order to ignite the first load of refuse. Also, the loader begins operation and can move the refuse into the main chamber to start the combustion process.

Rows V to XII show the operation of the incinerator-boiler under different, albeit normal, operating conditions. These conditions specifically refer to the temperatures reaching various set points as determined by the thermocouples 461, 393, 396, and 403. These rows correspond to the various conditions seen in FIG. 9 for the incinerator of FIGS. 1 to 13. As discussed above, the actual temperatures of the set points for the two systems vary due to the placement of the thermocouples, the nature of the particular refuse, as well as other factors. The general principles, of course, remain the same. The changes in the system's operation relative to the different temperature set points for the incinerator of FIGS. 14 to 20 appear in columns O to S of FIG. 21*a*.

Row IX illustrates an operational condition not seen for the system set forth in FIGS. 1 through 13. This row refers to the temperature determined by the thermocouple 396 at stage $2\frac{1}{2}$ lying above its first set point but below its second set point. Between the two set points, the fuel for the second stage burner 397 does not assume either of its two extreme values. Rather, it proportionates between the highest fuel setting, which it has at and below the lower set point, and the low setting, which it assumes at the higher set point.

As discussed above, the second stage 185 must maintain a temperature that assures the complete combustion of the hydrocarbons passing through it. At the lower set point, the second stage burner 397 must operate at maximum in order to maintain the temperature. Above the second, or higher, set point, the fuel valve in the second stage burner 397 goes to its lowest setting; the combustion of the hydrocarbons passing through maintains the required temperature. Between these two values, the amount of fuel varies from its high setting to its low setting as the temperature varies between the lower and the higher set points.

Rows XIII through XXV of FIG. 21*b* illustrate the system's operation in its various shutdown modes. Row XIII sets forth the events that occur when the operator hits the "emergency" (or "panic") switch. As indicated there, all components simply turn off.

Rows XIV to XVIII give the various modes of an automatic and complete shutdown of the system. The reasons for the various shutdowns appear on the different lines XIV through XVIII. The condition discussed on each line represents a sufficiently anomalous and undesired situation to require the complete termination of the system's operation.

Other anomalous conditions may allow the incinerator-boiler to operate, but not in its usual fashion. When any of these situations, given in rows XIX through XXII, occur, the system can still operate, but only in an abnormal manner. Under any of these conditions, for example, the cupola caps 189 open. As a result, none of the exhaust gases will pass to the boiler 191. However, notwithstanding these limitations, the incincerator, provided other problems do not interfere, can still accept and burn refuse.

The normal method of shutting the system down appears in rows XXIII through XXV. In step 1 of the normal shutdown, seen in row XXIII, the loader turns off to preclude the introduction of any refuse into the incinerator. The refuse already in the incinerator, of course, must complete its combustion. As the refuse in the main chamber 182 becomes depleted through its combustion, the fuel and the air for the oil burner 257 in the main combustion chamber 182 must turn on. The burner 257 then maintains the main chamber at a sufficiently high temperature to assure satisfactory combustion. Furthermore, corrosive materials have the opportunity to vaporize from the residue. This helps avoid the acid corrosion of both the radiant wall tubes 273 and the water tubes 417 and 419 in the boiler 191.

The system remains in step 1 of the normal shutdown for a period of time determined by a first timer. It then enters step 2 of the normal shutdown shown on row XXIV. At this point, the fuel and air to the first stage oil burner 257 turn off, as does the air to the ignition burner 252. The blowers 299, 381, and 401 in the first, second, and third stages, respectively, remain on to purge the system of any remaining gaseous combustion products.

The second stage of the normal shutdown lasts for a period of time determined by a second timer. After that, the system enters its third step of shutdown shown on row XXV in which the system has actually turned off.

The flow diagrams of FIGS. 22*a* to 22*h* show the various steps in the operation of the incinerator boiler system of FIGS. 14 TO 21. A controller such as the Texas Instrument 5TI-103 Control System and Sequencer may provide the direction required for the proper sequential operation of the systems' components.

In FIGS. 22*a* to 22h, a rectangular box gives a logical step in the system's operation. A pentagonal box indicates that the succeeding step follows automatically. The circular shape, like the circles 473 and 490, indicate switches that the operator must manually set. The diamond shape, as usual, indicates a decision point in either the program or the control of the system.

The operation of the system diagrammed in FIGS. 22*a* to 22*h* commences with the operator turning on the main power switch at the circle 473. The bulb 474 then lights to indicate that the system, in fact, receives power. Various other components also receive electricity; the power turns on for the alarm system at the box 475, the fan actuators at the box 476, the ignition burner fan at the box 477, and for the temperature controllers at the box 478.

Two subsidiary panels have on-off switches located on the main panel and controlling their power. Thus, the switch 482 provides power to the stage 2 burner as shown in the box 483. The light 484 on the main panel shows the receipt of power by the stage 2 burner panel through the switch 482. Similarly, the oil burner for stage 1, as shown in the box 485, receives its power through the switch 486. The light 487 on the main panel shows that the switch 486 occupies the position in which it supplies power to the oil burnerin the main combustion chamber.

As the next step in starting the system, the operator switches on the power to the waste-loading panel shown at the circle 490. The light 491 indicates that this panel has obtained electricity.

The power from the loader panel first goes to the transducer which determines the level of the water in the ash pit as shown at the box 492. The light 493 goes on when sufficient water sits within the pit. The power from the loader panel also goes to the ash remover equipment as shown in the box 494.

Power from the loader panel also runs the air compressor as shown at the box 495. The pneumatic force produced by this component helps operate the cupola caps, as shown at the box 496, the hopper lid, shown at the box 497, and the moving floor components shown at the box 498. The moving floor, however, also requires electrical power directly from the loader panel itself.

The arrow on the right side of the box 495 indicates that the operation diagrammed after it occurs automatically. Thus, the operation of the air compressor at the box 495 automatically provides pneumatic pressure to the boxes 496 to 498.

The operator, at the box 502, should check the set points on the temperature controllers in the three combustion stages. Normally, these points do not change over substantial periods of time. However, the operator should make sure that no mishap has accidentally altered their settings.

The operator also decides whether the main combustion chamber will receive its fuel from refuse or from fuel oil. Typically, the equipment starts up to operate upon waste. Accordingly, the operator places the steam production selector switch to the waste mode at the circle 503. The note box 504 indicates that the system cannot start up if in the mode to employ petro-gas as the fuel. It must run in the fuel oil mode or waste mode in order to commence operation.

The operator next places the cupola cap selector in the automatic mode as seen in the circle 507. When the system first starts up, as seen in the note box 508, the cupola cap should remain open with the selector in the auto mode; the system does not yet operate. Alternatively, if the cupola caps have occupied their closed configuration, they should, at the circle 507, open. As indicated, the operation of the cupola caps does require pneumatic pressure, shown at the box 496, from the operation of the air compressor at the box 495.

The diamond 509 next asks whether the cupola caps, in fact, have moved or remained, as appropriate, in the open position. It not, they may, as one possibility, occupy their closed configuration which the light 510 would indicate. Alternatively, the lighting of the bulb 511 would show that the caps remain partially open. This could result from either situation of both caps occupying a position between their open and closed configurations or one cap opening while the other one remains closed.

In either unacceptable event, the diamond 512 asks whether, in fact, the cap selector has been placed in the auto mode. It not, the program returns to the circle 507 where the operator should place the cap selector in its proper position.

However, if the diamond 512 finds the cap selector in the auto mode, then the operator must check the overall condition of the caps at box 513. This includes checking the condition of the air compressor at the box 495 and the cupola cap equipment at the box 496. At some point in the proper operation of the system, the cupola caps will, in fact, open. This allows the scheme to progress to the circle 516 on FIG. 22*b*. The operator pushes the button shown there to start the warm-up sequence of the equipment. The light 517 indicates when the sequence has begun.

The warm-up beings by purging the three combustion chambers of their gaseous contents, shown at the box 518 and by the light 519. The purging of the chambers removes any volatile components that may have accumulated there during the time the system did not operate. The purging includes operating the blowers for both halves of the main combustion chamber, the second stage, and the third stage. All of these blowers, during this process, operate at their high volumes, as shown respectively by the boxes 520 to 523 and the lights 524 and 527.

Further, upon the initiation of the starting sequence, the operator pushes the start button for the scrubber pump as shown in the circle 530. The note box 531 indicates that the scrubber pump must operate before the induced draft fan will run. In other words, the system will not allow the induced draft fan gases to pass through the scrubber unless the scrubber pump provides the scrubber fluids necessary for cleaning those gases.

Eventually, as shown by the box 533, the combustion stages will complete their purge of gaseous material. However, the program specifically requires that the purge continue for at least the indicated preset period of time. Thus, when the operator presses the sequence start button at the circle 516, the purge timer keeps track of the purge's duration as shown at the box 534. When the purge has lasted at least five minutes as shown at the box 535, the system will consider the purge as completed, and the light 536 in the box 533 will then turn on.

The operator then pushes the button to start the induced draft fan shown n the circle 539. The diamond 540 asks whether the fan has actually started to operate. If not, the operator must physically check the scrubber pump shown at the box 541 and the operation of the induced draft fan shown at the box 542. As indicated by the box 543, the malfunctioning of the induced draft fan may have resulted from attempting to start it prior to the expiration of the required purging time for the combustion chambers.

When the induced draft fan starts to operate, the program goes to the box 547 where the cupola caps start to close. The light 548 indicates the commencement of this operation while the diamond 549 asks whether it has reached completion. If not, the operator must check various components. These include the water level within the boiler, the boiler steam pressure, the functioning of the draft alarm, the motor panel electricity, and the air compressor. All of these appear in the box 550.

When the cupola caps actually close, the light 551 turns on and the convection section starts to purge itself of gaseous contents as shown at the box 554. The light 555 on the panel comes on to indicate that the sequence has reached this stage.

The second purge timer then begins running as shown in the box 556. When the second purge timer, as the box 557, shows that five preset period, specifically, minutes have elapsed, the convection section has completed its purge, at the box 558, and turns on the light 559.

The burner 397 in the second stage reburn tunnel then starts to purge itself for 90 seconds; its fan blows in fresh air. After this period, its ignition commences as shown at the box 561. The bulbs 562 then light in sequence to indicate the completion of the various steps in the ignition of the burner 397. At this stage, the diamond 563 verifies the existence of the flame for the second stage burner 397.

If the burner 397, however, lacks a flame, then the sequence moves to the box 564 which starts the entire process over again. To do so, the program returns to the box 518 of FIG. 22*b* which recommences the entire ignition sequence by purging the three burning stages. As discussed above, the program returns to the box 518 whenever necessary to commence an ignition process.

If the second stage burner 397 has a flame, then the program at the box 566 allows the second stage tunnel 185 to warm up to its operating temperature. The diamond 567 then asks whether the temperature of the second stage reburn tunnel has reached its lower set point. If not, the program waits at the box 566 for this event to occur.

When the second stage reaches its operating temperature, the light 568 turns on. The program then travels to the box 570 in FIG. 22*d* where the main combustion chamber begins its warming process. To accomplish this step, the operator turns the oil burner selector switch to its "on" position at the circle 571. In response, the oil burner 257 undergoes a 90 second air purge and then undergoes its ignition sequence as stated at the box 572. The lights 573 turn on upon the completion of various stages of that sequence.

The diamond 575 then asks whether the oil burner 275 in fact produced a flame. If not, the box 576 requires the complete ignition sequence for the entire system to begin anew; the system does not simply permit the oil burner 257 to attempt another ignition. The program would then return to the box 518 in FIG. 22*b*. The failure of an ignition sequence places combustible gases within the incinerator. As a result, the ignition chambers must purge themselves of all of these gases to allow a controlled, safe ignition.

After the oil burner 257 properly ignites at the diamond 575, it warms the main combustion chamber 182 to its operating temperature as indicated by the box 578. As indicated by the note box 578, the oil burner remains under manual control during the warm-up of the main combustion chamber; the operator slowly opens the burner to gradually heat the chamber. When the main chamber has reached its operating condition, the operator returns the oil burner 257 to its automatic mode.

The diamond 580 asks whether the main combustion chamber 182 has reached its minimal operating temperature established by its lower set point. If not, the program progresses no further than the box 578 until it accomplishes this task. Moreover, the oil burner 257 must remain on for a minimum of five minutes before the program can proceed, as shown by the box 581.

After both the five-minute period and the temperature of the main chamber exceeding its lower set point, the program continues. The box 582 indicates that the three combustion stages as well as the convection section 191 have all warmed up to their operating temperatures. The incinerator may then receive refuse upon which to operate. Accordingly, the diamond 583 asks whether the system has waste upon which to operate. If not, it will travel to FIG. 22*f* to utilize auxiliary fuel as discussed below.

Assuming available waste for the main chamber, the operator turns the oil burner 257 selector switch to its "off" position at the circle 587. At this juncture, the oil burner has served its purpose of warming the main combustion chamber 182 to its operating temperature. Since the system can now operate upon waste, it has no further need for the oil burner. The operator also moves the steam production selector selector switch to the waste mode at the circle 588.

The last burner in the system, the ignition burner 252, must now ignite. To do so, it first underfoes a 90 second air purge and then its sequential ignition shown in the box 589. The bulbs 590 light in their order to indicate that the ignition burner has properly ignited.

The diamond 591 inquires as to the completion of the lighting of the ignition burner 252. Failure of this step places the program at the box 592 which requires the entire ignition sequence for the complete system to begin anew. When this occurs, the program returns to the box 518 in FIG. 22*b*.

However, if the ignition burner 252 has alighted properly, the main combustion chamber 182 begins to receive refuse. Accordingly, the operator places the loader switch to its auto mode in the circle 596. He then loads refuse into the hopper at the box 597. The diamond 598 then asks whether the loader has become locked out of operation. If so, the bulb 599 turns on; the operator must then check the components shown in the box 600. This includes first looking at the temperature of the third stage. If its temperature exceeds the upper set point, the system has already become too hot. Thus, it should not receive any refuse, the burning of which would increase its temperature even further.

Furthermore, if the boiler 283 has lost water; the steam pressure has become too high; or the moving floor operates improperly, then the lights 601 to 603, respectively, turn on to indicate a problem. Any of these prevents the functioning of the loader. Furthermore, if the air compressor at the box 495 fails to operate, the loader lacks the necessary power to function.

Similarly, a serious lack of induced draft will cause the draft sensor after the third stage 186 to fall below its second set point. This indicates a substantial, if not complete, blockage of the system or the inoperation of the induced draft fan. Either event causes the light 604 to turn on. It also prevents the loader from the placing refuse into the main combustion chamber 182.

Lastly, the loader panel may simply not have received electrical power. Obviously, this will also keep the loader from operating.

Alternatively, the loader may not be locked out. Or, the operator may have repaired whatever problem caused the lock-out condition to allow the program to proceed. As a result, the operator then pushes the button at the circle 608 to start the loading cycle. The light 609 turns on to indicate that the operator has actuated the loading switch. The loader at the box 610 cycles, and the light 611 turns on while the loader operates.

The diamond 612 asks if the loader has jammed during its operation. If the loader has jammed, the light 615 turns on and the program proceeds to FIG. 22*g*, discussed below, to cure the problem.

If the loader does not jam, it loads refuse into the main combustion chamber 182 for burning. The diamond 616 then enquires as to whether additional waste must undergo burning. If so, the operator then loads it at the box 597, and the program moves and burns if following the steps outlined above.

If, at the diamond 616, no further refuse awaits combustion, then the incinerator must burn auxiliary fuel to provide heat to its boiler and convection units. Accordingly, the program travels to the diamond 617 which asks whether the system will utilize auxiliary fuel to produce steam. The program also reaches the diamond 617 from the diamond 583. This enquired as to the original availability of waste material for burning prior to the loading of any waste into the main chamber 182.

Figure 22A:
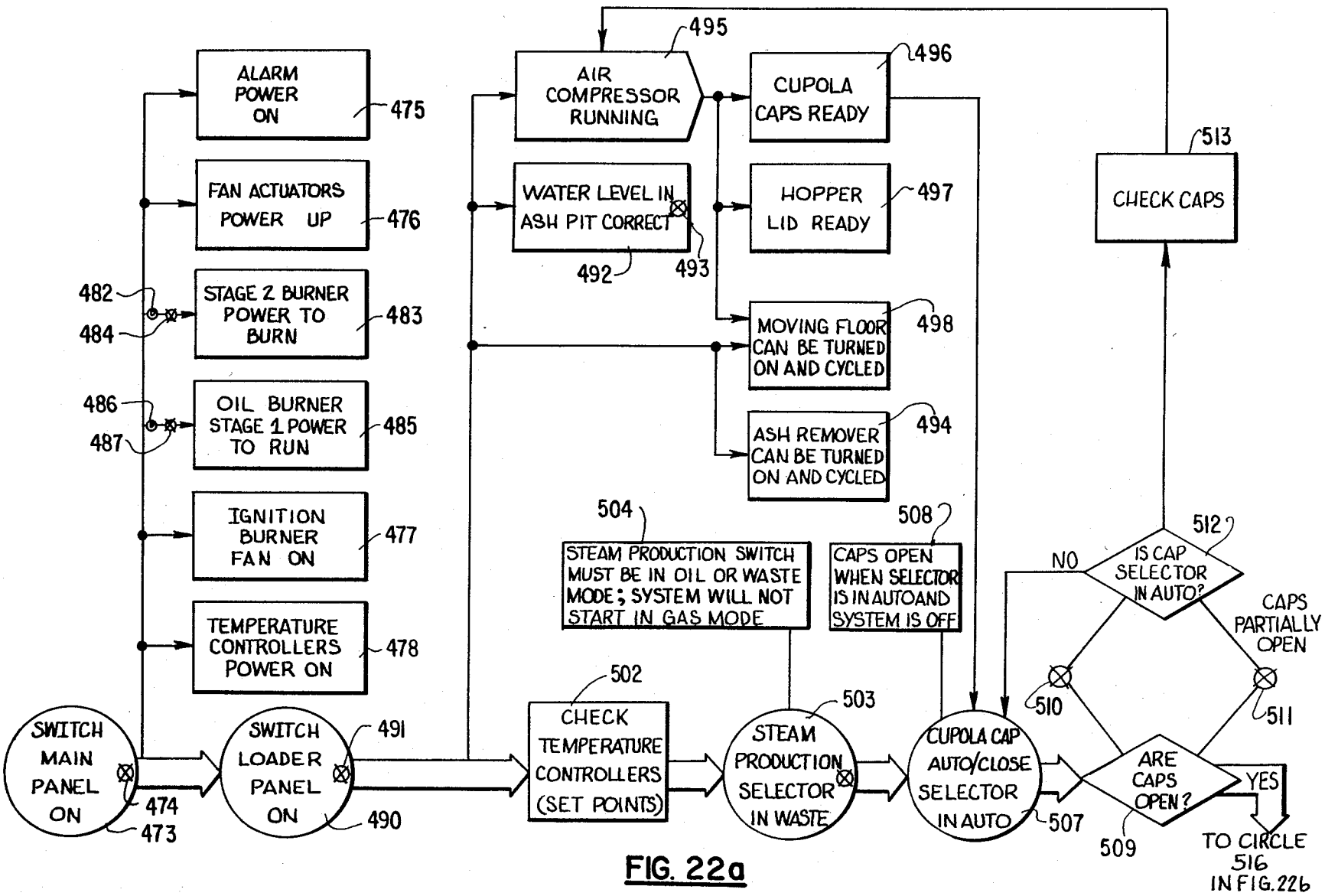
FIGS. 22*a* through 22*h* give a flow diagram for the operation employing a programmable controller of the incinerator-boiler system shown in FIGS. 14 through 20.
Figure 22B:
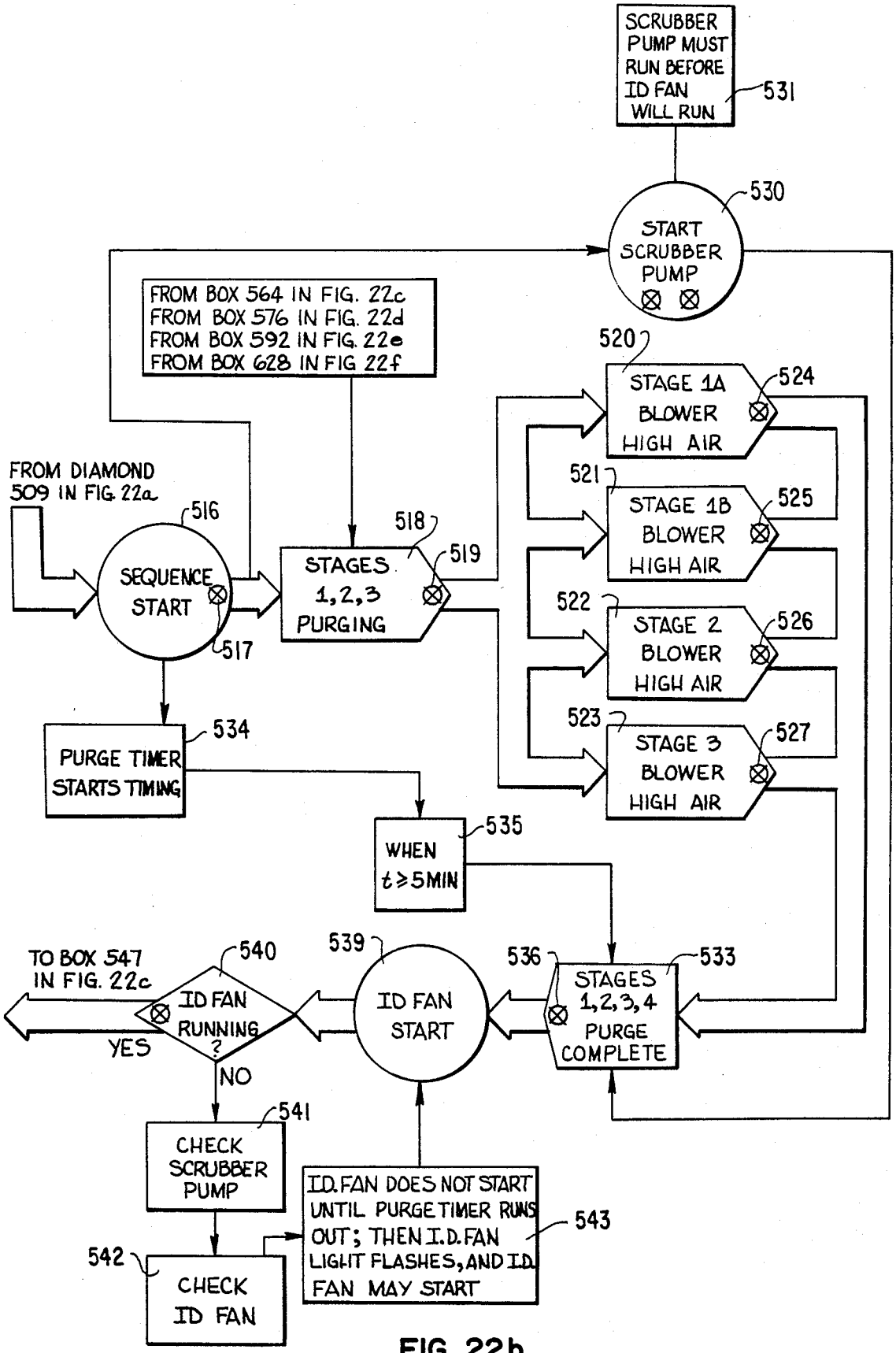
Figure 22C:
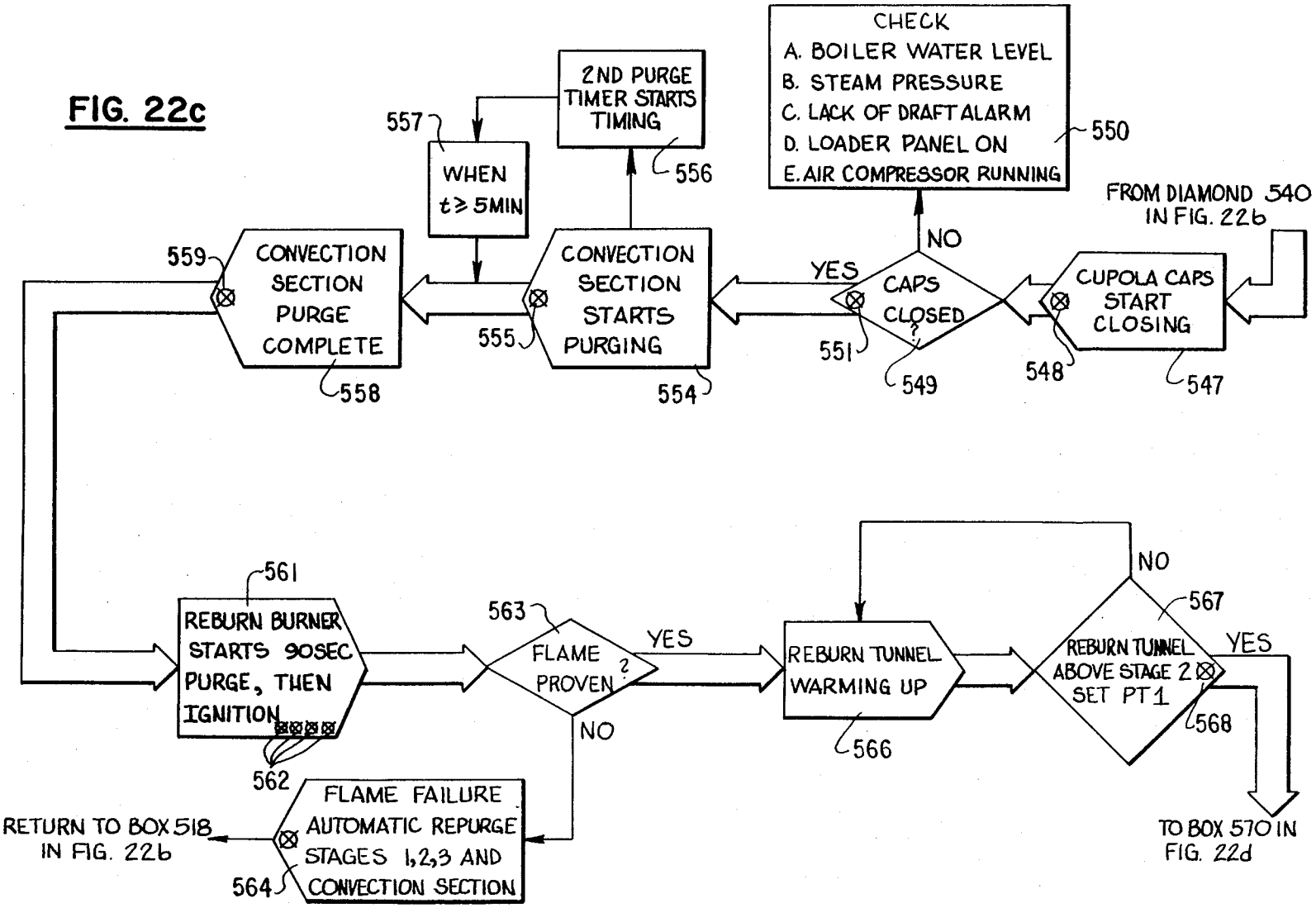
Figure 22D:
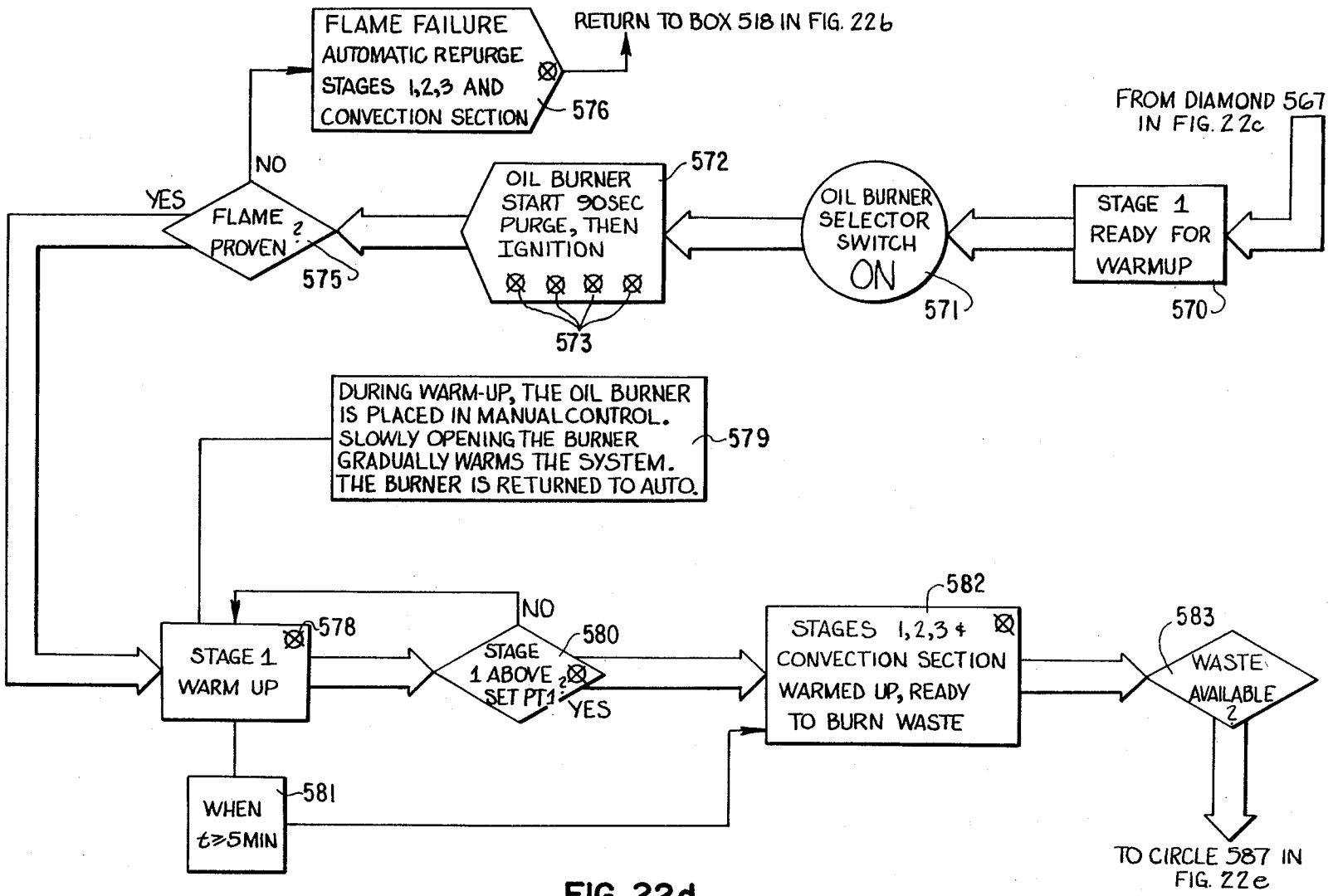
Figure 22E:
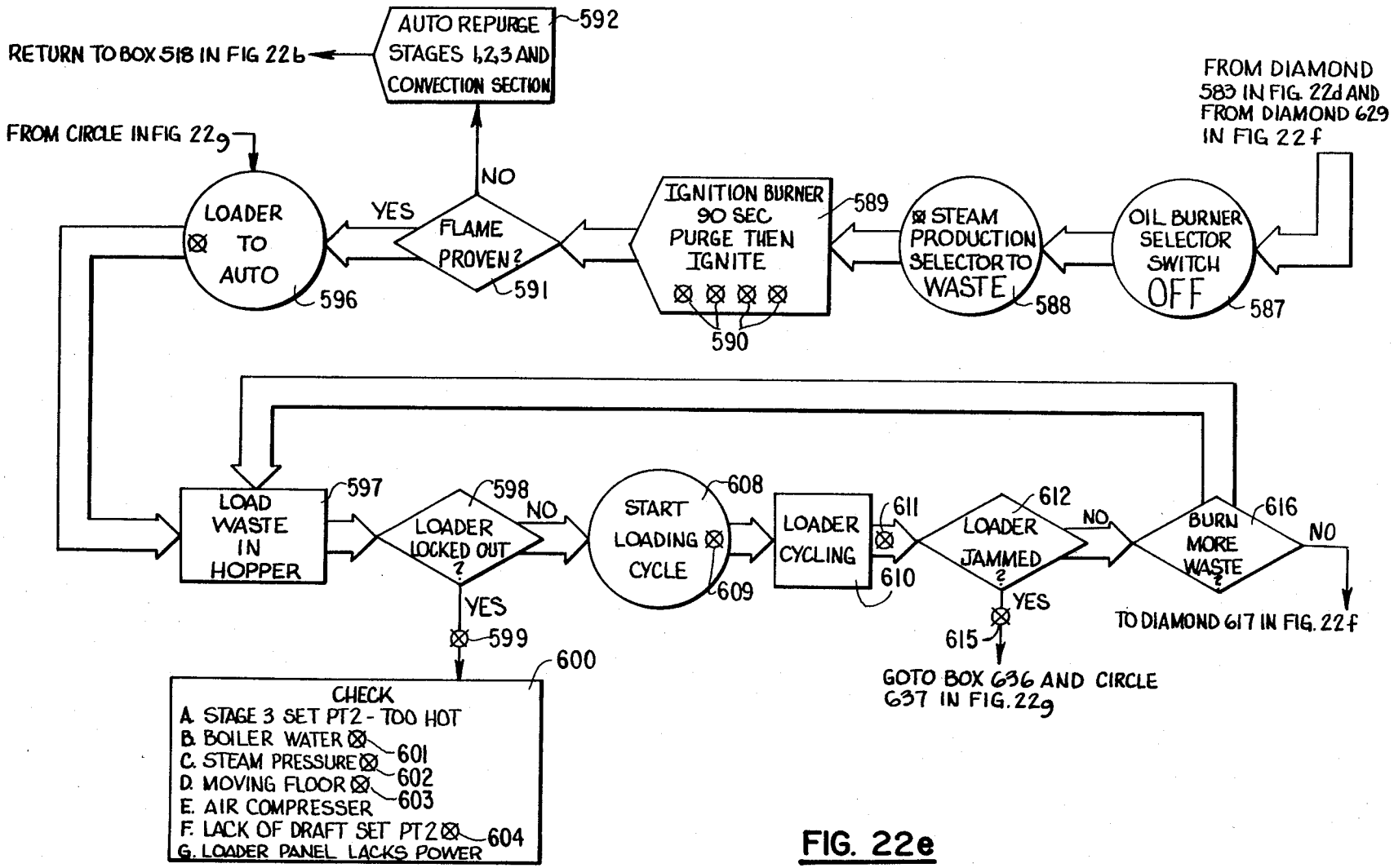
Figure 22F:
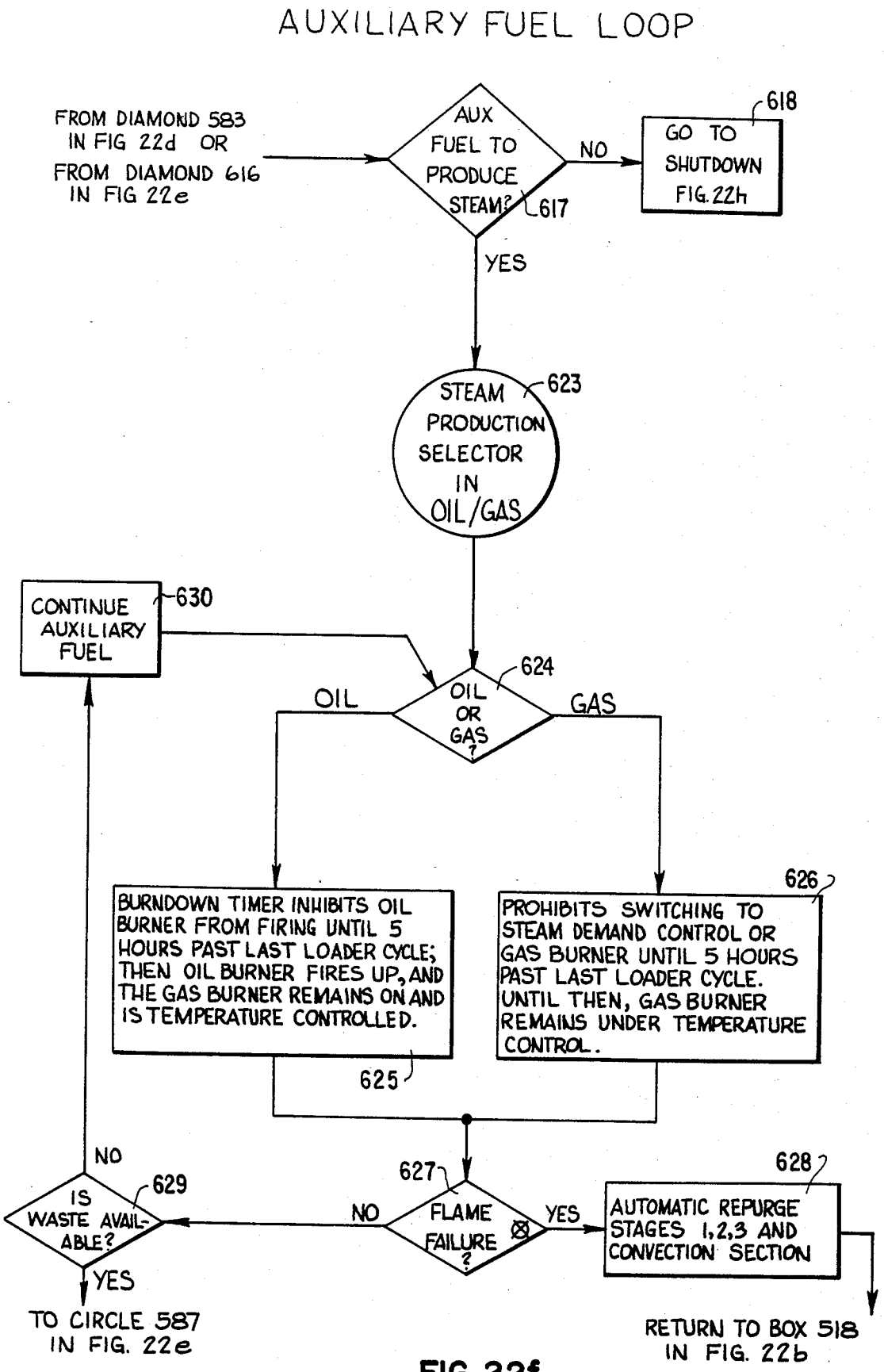
Figure 22G:
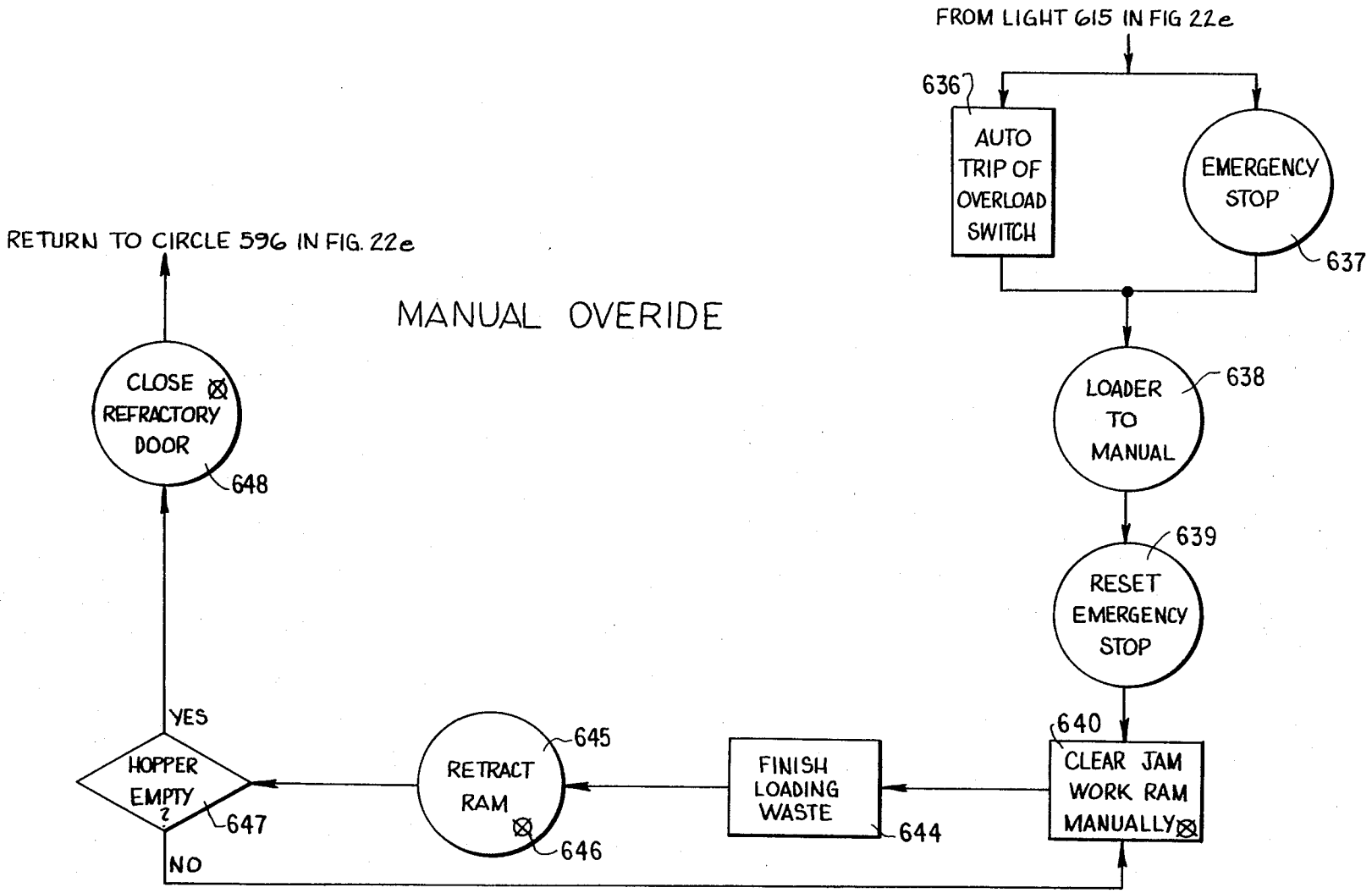
Figure 22H:
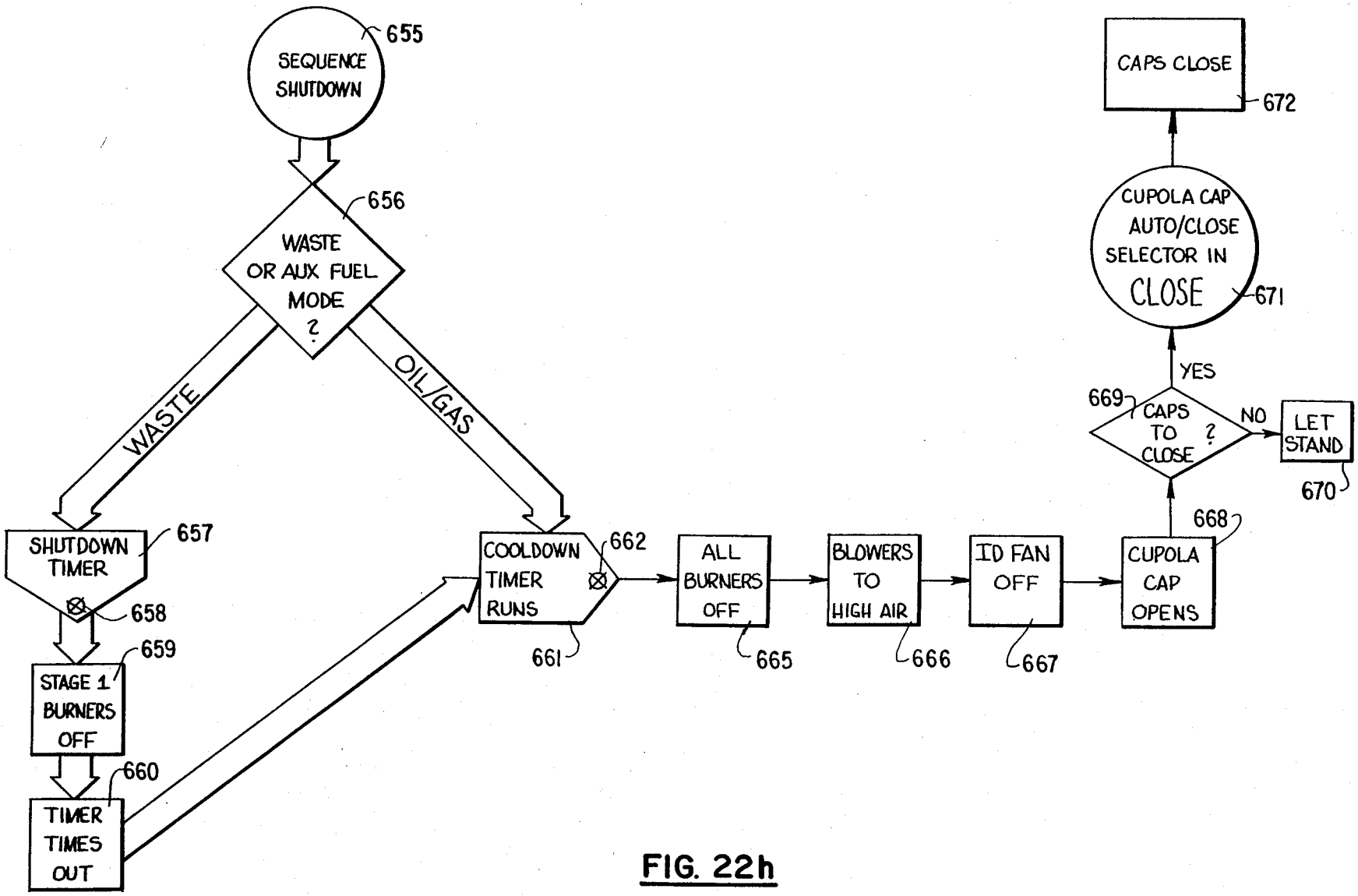

If, at the diamond 617, the operator decides not to use auxiliary fuel, the program travels to the box 618; the system shuts down according to the routine shown in FIG. 22*h*.

However, to utilize auxiliary fuel, the operator places the steam production selector switch in either its oil or gas mode at the circle 623. The diamond 624 then asks which of these two modes the operator has actually selected.

For oil, the program travels to the box 625. A delay of five hours must intervene after the last cycle of the loader before the system will operate fully upon fuel oil. This permits the complete combustion of any refuse placed within the main combustion chamber 182. After that time, the oil burner 257 may ignite. It then operates to the extent required to maintain the appropriate temperature within the main combustion chamber.

Similarly, if the operator selects natural gas as the fuel, the program travels to the box 626. This causes the gas burner 397 in the second combustion stage 185 to provide all of the heat required for steam production.

However, the gas burner 185 normally remains in operation to control the temperature of the second stage. Accordingly, it will not turn off for the period of five hours after the last cycle of the loader. Rather, for this five hour period, the burner 397 operates in the fashion discussed above to maintain the proper temperature of the second combustion stage.

After the passage of those five hours, the control of the gas burner 397 changes to meet the demand for steam. In other words, the second stage burner 397 receives sufficient gas to produce the amount of steam required. When doing so, it deos not attempt to maintain any particular temperature in the second stage 185.

As an alternate arrangement, the auxiliary fuel can operate in conjunction with the refuse to maintain the desired temperatures. This permits the production of the required amount of steam without interruption.

During the production of steam by either the oil burner 257 or the gas burner 397, the program at the diamond 627 asks whether flame failure may have occurred in the operation burner. If that has happened, the program goes to the box 628. A complete repurging of all combustion chambers then occurs, and then the ignition must start over from the beginning at the box 518 in FIG. 22*b*.

The program stands ready to permit the introduction of further waste into the main combustion chamber 182. Accordingly, it asks, at the diamond 629, whether such material has become available. If not, the box 620 permits the continued operation of the oil or gas burner, as appropriate, to produce the needed steam. If the incinerator should burn refuse, the program returns to the circle 587 to allow its use.

As discussed above at the diamond 612 in FIG. 22*e*, the loader can become jammed for a variety of reasons. Should this occur, the light 615 turns on. The program then travels to the box 636 or to the circle 637 in FIG. 22*g*. At the box 636, the jamming of the loader causes the automatic tripping of the overload switch on the loader motor. This, of course, prevents damage to that component. Alternatively, the operator may detect the unsatisfactory performance of the loader and press the emergency stop button at the circle 637.

To permit the further operation of the system in either case, the operator moves the loader switch to manual operation at the circle 638. He also resets the emergency stop button, if necessary, at the circle 639. He should then clear whatever caused the jam in the loader and work the ram manually at the box 640. This allows him to finish loading the waste into the main combustion chamber as shown at the box 644.

At the circle 645, the operator retracts the loading ram. The bulb 646 lights to indicate the completion of this task. At the diamond 647, the program asks whether the hopper has emptied. If not, the operator must repeat the steps from the box 640 to clear the hopper. When he has done so, he closes the refractory door at the circle 648 to allow the main combustion chamber to devour the loaded waste. The program then returns to the circle 596 in FIG. 22*d* where the operator returns the operation of the loader to the automatic mode for its normal operation.

On occasion, the entire system should shut down. The operator begins this process by pushing the shut-down button at the circle 655 in FIG. 22*h*. The diamond 656 asks whether the combustion chambers had operated upon waste or an auxiliary fuel. If using waste, the program proceeds to the box 657 which starts the shut-down timer. The bulb 658 turns on to indicate this phase of the shut-down procedure. The shut-down timer runs for a sufficient period to allow all of the refuse in the main chamber 182 to burn. Also during this time, the stage one burners turn off, as indicated by the box 659.

Eventually, the shut-down timer expires at the box 660. The program at the box 661 commences the operation of the cool-down timer. The program reaches the same box 661 directly from the diamond 656 if the system operated upon auxiliary fuel at the beginning of its shut-down.

While the cool-down timer runs, the light 662 turns on. The cool-down timer 661 controls the subsequent sequence of events. This includes turning all system burners off at the box 665. All of the blowers provide the maximum amount of air to all combustion chambers at the box 666. This serves to remove any combustible gaseous material contained in the system.

Subsequently, and still under the control of the cool-down timer, the induced draft fan turns off at the box 667 and the cupola caps open at the box 668. When the cupola caps open, the cool-down timer has run its course. Furthermore, the system has, in fact, completely shut down.

At this juncture, the operator may wish to reclose the cupola cap. He may do this simply to prevent the entrance of precipitation into the stack 187. The diamond 669 asks whether he wishes to do this. If not, the cupola cap remains open as indicated by the box 670. If the operator wants the cupola caps closed, he places the cupola cap selector to "close" at the circle 671. In response, the caps assume their closed configuratiion at the box 672.

Accordingly, what is claimed is:

1. A method of incinerating refuse which comprises:

(A) placing bulk refuse through a first inlet opening into a main incinerator chamber;

(B) burning said bulk refuse to produce gaseous combustion products;

(C) passing the gaseous combustion products out of said main combustion chamber through a first outlet opening and directly into a second inlet opening of a first reburn chamber;

(D) measuring a first temperature within or in near proximity to the interior of said first reburn chamber;

(E) burning, in said first chamber and in proximity to said second inlet opening, an amount of fuel, said amount of fuel being a first amount when said first temperature is above a first predetermined set point and a second amount when said first temperature is below a second prodetermined set point which is not higher than said first set point, said first amount being less than said second amount;

(F) measuring a second temperature within or in near proximity to the interior of said first reburn chamber;

(G) introducing an amount of an oxygen-containing gas into said first reburn chamber through a plurality of jets extending at least about half the distance from said second inlet opening to a second outlet opening through which the gaseous combustion products can egress from said first reburn chamber, said amount of said oxygen-containing gas introduced into said first chamber being a third amount when said second temperature is above a third predetermined set point and a fourth amount when said second temperature is below said third set point, said third amount being greater than said fourth amount;

(H) passing the gaseous combustion products out of said first reburn chamber through said second outlet opening and directly through a third inlet opening into a second reburn chamber;

(I) measuring a third temperature within or in near proximity of the interior of said second reburn chamber;

(J) introducing an amount of an oxygen-containing gas into said second reburn chamber through a plurality of jets extending at least about half the distance from said third inlet opening to a third outlet opening through which the gaseous products of combustion can egress from said second reburn chamber, said amount of said oxygen-containing gas introduced into said second chamber being a fifth amount when said third temperature is above a fourth predetermined set point and a sixth amount when said third temperature is below said fourth set point, said fifth amount being greater than said sixth amount.

2. The method of claim 1 wherein said main chamber includes a fire-resistant hearth floor.

3. The method of claim 2 further including introducing into said main chamber an amount of oxygen-containing gas that contains within 10 percent of the stoichiometric amount required, on a time average basis, for the refuse placed within said main chamber.

4. The method of claim 3 further including maintaining the lift velocity of the gases within said main chamber to below about two feet per second.

5. The method of claim 3 further including maintaining the temperature within the said first and second reburn chambers at at least 1400° F.

6. The method of claim 5 further including maintaining the temperature in said main chamber at about 800° to 1500° F.

7. The method of claim 6 wherein said oxygen-containing gas is passed into said main chamber through nozzles located near the roof of said main chamber and horizontally through nozzles located in said floor horizontally.

8. The method of claim 7 further including measuring a fourth temperature within said main combustion chamber; burning an amount of a fuel in said combustion chamber, said amount of fuel burned in said main chamber being a fifth amount when the said fourth temperature is above a fifth predetermined set point, and a sixth amount when said sixth temperature is below said fifth set point, said sixth amount being greater than said fifth amount.

9. The method of claim 8 wherein said oxygen-containing gas is introduced through said nozzles in said floor with a velocity not exceeding about 150 ft./minute.

10. The method of claim 9 further including measuring a fifth temperature within said second reburn chamber and wherein the amount of said oxygen-containing gas introduced into said main chamber is a seventh amount when said fifth temperature is above a sixth predetermined set point higher than said fourth set point and an eighth amount when said fifth temperature is below said sixth set point.

11. The method of claim 10 further including, when said fifth temperature determined is above said sixth set point, preventing the placing of refuse into said main combustion chamber.

12. The method of claim 11 further including passing a heat exchange medium in proximity to the interior of said main combustion chamber for a sufficient period to heat said exchange medium and then passing said heated exchange medium away from said interior of said main combustion chamber.

13. The method of claim 12 wherein said exchange medium is a first exchange medium, and further including (1) passing said gaseous combustion products out of said third outlet opening and into a fourth inlet opening into a recovery unit and then then out of said recovery unit through a fourth outlet opening; and (2) passing a second exchange medium in proximity to the interior of said recovery unit for a sufficient period to heat said second exchange medium and thereafter removing said second exchange medium from said recovery unit.

14. The method of claim 13 further including preventing the escape of substantial heat from said first and second reburn chambers.

15. The method of claim 11 further including completely surrounding said gaseous products of combustion with said oxygen-containing gas for at least a portion of said first reburn chamber.

16. The method of claim 11 wherein said second, third, and fourth set points are all at least 1500° F.

17. The method of claim 16 wherein said oxygen-containing gas is introduced into said first and second reburn chambers for substantially the entire distance from said second inlet opening to said second outlet opening and from said third inlet opening to said third outlet opening, respectively.

18. The method of claim 17 further including, when said third set point is higher than said second set point and when said first temperature is between said first and second set points, burning in said first reburn unit an amount of fuel that is between said first amount and said second amount.

19. The method of claim 17 further including, when said fifth temperature exceeds a seventh predetermined set point not lower than said fourth set point, stopping the burning of fuel in said first reburn chamber.

20. The method of claim 17 further including passing at times the gaseous combustion products out of said second reburn chamber through said third outlet opening and through a fourth inlet opening into a processing chamber; affecting the condition of the gaseous combustion products within said processing chamber; thereafter, passing the gaseous combustion products out of said processing chamber through a fourth outlet opening; and, at other times, passing the gaseous combustion products out of said second reburn chamber through said third outlet opening directly into the atmosphere.

21. The method of claim 20 further including (1) passing an exchange medium into said processing chamber for a sufficient period to heat said exchange medium and thereafter removing said exchange medium from said processing chamber and (2) adding to said gaseous products of combustion between said third outlet opening and said fourth inlet opening a cooler gas having a temperature lower than the combustion products to which added.

22. The method of claim 21 further including (1) determining the presence of one or more of a predetermined group of improper conditions of operation of said system and (2), when determining that at least one of said predetermined group of improper operating conditions exists, passing the gaseous combustion products out of said second reburn chamber through said third outlet and directly into the atmosphere without otherwise affecting the operation of said main combustion chamber and said first and second reburn chambers.

23. The method of claim 22 further including (1) inducing a flow of gas from said fourth inlet opening through said processing chamber and out said fourth outlet opening; (2) determining the velocity of gases passing through said third outlet opening; and (3), in response to the velocity of the gases passing through said third outlet opening, changing the amount of flow induced from said fourth inlet opening to said fourth outlet opening.

24. A method of burning fumes emanating from the output of a source and containing combustible hydrocarbons with an average number of Btu's per hour comprising:

(A) passing said gaseous combustion products from said outlet directly into a first inlet opening of a first reburn chamber, said first inlet opening having a sufficient cross-sectional area to maintain the heat throughput through said first inlet opening to a level no greater than about 15,000 Btu/sq.ft.hr.;

(B) measuring a first temperature in or in near proximity to the interior of said first reburn chamber;

(C) burning, in said first chamber, in proximity to said first inlet opening, an amount of fuel, said amount of fuel being a first amount when said first temperature is above a first predetermined set point and a second amount when said first temperature is below a second predetermined set point which is not higher than said first set point, said first amount being less than said second amount;

(D) measuring a second temperature within or in near proximity to the interior of said first reburn chamber;

(E) introducing an amount of an oxygen-containing gas into said first reburn chamber through a first plurality of jets extending at least about half the distance from said first inlet opening to a first outlet opening through which the gaseous combustion products can egress from said first reburn chamber, said amount of said oxygen-containing gas introduced into said first chamber being a third amount when said second temperature is above a third predetermined set point and a fourth amount when said second temperature is below said third set point, said third amount being greater than said fourth amount;

(F) passing the gaseous combustion products out of said first reburn chamber through said first outlet opening and directly through a second inlet opening into a second reburn chamber;

(G) measuring a third temperature within or in near proximity to the interior of said second reburn chamber;

(H) introducing an amount of an oxygen-containing gas into said second reburn chamber through a second plurality of jets extending at least about half the distance from said second inlet opening to a second outlet opening through which the gaseous products of combustion can egress from said second reburn chamber, said amount of said oxygen-containing gas introduced into said second chamber being a fifth amount when said third temperature is above a fourth predetermined set point and a sixth amount when said third temperature is below said fourth set point, said fifth amount being greater than said sixth amount.

25. The method of claim 24 wherein said second, third, and fourth predetermined set points are each at least about 1400° F.

26. The incinerator system of claim 25 further including limiting the velocity of said gaseous fluid passing through said inlet opening to about 40 ft./second and the sizes of particles of hydrocarbon material to about 100 microns.

27. The method of claim 26 wherein said second, third, and fourth set points are all at least 1500 F.

28. The method of claim 27 wherein said oxygen-containing gas is passed through said first and second pluralities of jets extending substantially the entire distance from said first inlet opening to said first outlet opening and from said second inlet opening to said second outlet opening, respectively.

29. The method of claim 28 including introducing said oxygen-containing gas into said first and second reburn chambers with sufficient velocity to create substantial turbulence within said first and second reburn chambers.

30. The method of claim 29 further including passing said oxygen-containing gas into said second reburn chamber with a component of motion that is tangential to the outer perimeter of said second reburn chamber.

31. The method of claim 30 further including measuring a fourth temperature in said second reburn chamber, and, when said fourth temperature exceeds a fifth predetermined set point not lower than said fourth set point, stopping the burning of the fuel in said first reburn chamber.

32. The method of claim 30 wherein said fifth set point is higher than said fourth set point.

33. The method of claim 30 further including at times passing the gaseous combustion products out of said second reburn chamber through said second outlet opening and into a processing chamber through a third inlet opening; affecting the condition of the gaseous combustion products within said processing chamber; thereafter passing the gaseous combustion products out of said processing chamber through a fourth outlet opening; and, at other times, passing the gaseous combustion products out of said second reburn chamber through said third outlet opening directly into the atmosphere.

34. The method of claim 33 further including (1) determining the presence of one or more of a predetermined group of improper conditions of operation of said system and (2), when determining that at least one of said predetermined group of improper operating conditions exists, passing the gaseous combustion products out of said third outlet and directly into the atmosphere without otherwise affecting the operation of said first and second reburn chambers.

35. The method of claim 33 further including (1) passing an exchange medium into said processing chamber for a sufficient period to heat said exchange medium and thereafter removing said exchange medium from said processing chamber and (2) adding to said gaseous products of combustion between said third outlet opening and said fourth inlet opening a cooler gas having a temperature lower than the combustion products to which added.

36. The method of claim 33 further including (1) inducing a flow of gas from said fourth inlet opening through said processing chamber and out said fourth outlet opening; (2) determining the velocity of gases passing through said third outlet opening; and (3), in response to the velocity of the gases passing through said third outlet opening, changing the amount of flow induced from said third inlet opening to said third outlet opening.

37. A method of incinerating refuse and recovering heat produced thereby which comprises:

(A) placing bulk refuse through a first inlet opening into a main incinerator chamber;

(B) burning said bulk refuse to produce gaseous combustion products;

(C) passing the gaseous combustion products out of said main combustion chamber through a first outlet opening and directly into a second inlet opening of a reburn unit, said reburn unit including insulating means for preventing the escape of substantial heat from said reburn unit except from a second outlet opening through which the gaseous products of combustion can egress from said reburn unit;

(D) passing a fluid heat-exchange medium in proximity to the burning refuse in said main combustion chamber and thereafter moving said heat-exchange medium away from said main combustion chamber;

(E) burning, in said reburn unit, and in proximity to said second inlet opening, an amount of fuel;

(F) introducing an amount of an oxygen-containing gas into said reburn unit;

(G) passing the gaseous combustion products out of said reburn unit through said second outlet opening and directly through a third inlet opening into a recovery unit;

(H) passing a fluid heat-exchange medium in proximity to the gaseous products of combustion in said recovery unit and thereafter moving said heat-exchange medium away from said recovery unit;

(I) passing the gaseous combustion products out of said recovery unit through a third outlet opening.

38. The method of claim 37 further including burning within said main chamber an auxillary nonrefuse fuel in an amount to supply within said main combustion chamber an average predetermined amount of Btu's.

* * * * *

UNITED STATES PATENT AND TRADEMARK OFFICE

CERTIFICATE OF CORRECTION

PATENT NO. : 4,516,510

DATED : May 14, 1985

INVENTOR(S) : John N. Basic, Sr.

It is certified that error appears in the above-identified patent and that said Letters Patent is hereby corrected as shown below:

Column 46, line 29, Claim 24, change "15,000 Btu/sq.ft.hr." to --15,000 Btu/sq.in.hr.--.

Signed and Sealed this

Twenty-fifth Day of February, 1992

*Attest:*

HARRY F. MANBECK, JR.

*Attesting Officer*

*Commissioner of Patents and Trademarks*